US006179065B1

(12) United States Patent
Payne et al.

(10) Patent No.: US 6,179,065 B1
(45) Date of Patent: Jan. 30, 2001

(54) SYSTEM AND METHOD FOR AUTOMATICALLY CONTROLLING A PIPE HANDLING SYSTEM FOR A HORIZONTAL BORING MACHINE

(75) Inventors: David R. Payne; Cody L. Sewell, both of Perry; Kelvin P. Self, Stillwater; J. Kevin Wilda; David A. Rorabaugh, both of Perry, all of OK (US)

(73) Assignee: The Charles Machine Works, Inc., Perry, OK (US)

( * ) Notice: Under 35 U.S.C. 154(b), the term of this patent shall be extended for 0 days.

(21) Appl. No.: 09/146,123

(22) Filed: Sep. 2, 1998

(51) Int. Cl.[7] ..... E21B 19/14

(52) U.S. Cl. ..... 175/24; 175/52; 175/85; 184/15.2; 414/22.54; 414/22.65

(58) Field of Search ..... 175/24, 52, 61, 175/62, 85, 203; 414/22.51, 22.54, 22.58, 22.63, 22.65, 22.68; 184/6.19, 15.2

(56) References Cited

U.S. PATENT DOCUMENTS

| | | | |
|---|---|---|---|
| Re. 30,071 | 8/1979 | Hilding et al. | 175/52 |
| 3,095,048 | 6/1963 | O'Neil et al. | 175/6 |
| 3,411,596 | 11/1968 | Robbins | 175/85 |

(List continued on next page.)

FOREIGN PATENT DOCUMENTS

| | | | |
|---|---|---|---|
| 1483865 | 1/1970 | (DE) | E21C/9/00 |
| 2018884 | 3/1972 | (DE) | E21B/19/00 |
| 2148357 | 5/1972 | (DE) | E21C/5/00 |
| 0477728 | 4/1992 | (EP) | E21B/19/14 |
| 0565502 | 10/1993 | (EP) | E21B/19/20 |
| 65471 | 1/1984 | (FI) | E21C/9/00 |
| 225859 | 4/1969 | (SE) | E21B/19/00 |
| 1455510 | 11/1976 | (SE) | E21B/19/14 |
| 1737094 | 5/1992 | (SU) | E21B/7/00 |
| 9119885 | 12/1991 | (WO) | E21C/11/00 |

OTHER PUBLICATIONS

H.G. Allen and Paul Scott, "Semi–Automatic Drilling Rig," SPE 1378.

R.J. Bromell, "Automation in Drilling," Oct., 1967, SPE 1842.

D.H. Ward et al., "A Computer–Controlled System for Automated Racking of Pipe on Drilling Vessels," May, 1975, SPE 5460.

J.D. Brugman, "Automated Pipe Handling: A Fresh Approach," Mar., 1987, SPE/IADC 16065.

G.I. Boyadjieff, "The Application of Robotics to the Drilling Process," Feb., 1988, IADC/SPE 17232.

B.J. Kennett and M. Smith, "The Design of an Automated Drilling Rig: RA–D," Mar., 1991, SPE/IADC 21921.

G.I. Boyadjieff and M.A. Merit, "Experiences in Automating Pipe–Handling Functions," Sep., 1992, SPE 21956.

(List continued on next page.)

*Primary Examiner*—William Neuder
(74) *Attorney, Agent, or Firm*—McKinney & Stringer, P.C.

(57) ABSTRACT

An automatic pipe handling system for automatically transporting pipe sections to and from a horizontal boring machine. The system comprises a pipe handling assembly, a pipe lubrication assembly, a makeup/breakout assembly, and an automatic control system. The pipe handling assembly stores pipe sections and transports the pipe sections to and from the drill string of a boring machine. As the pipe handling assembly transports a pipe section, the pipe lubrication assembly lubricates the appropriate pipe joints. The makeup/breakout assembly secures the drill string and pipe joints so that pipe sections can be added to or removed from the drill string. A programmed controller automatically operates the pipe handling system and its components by synchronizing the operations of the pipe handling system. The controller sequences and times the operation of each aspect of the pipe handling system during both the boring operation and the backreaming operation.

115 Claims, 33 Drawing Sheets

U.S. PATENT DOCUMENTS

| | | | | |
|---|---|---|---|---|
| 3,506,075 | | 4/1970 | Attebo | 175/52 |
| 3,552,506 | | 1/1971 | Mayer | 175/85 |
| 3,561,616 | | 2/1971 | Eddy et al. | 214/2.5 |
| 3,903,994 | * | 9/1975 | Hafner | 184/15.2 |
| 3,913,753 | | 10/1975 | Swartz et al. | 214/2.5 |
| 3,918,536 | | 11/1975 | Deeter et al. | 175/85 |
| 3,965,994 | | 6/1976 | Hilding | 175/52 |
| 3,966,053 | | 6/1976 | Loftis | 211/60 |
| 3,985,189 | | 10/1976 | Jahnke et al. | 175/52 |
| 4,199,858 | * | 4/1980 | Meijs | 166/243 |
| 4,382,738 | | 5/1983 | Frias | 414/22 |
| 4,445,579 | | 5/1984 | Bello | 175/52 |
| 4,449,592 | | 5/1984 | Mayer | 175/52 |
| 4,455,116 | | 6/1984 | Lindstedt et al. | 414/22 |
| 4,531,875 | | 7/1985 | Krueger | 414/22 |
| 4,604,724 | * | 8/1986 | Shaginian et al. | 364/478 |
| 4,632,618 | | 12/1986 | Issakainen | 414/22 |
| 4,709,766 | | 12/1987 | Boyadjieff | 175/52 |
| 4,725,179 | | 2/1988 | Woolslayer et al. | 414/22 |
| 4,730,254 | | 3/1988 | Voden, Jr. | 364/422 |
| 4,822,230 | | 4/1989 | Slettedal | 414/22.54 |
| 4,834,195 | | 5/1989 | Robinson | 175/52 |
| 4,951,759 | | 8/1990 | Richardson | 175/85 |
| 5,050,283 | | 9/1991 | Piipponen et al. | 29/240 |
| 5,183,122 | | 2/1993 | Rowbotham et al. | 175/52 |
| 5,263,545 | | 11/1993 | Tudora et al. | 175/52 |
| 5,284,375 | | 2/1994 | Land, III | 294/88 |
| 5,294,228 | | 3/1994 | Willis et al. | 414/22.55 |
| 5,297,642 | | 3/1994 | Rajakallio et al. | 175/85 |
| 5,375,667 | | 12/1994 | Trevisani | 175/52 |
| 5,381,874 | * | 1/1995 | Hadank et al. | 184/6.19 |
| 5,390,748 | | 2/1995 | Goldman | 175/24 |
| 5,518,076 | | 5/1996 | Holz et al. | 175/57 |
| 5,556,253 | | 9/1996 | Rozendaal et al. | 414/797.7 |
| 5,607,280 | | 3/1997 | Rozendaal | 414/745.7 |
| 5,701,962 | * | 12/1997 | Jantunen | 175/24 |
| 5,806,613 | * | 9/1998 | Sparks et al. | 175/52 |

OTHER PUBLICATIONS

M.E. Jacques and N.W. Herst, "Pipe–Racking Systems: Are They Cost Efficient?, " Mar., 1992, SPE 21957.

J.D. Rushford, "Slant–Drilling Performance and Rig Design in Canada," Dec., 1993, SPE 23851.

Holger Kinzel and B.G. Pletras, "The Designing and Building of an All–Purpose Automatic Torque–Wrenching Machine for Drilling Rigs," Feb., 1992, IADC/SPE 23893.

B.K. Simpson, "Field Trials of the First RA–D (Rig Automation–Drilling) Automated Drilling Rig," Feb., 1992, IADC/SPE 23894.

S.J. Houston, "Rig Automation–Drilling: The Proving of the Concept," Sep., 1993, SPE 26756.

John McGill, "The World's Most Advanced Platform Rig Troll," Feb., 1994, IADC/SPE 27518.

A.J. Beswick and D.L. Hills, "Low Cost Slim Hole Drilling System," Feb., 1995, SPE/IADC 29388.

David Harris and Egill Abrahamsen, "The Mechanization of the Tubular Running and Handling Process," Sep., 1996, IADC/SPE 36393.

E. Tsuru et al., "Innovative Technology for Tubular Connection to Eliminate Thread Compound Grease," Mar., 1997, SPE/IADC 37649.

* cited by examiner

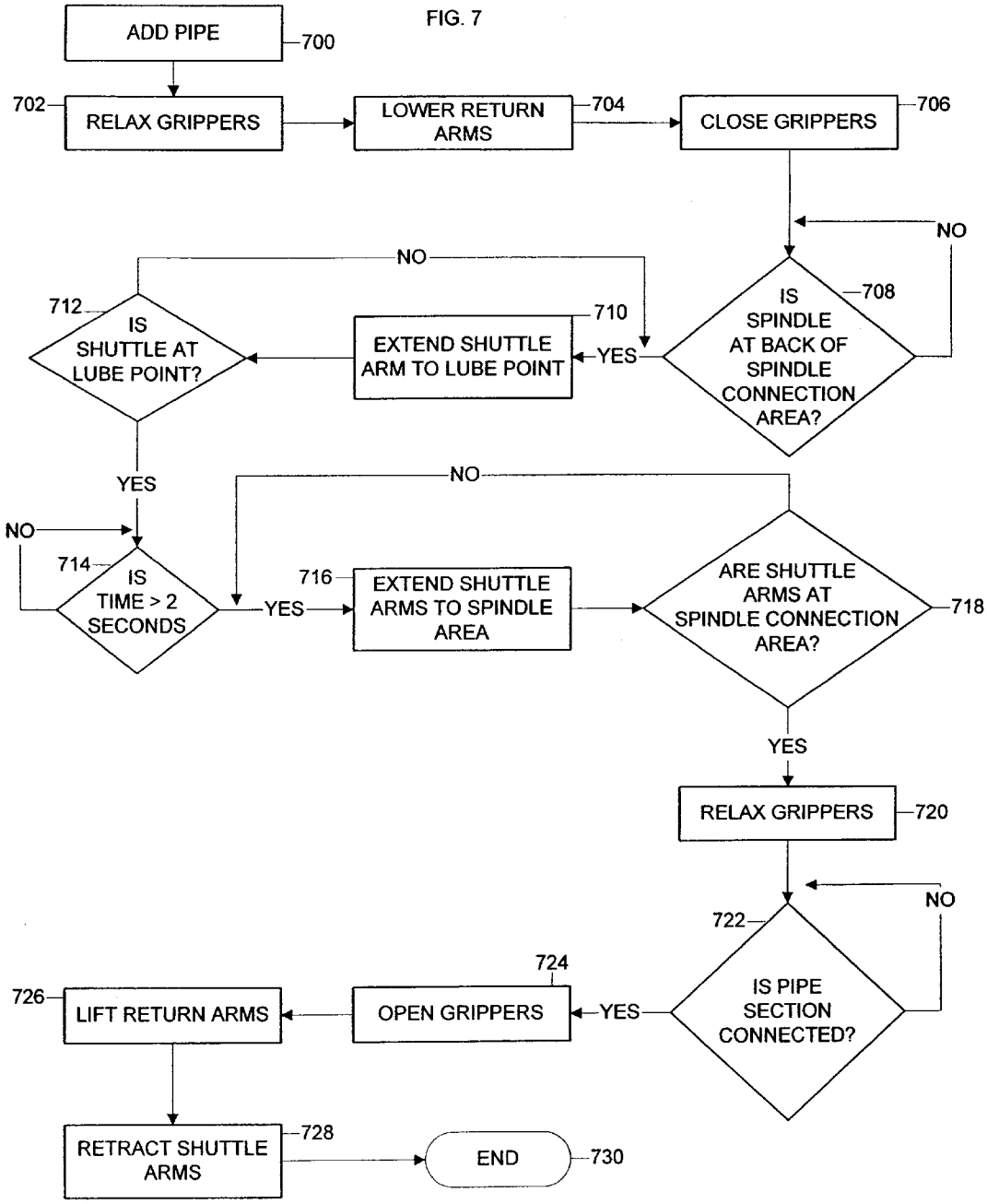
FIG. 7
ADD PIPE
700
702
RELAX GRIPPERS
LOWER RETURN ARMS
704
CLOSE GRIPPERS
706
NO
NO
712
IS SHUTTLE AT LUBE POINT?
710
EXTEND SHUTTLE ARM TO LUBE POINT
YES
IS SPINDLE AT BACK OF SPINDLE CONNECTION AREA?
708
YES
NO
NO
714
IS TIME > 2 SECONDS
YES
716
EXTEND SHUTTLE ARMS TO SPINDLE AREA
ARE SHUTTLE ARMS AT SPINDLE CONNECTION AREA?
718
YES
RELAX GRIPPERS
720
NO
722
IS PIPE SECTION CONNECTED?
YES
724
OPEN GRIPPERS
726
LIFT RETURN ARMS
RETRACT SHUTTLE ARMS
728
END
730

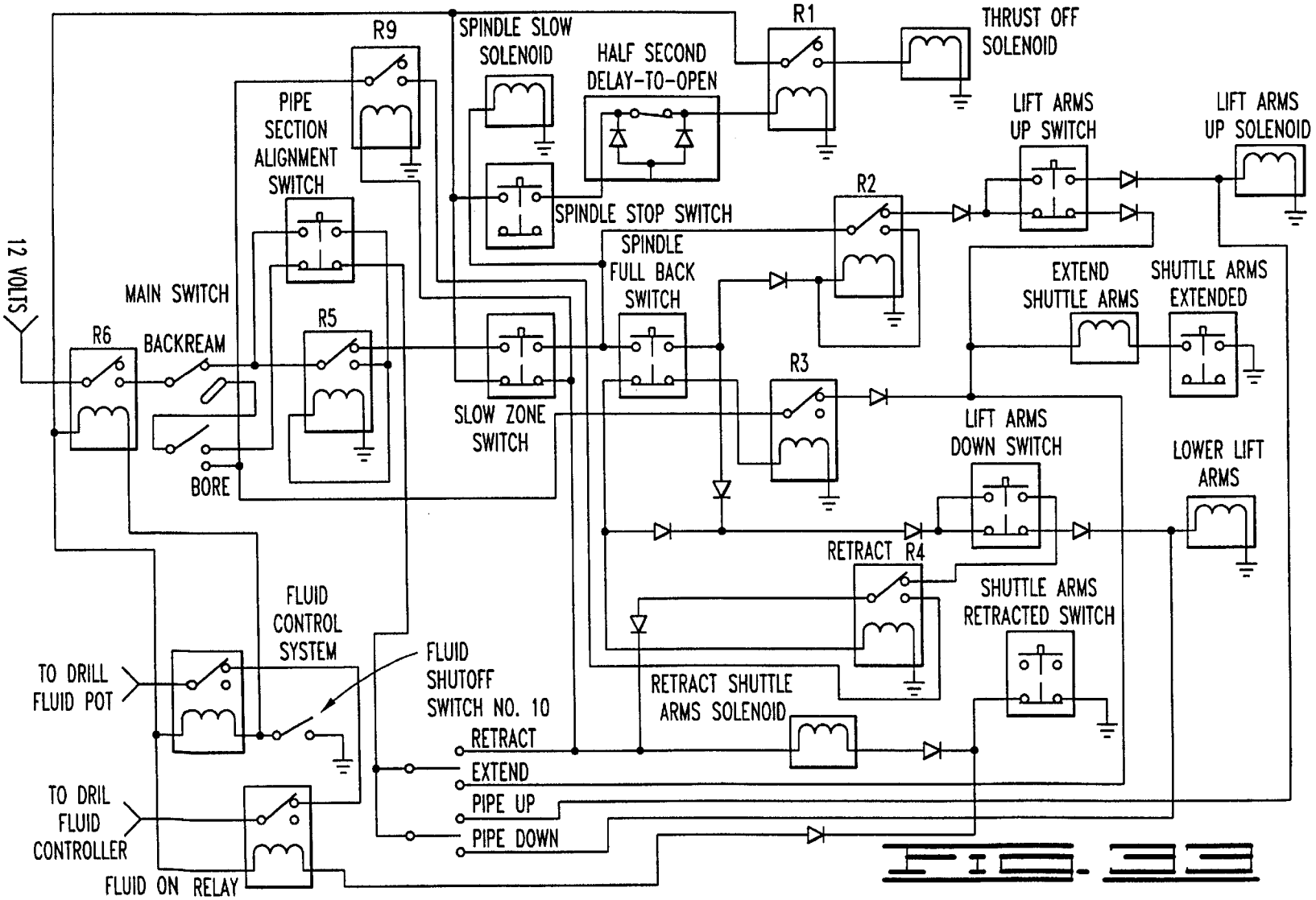
LIFT ARMS UP SOLENOID
SHUTTLE ARMS EXTENDED
LOWER LIFT ARMS
THRUST OFF SOLENOID
LIFT ARMS UP SWITCH
EXTEND SHUTTLE ARMS
LIFT ARMS DOWN SWITCH
SHUTTLE ARMS RETRACTED SWITCH
R1
R2
R3
R4
RETRACT
HALF SECOND DELAY-TO-OPEN
SPINDLE STOP SWITCH
SPINDLE FULL BACK SWITCH
RETRACT SHUTTLE ARMS SOLENOID
SPINDLE SLOW SOLENOID
SLOW ZONE SWITCH
FLUID SHUTOFF SWITCH NO. 10
RETRACT
EXTEND
PIPE UP
PIPE DOWN
R9
R5
PIPE SECTION ALIGNMENT SWITCH
FLUID CONTROL SYSTEM
MAIN SWITCH
BACKREAM
BORE
R6
12 VOLTS
TO DRILL FLUID POT
TO DRIL FLUID CONTROLLER
FLUID ON RELAY

SYSTEM AND METHOD FOR AUTOMATICALLY CONTROLLING A PIPE HANDLING SYSTEM FOR A HORIZONTAL BORING MACHINE

FIELD OF THE INVENTION

The present invention relates to the field of horizontal underground boring, and in particular to automated pipe handling systems for automatically loading and unloading pipes on a horizontal boring machine.

SUMMARY OF THE INVENTION

The present invention comprises an automated pipe handling system for use with a horizontal boring machine having a drive system, a drill string comprised of a plurality of pipe sections connectable at threaded joints, a spindle comprising a spindle pipe joint for connecting the drill string to the drive system, and a spindle connection area. The automated pipe handling system comprises a makeup/breakout assembly, a pipe handling assembly, a pipe lubrication assembly, a handling assembly control system, a pipe lubrication control system, and a makeup/breakout control system. The makeup/breakout assembly is adapted to secure the drill string and at least one pipe section in the spindle connection area so that the at least one pipe section in the spindle connection area can be connected to and disconnected from the drill string. The makeup/breakout control system automatically operates the makeup/breakout assembly. The pipe handling assembly is adapted to store and transport pipe sections to and from the spindle connection area. The handling assembly control system automatically operates the pipe handling assembly. The pipe lubrication assembly is adapted to apply lubricant to at least one pipe joint. The pipe lubrication control system automatically operates the pipe lubrication assembly.

The present invention is further directed to an automated control system for a pipe handling system comprising a pipe handling assembly, a pipe lubrication assembly, and a makeup/breakout assembly. The automated control system comprises a handling assembly control system, a pipe lubrication control system, and a makeup/breakout control system. The handling assembly control system automatically operates the pipe handling assembly. The pipe lubrication control system automatically operates the pipe lubrication assembly. The makeup/breakout control system automatically operates the makeup/breakout assembly.

Further, the present invention comprises an automated pipe handling system comprising a pipe handling assembly and a handling assembly control system. The pipe handling assembly is adapted to store and transport pipe sections to and from a connection area. The handling assembly control system automatically operates the pipe handling assembly.

In another aspect, the present invention comprises an automated pipe lubrication system for use with a pipe handling system comprising a pipe handling assembly that stores and transports pipe sections having pipe joints, to and from the pipe handling system. The automated pipe lubrication system comprises a pipe lubrication assembly and a pipe lubrication control system. The pipe lubrication assembly is adapted to apply lubricant to at least one pipe joint. The pipe lubrication control system automatically operates the pipe lubrication assembly.

In yet another aspect, the present invention comprises an automated makeup/breakout system for use with a pipe handling system having a pipe handling assembly. The automated makeup/breakout system comprises a makeup/breakout assembly and a makeup/breakout control system. The makeup/breakout assembly is adapted to secure at least one pipe section so that the pipe joints of the at least one pipe section can be connected to or disconnected from at least one other pipe joint. The makeup/breakout control system automatically operates the makeup/breakout assembly.

The present invention further comprises a horizontal boring machine comprising a frame, a drill string, a drive system, and an automated pipe handling system. The drill string comprises a plurality of pipe sections connected at threaded pipe joints. The drive system, attached to the frame, rotates and advances the drill string through the earth. The automated pipe handling system is used to add and retrieve pipe sections to and from the drill string. The automated pipe handling system comprises a pipe handling assembly, a lubrication assembly, a makeup/breakout assembly, and a control system. The pipe handling assembly is adapted to transport pipe sections to and from the boring machine. The pipe lubrication assembly is adapted to apply lubricant to at least one pipe joint. The makeup/breakout assembly is adapted to secure at least one pipe section so that the pipe section can be connected to or disconnected from the drill string. The control system automatically operates the pipe handling system.

In yet another embodiment, the present invention is a method directed to drilling a horizontal borehole. The method comprises driving a boring tool through the earth using a drill string composed of pipe sections and repeatedly adding pipe sections to the drill string until the borehole is completed. The pipe sections are added by automatically delivering pipe sections to the drill string.

Finally, the present invention is directed to a method for pulling a drill string back through the borehole. The method comprises pulling the drill string back through the earth and repeatedly removing the pipe sections from the drill string. The pipe sections are removed by automatically transporting the pipe sections from the drill string.

BRIEF DESCRIPTION OF THE DRAWINGS

FIG. 7 is a flow diagram of a version of software for an Add Pipe routine for the pipe handling assembly controller of FIG. 6.

FIG. 16 is an exploded, schematic illustration of a preferred embodiment of a pipe lubrication assembly.

FIG. 33 is a schematic illustration of an alternative embodiment for a circuit for controlling a pipe handling assembly.

BACKGROUND OF THE INVENTION

Figure 1:
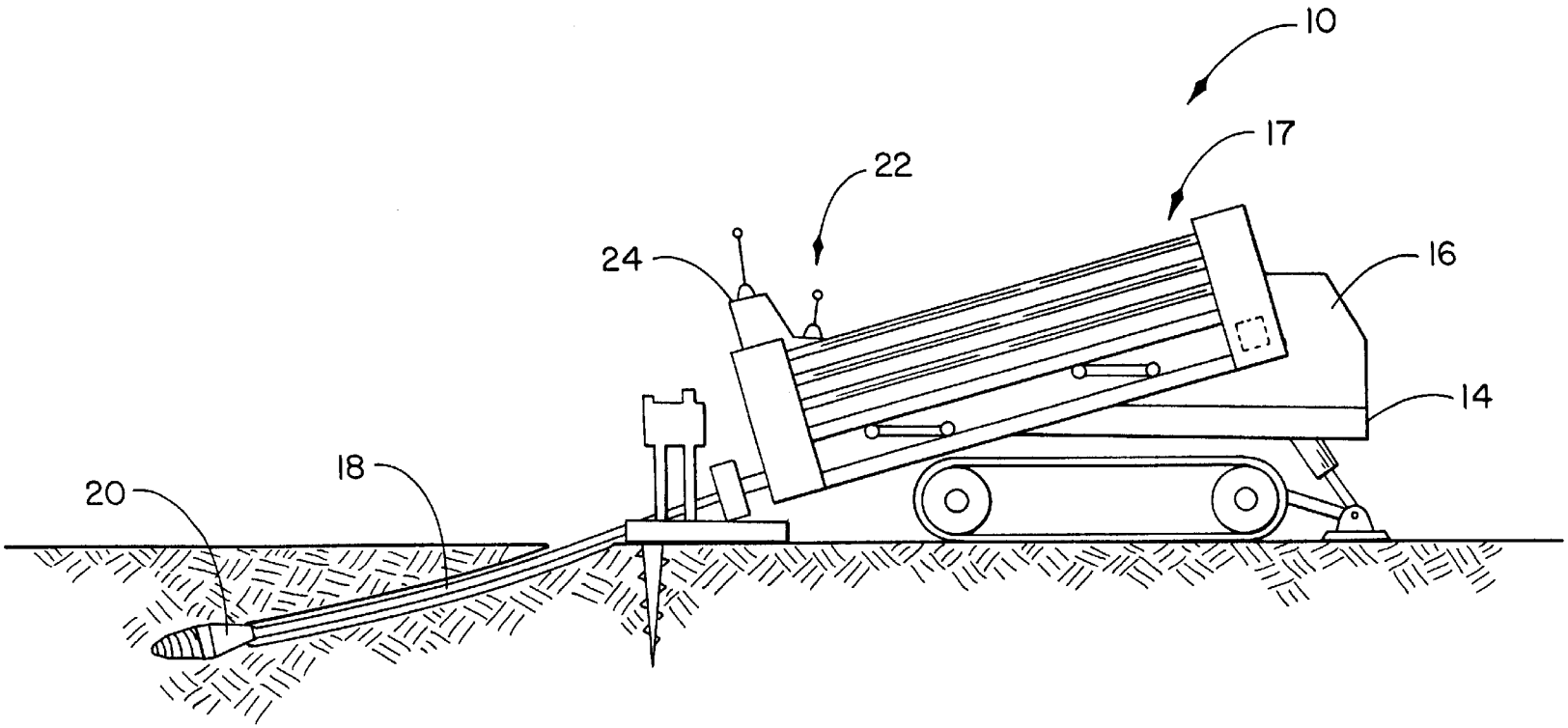
FIG. 1 is a side view of a horizontal boring machine with a pipe handling system in accordance with the present invention.

Horizontal boring machines are used to install utility services or other products underground. Horizontal boring eliminates surface disruption along the length of the project, except at the entry and exit points, and reduces the likelihood of damaging previously buried products. Skilled and experienced crews have greatly increased the efficiency and accuracy of boring operations. However, there is a continuing need for more automated boring machines which reduce the need for operator intervention and thereby increase the efficiency of boring underground.

The boring operation is a process of using a boring machine to advance a drill string through the earth along a desired path. The boring machine generally comprises a frame, a drive system mounted on the frame and connected to one end of the drill string, and a boring tool connected to the other end of the drill string. The drive system provides thrust and rotation needed to advance the drill string and the boring tool through the earth. The drive system generally has a motor to rotate the drill string and separate motor to push the drill string. The drill string is advanced in a straight line by simultaneously rotating and pushing the drill string through the earth. To control the direction of the borehole, a slant-faced drill bit may be used. When the direction of the borehole must be changed, the drill bit is positioned with the slant-face pointed in the desired direction. The drill string is then pushed through the earth without rotation, so that the slant-face causes the drill string to deflect in the desired direction.

The drill string is generally comprised of a plurality of drill pipe sections joined together at threaded connections. As the boring operation proceeds, the drill string is lengthened by repeatedly adding pipe sections to the drill string. Each time a pipe section is added to the drill string the pipe section being added is aligned with the drill string, the threaded joints are lubricated to ensure proper connections, and the connections between the drive system, the pipe section, and the drill string are secured. The process is the same each time a pipe section is added to the drill string.

When the boring operation is completed, the drill string is pulled back through the borehole, generally with the utility line or product to be installed underground connected to the end of the drill string. Many times, the original borehole must be enlarged to accommodate the product being installed. The enlarging of the borehole is accomplished by adding a backreaming tool between the end of the drill string and the product being pulled through the borehole. During this backreaming operation, pipe sections are removed from the drill string as the drill string gets shorter. Each time a pipe section is taken from the drill string, the connections between the drive system, the pipe section, and the drill string are broken, the pipe section is removed from the boring machine, and the threaded joint of the drill string is lubricated before the drive system is reconnected to the drill string so the backreaming operation can continue. As is the case with the addition of pipe sections to the drill string, the process is repetitive. As one skilled in the art will appreciate, efficient and economic machines for adding and removing pipe sections are a present need in the industry.

DETAILED DESCRIPTION OF THE PREFERRED EMBODIMENTS

Turning now to the drawings in general and FIG. 1 in particular, there is shown in FIG. 1 a horizontal boring machine in accordance with the present invention. The boring machine, designated by reference numeral 10, generally comprises a frame 14, a drive system 16 supported on the frame, a pipe handling system 17 supported on the frame, a drill string 18, and a directional boring tool 20. The boring machine 10 is operated and monitored with controls located at an operator's console 22. The operator's console 22 contains a control panel 24 having a display, joystick, and other machine function control mechanisms, such as switches and buttons. From the control panel 24, each of the underlying functions of the boring machine 10 can be controlled. The display on the control panel 24 may include a digital screen and a plurality of signaling devices, such as gauges, lights, and audible devices, to communicate the status of the operations to the operator.

Figure 2:
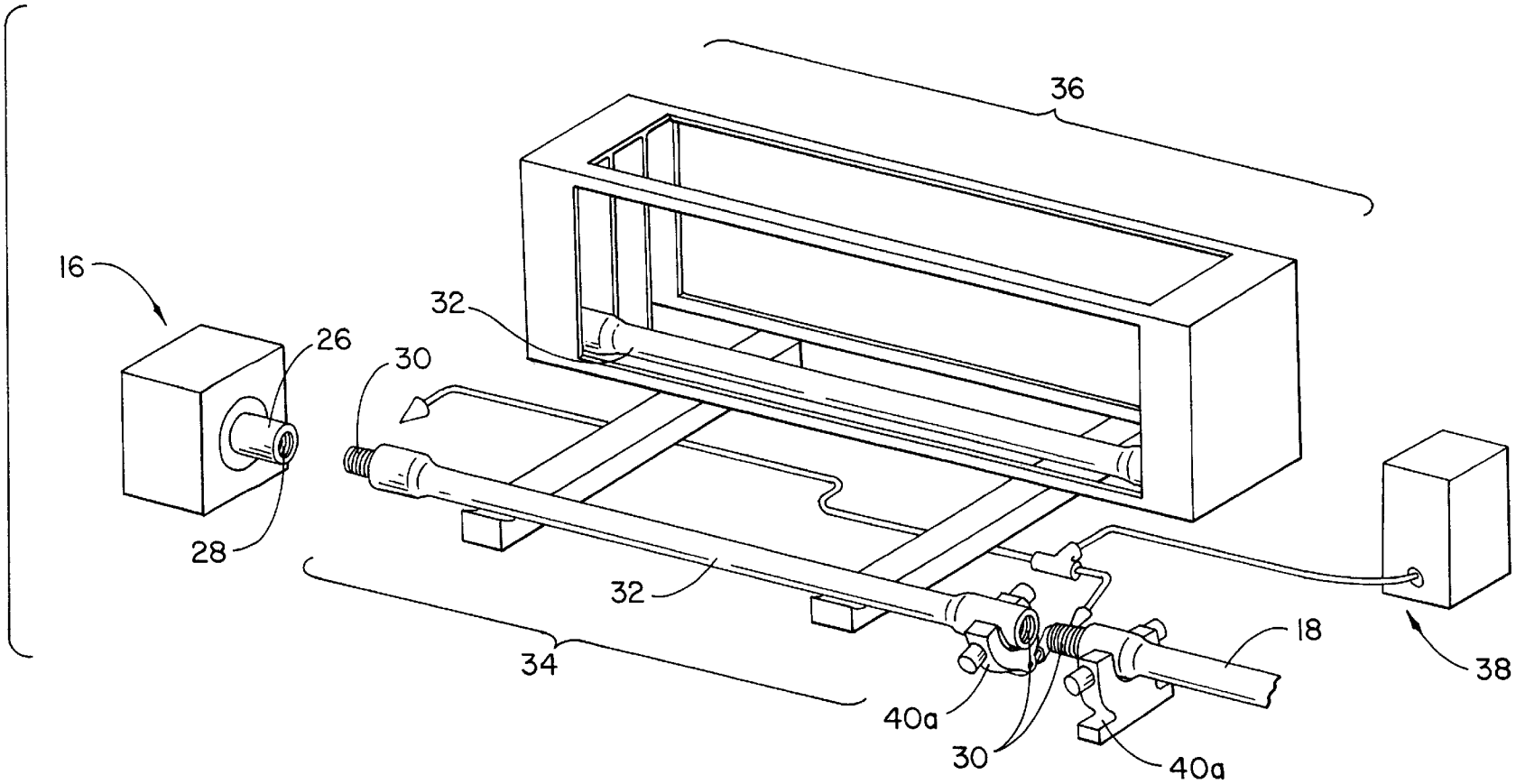
FIG. 2 is a right frontal perspective view of a pipe handling assembly, a makeup/breakout assembly, and a pipe lubrication assembly for use with a horizontal boring machine.

As depicted in FIG. 2, the drive system 16 is connected to the drill string 18 by way of a spindle 26. The spindle 26 comprises a threaded spindle pipe joint 28 for connection to a threaded pipe joint 30 on the end of a pipe section 32. As used herein, a pipe joint 30 can be either of the male or female threaded ends of a pipe section 32. One skilled in the art will appreciate that the drill string 18 is formed of a plurality of individual pipe sections 32 connected together at threaded pipe joints 30. As designated herein, the reference numeral 32 will refer to individual pipe sections 32 and the reference numeral 18 will refer to the drill string 18 in the earth, where it is understood that the drill string comprises at least one pipe section.

One skilled in the art will also appreciate that the connections between the spindle 26 and an individual pipe section 32, between the spindle and the end of the drill string 18, or between the pipe sections comprising the drill string, involve a careful coordination between the rotation and thrust of the spindle. Whenever a connection is made or broken, the rotation and the thrust of the spindle 26 must be coordinated to meet the threaded pitch of the pipe joints 30 and the spindle pipe joint 28 so that the threads of the joints are not damaged. Where connections between joints are discussed in this application, it will be understood that the thrust and rotation of the spindle 26 are being coordinated so as not to damage the joints.

As the boring machine 10 bores the borehole and the drill string 18 is lengthened, additional pipe sections 32 are added or "made up." The makeup operation begins with the spindle 26 at the back end 33 of a spindle connection area 34, remote from the exposed end of the drill string 18. A pipe section 32 is transported to the spindle connection area 34 by a pipe handling assembly 36. As the pipe section 32 is transported, and before the pipe section is connected to the drill string 18, the pipe lubrication assembly 38 lubricates pipe joints 30 to ensure proper connections are made. A makeup/breakout assembly 40 then secures the pipe section and the drill string 18 so that the spindle 26 can be connected to the pipe section and the pipe section can be connected to the drill string. The boring operation can then continue by advancing the drill string 18 along the desired path.

When the boring operation is complete, the backreaming operation is started to enlarge the borehole. At the same time, a utility line or other product to be installed underground can be attached to the end of the drill string 18 and pulled back through the borehole. During the backreaming operation, pipe sections 32 are removed from the drill string 18 or "broken out." When the spindle 26 has moved to the back end 33 of the spindle connection area 34, the pipe section 32 in the spindle connection area is removed from the drill string 18. The makeup/breakout assembly 40 secures the pipe section 32 and the drill string 18 in order to disconnect the spindle 26 from the pipe section 32 in the spindle connection area 34 and the pipe section from the drill string 18. The pipe section 32, free from the drill string 18 and the spindle 26, is then transported out of the spindle connection area 34 by the pipe handling assembly 36. The spindle 26 is then moved to the front end of the spindle connection area 34. The spindle pipe joint 28 or pipe joint 30 on the exposed end of the drill string is then lubricated so the spindle 26 can be reconnected to the drill string 18. The backreaming operation can then continue by pulling the drill string 18 back through the borehole.

Traditionally, the makeup and breakout operations have been performed by the operator, with the assistance of wrenches on the boring machine 10 and by manually applying lubricant when needed. One advantage of the present invention is that it provides an apparatus to automatically perform the underlying functions of the makeup and breakout operations.

Pipe Handling System

Figure 3:
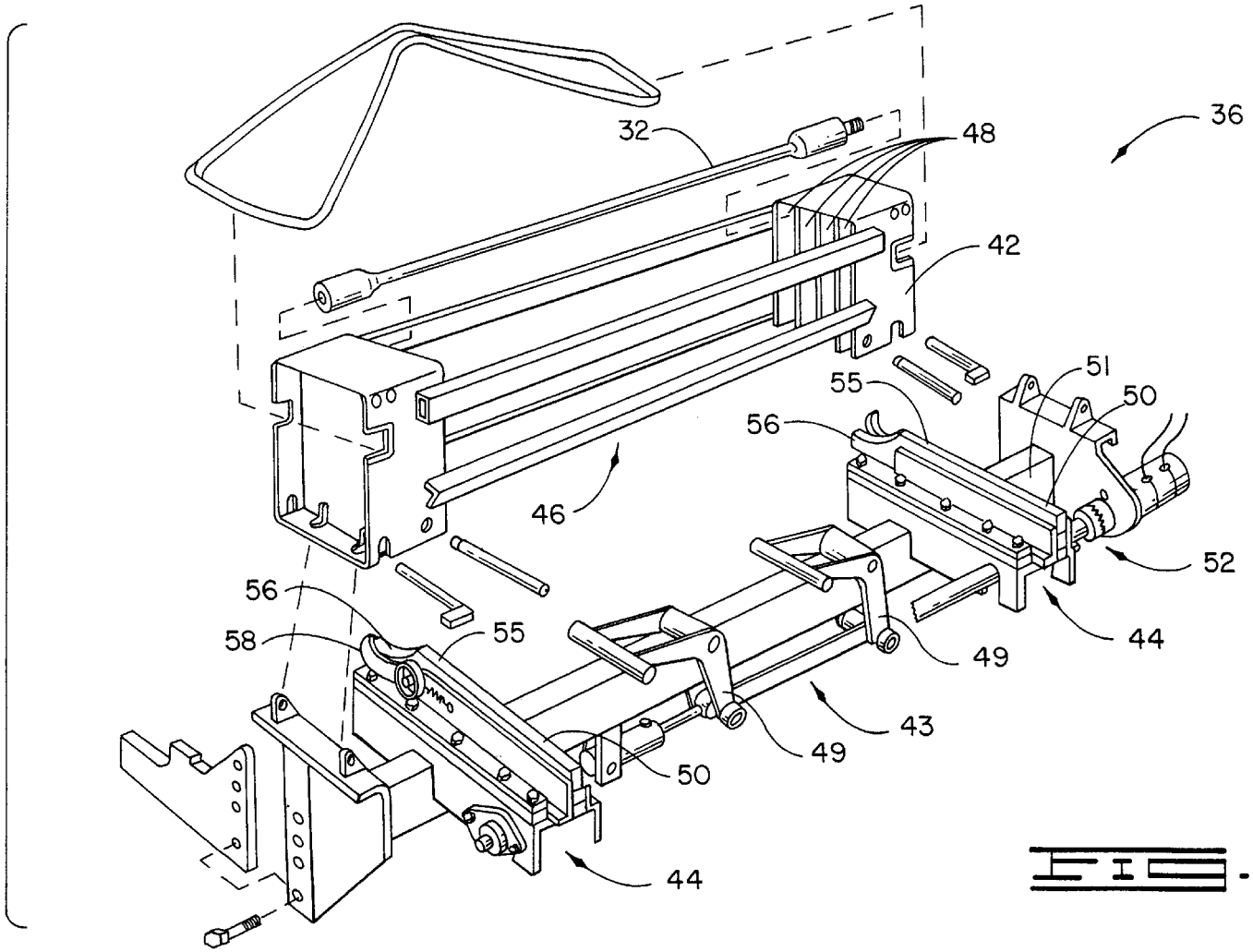
FIG. 3 is an exploded left frontal perspective view of the pipe handling assembly shown in FIG. 2.
Figure 4:
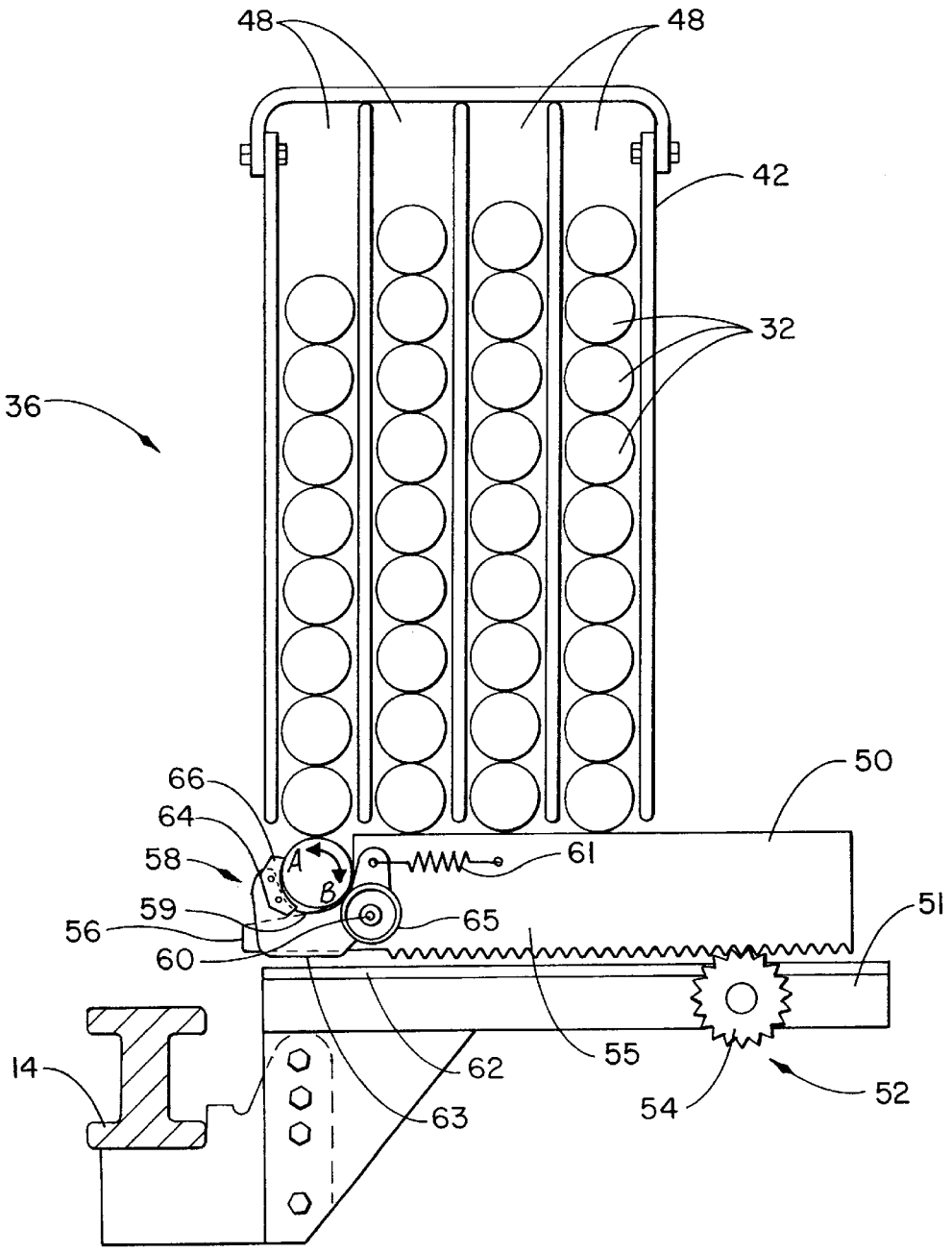
FIG. 4 is a partial sectional end elevational view of the pipe handling assembly of FIG. 3.

A preferred embodiment for the pipe handling assembly 36 of the present invention is shown in more detail in FIGS. 3 and 4. Pipe handling assemblies suitable for use with the present invention are described in U.S. patent application Ser. No. 08/624,240, filed by the Charles Machine Works, Inc. on Mar. 29, 1996, entitled Pipe Handling Device, the contents of which are incorporated herein by reference.

The pipe handling assembly 36 shown in FIGS. 3 and 4 shuttles pipe sections 32 between a storage position and the spindle connection area 34 (see FIG. 1). The pipe handling assembly 36 is preferably attached to the frame 14 of the boring machine 10 or positioned proximate the frame for storing and transporting pipe sections 32 to and from the drill string 18. The pipe handling assembly 36 comprises a magazine 42 for storing the pipe sections 32, a pipe return assembly 43 for lifting pipe sections in and out of the magazine, and a transport assembly 44 for transporting pipe sections between the magazine and the spindle connection area 34.

The magazine 42 defines an open bottom 46 and a plurality of pipe receiving columns 48. This configuration accommodates a plurality of pipe sections 32 which may be stacked in generally horizontal columns 48 and which may be dispensed or replaced through the open bottom 46 of the magazine 42. As described fully in U.S. patent application Ser. No. 08/624,240, the magazine 42 is also designed to be removed from the pipe handling assembly 36 so that another magazine with additional pipe sections 32 can be provided to the boring machine 10 during the boring operation. Similarly, an empty magazine 42 can be provided during the backreaming operation for storage of pipe sections 32 removed from the drill string 18.

The pipe return assembly 43 (FIG. 3) is positioned beneath the open bottom 46 of the magazine 42. As described in U.S. patent application Ser. No. 08/624,240, the pipe return assembly 43 comprises return arms 49 for lowering pipe sections 32 from the magazine 42 and lifting pipe sections back into the magazine.

The transport assembly 44 is situated beneath the open bottom 46 of the magazine 42. The transport assembly 44 comprises a transport member 50 movably supported on an assembly frame 51 and a drive assembly 52 for driving the movement of the transport member. The drive assembly 52 serves to move the transport member 50 from a receiving position beneath the magazine 42 to an extended position at the spindle connection area 34. In the preferred embodiment, the drive assembly 52 comprises a hydraulically actuated rack and pinion gear 54. One skilled in the art will appreciate that other implementations of the drive assembly 52 are possible. For example, a hydraulic cylinder could be used to move the transport member 50.

The transport member 50 comprises a plurality of shuttle arms 55 and a plurality of pipe holding members 56. The pipe holding members 56 are adapted to receive and support a pipe section 32. In a preferred embodiment, a pipe holding member 56 is formed in each of the shuttle arms 55. One skilled in the art will appreciate that the pipe holding members 56 need not be formed in the shuttle arms 55 but could comprise a separate structure attached to the end of each of the shuttle arms. Each pipe holding member 56 further comprises a gripper device 58 for retaining and stabilizing a pipe section 32 in the pipe holding member.

In one embodiment, shown in FIG. 4, the gripper device 58 is a passive device that will engage a pipe section 32 resting in the pipe holding member 56. The gripper device 58 defines an upper concave surface 59 for receiving the pipe section 32 and is mounted to the shuttle arm 55 by a pivot pin 60, about which the gripper device is permitted to rotate. A spring 61, connected between the shuttle arm 55 and the gripper device 58, provides a rotational force to the gripper device such that the gripper device is maintained in a position to support the pipe section 32.

When the holding member 56 is receiving a pipe section 32 from one of the pipe receiving columns 48, the holding member is potentially subject to the cumulative weight of a plurality of pipe sections in the receiving column. The rotational force generated by the spring 61 may be overcome by the cumulative weight and could cause the plurality of pipe sections 32 to spill out of the magazine 42. To prevent this, the assembly frame 51 has a top surface 62 that extends beneath each of the receiving columns 48. Consequently, when the pipe holding member 56 receives a pipe section 32 and the rotational force of the spring 61 is overcome by the cumulative weight of a plurality of pipe sections in a receiving column 48, a bottom surface 63 of the gripper device 58 contacts the top surface 62 of the assembly frame 51, effectively limiting the rotation of the gripper device and preventing the pipe sections from spilling out of the receiving column.

The ability of the gripper device 58 to rotate also allows the gripper device to passively grip and release a pipe section 32 in the spindle connection area 34. As the pipe holding member 56 approaches a pipe section 32 in the spindle connection area 34, the gripper device 58 is urged down and under the pipe section as the pipe section contacts the inclined leading edge 64 of the gripper device. Conversely, as the pipe holding member 56 is pulled away from the pipe section 32 in the spindle connection area 34, the pipe section is forced against the gripper device 58 and causes a rotational force about the pivot pin 60 sufficient to overcome the supporting force generated by the spring 61. Thus, the gripper device 58 is forced down and under the pipe section 32 in the spindle connection area 34, effectively releasing the pipe section.

The gripper device 58 also comprises a contact wheel 65 rotatably mounted on the pivot pin 60. The pipe section 32 in the pipe holding member 56 rests on the circumferential perimeter of the contact wheel 65. The rotating contact wheel 65 permits the pipe section 32 to rotate more easily as it rests in the pipe holding member 56; yet the contact wheel resists axial movement of the pipe section. Preferably, the contact wheel 65 is made of a resilient material such as polyurethane.

The pipe section 32 in the pipe holding member 56 is also contacted by a resistant thumb 66 positioned on the outer edge of the pipe holding member. The resistant thumb 66 has a slightly concave surface more sharply defined at the upper edge of the resistant thumb that engages the pipe section 32. Preferably, the resistant thumb 66 is made of a resilient material such as polyurethane. The shape of the resistant thumb 66 and the proximity of its upper edge relative to the pivot pin 60 have the effect of providing little resistance to the rotation of the pipe section 32 as it is rotated in direction A. However, as the pipe section 32 is rotated in direction B, it contacts the resistant thumb 62 and attempts to rotate the gripper device 58 about the pivot pin 60. The slight rotation of the gripper device 58 causes an even tighter gripping action which resists the rotation of the pipe section 32, effectively gripping the pipe section.

Figure 5A:
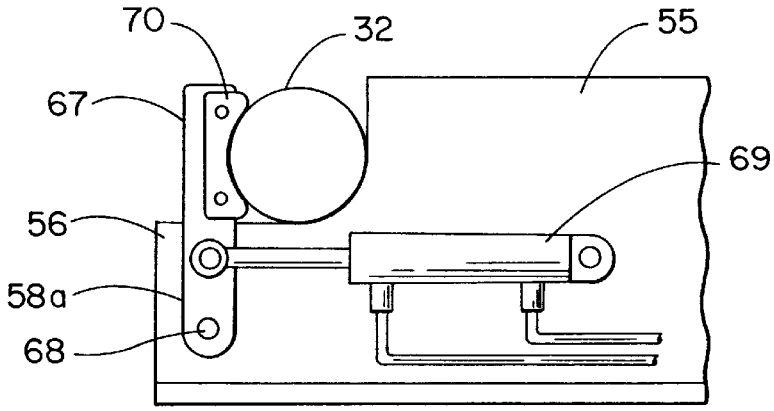
FIG. 5*a* is a fragmented side view of an embodiment of a pipe holding member of the pipe handling assembly of FIG. 3, in a closed position.
Figure 5B:
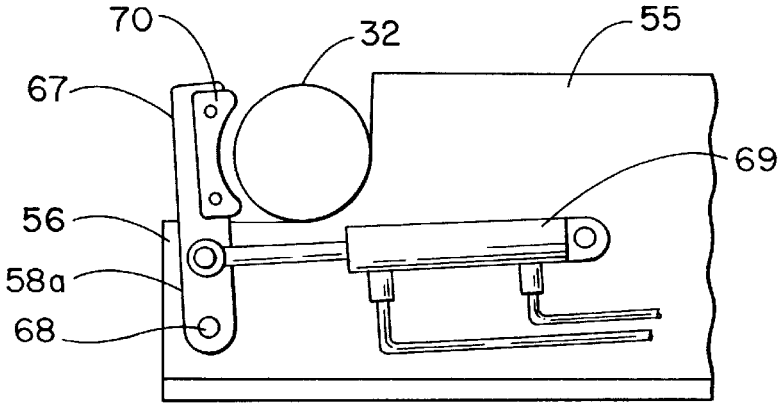
FIG. 5*b* is a fragmented side view of an embodiment of a pipe holding member of the pipe handling assembly of FIG. 3, in a relaxed position.
Figure 5C:
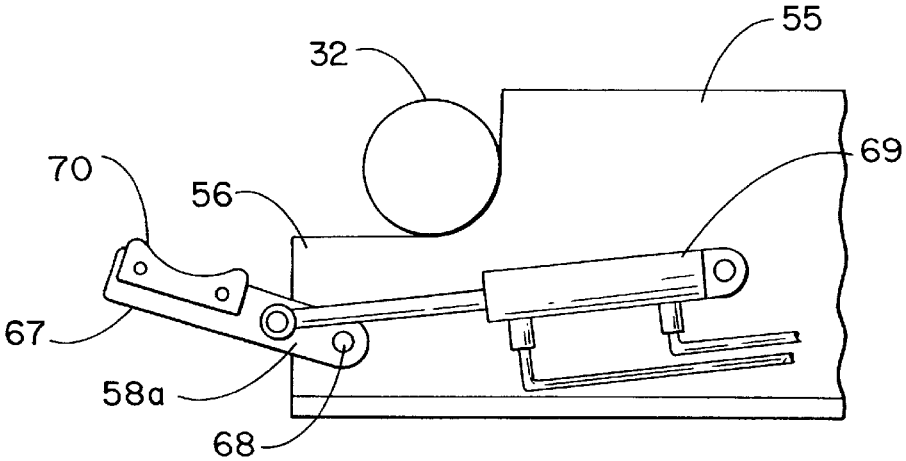
FIG. 5*c* is a fragmented side view of an embodiment of a pipe holding member of the pipe handling assembly of FIG. 3, in an open position.

In an alternative embodiment, depicted in FIGS. 5*a*–5*c*, the gripper device 58*a* is an active device and comprises a hydraulically actuated pivot arm 67. The pivot arm 67 is connected by a pivot arm pin 68 or other like mechanism to the end of the pipe holding member 56. A hydraulic cylinder 69 is connected to the pivot arm 67 such that the pivot arm can be pivoted about the pivot arm pin 68 between a first position (shown in FIG. 5*a*), a second position (shown in FIG. 5*b*), and a third position (shown in FIG. 5*c*). To the end of the pivot arm 67 remote from the pipe holding member 56 is attached a concave shaped grip 70 which is designed to engage the pipe section 32 in the pipe holding member when the pivot arm is fully closed in the first position as shown in FIG. 5*a*. When the grip 70 engages the pipe section 32, sufficient resistance is provided to prevent free rotation and free axial movement of the pipe section. In the second position, shown in FIG. 5*b*, the pivot arm 67 is in a relaxed position. In the relaxed position, the pipe section 32 will rest in the pipe holding member 56 and be permitted to rotate and slide in the pipe holding member. When the pivot arm 67 is in the third position, shown in FIG. 5*c*, the pivot arm is open and the grip 70 does not engage or retain the pipe section 32 in the pipe holding member 56.

Figure 6:
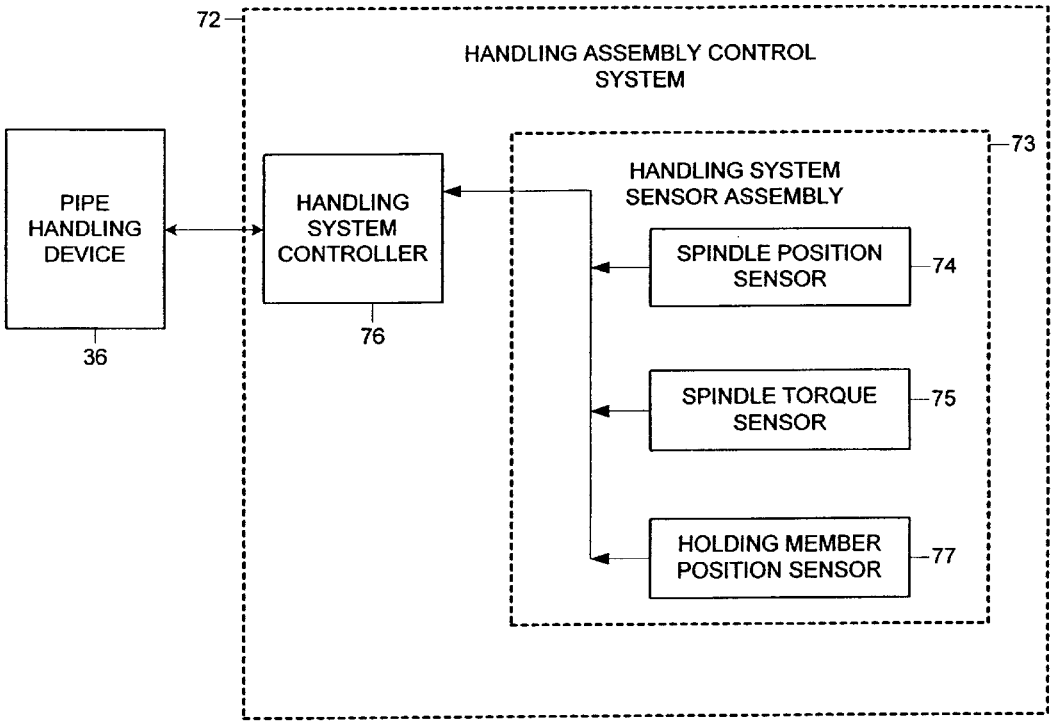
FIG. 6 is a block diagram of a circuit for controlling a pipe handling assembly in accordance with the present invention.

The present invention also provides for the automated control of the pipe handling assembly 36 by a handling assembly control system, shown in FIG. 6. The handling assembly control system 72 controls all of the underlying functions of the pipe handling assembly 36 and sequences those operations. The handling assembly control system 72 comprises a handling system sensor assembly 73 and a handling assembly controller 76. The handling system sensor assembly 73 comprises a spindle position sensor 74, a spindle torque sensor 75, and a holding member position sensor 77.

The spindle position sensor 74 tracks the position of the spindle 26 by monitoring the motor used to thrust the drill string 18 through the earth. The operation of the thrust motor can be correlated to the movement of the spindle 26 in the spindle connection area 34. Using a speed pickup sensor, for example, magnetic pulses from the motor can be counted and the direction and distance the spindle 26 has traveled can be calculated. An additional sensor or switch can be used to indicate when the spindle 26 has passed a "home" position. The magnetic pulses counted from the motor can then be used to determine how far the spindle 26 has traveled from the home position. When the spindle position sensor 74 detects the position of the spindle 26 at the back end 33 of the spindle connection area 34, it transmits a SPINDLE POSITION signal to the handling assembly controller 76. In response to the SPINDLE POSITION signal, the handling assembly controller 76 operates the pipe handling assembly 36. One skilled in the art will appreciate other methods for tracking the spindle 26 are also possible, such as photoelectric devices, mechanical devices, resistive devices, encoders, and linear displacement transducers that can detect when the spindle is in a particular position.

The spindle torque sensor 75 detects the pressure in the motor that provides rotation to the drill string 18 and transmits a SPINDLE CONNECTION signal. A pressure transducer on the rotation motor that rotates the spindle 26 is used in calculating the torque output from the rotation motor. The amount of torque measured from the rotation motor is an indication of whether the spindle 26 is connected to the drill string 18 and experiencing resistance, or disconnected and rotating freely. In response to the SPINDLE CONNECTION signal, the handling assembly controller 76 operates the pipe handling assembly 36.

The holding member position sensor 77 detects the position of the pipe holding members 56 (see FIG. 4) by correlating the operation of the drive assembly 52 to the distance traveled by the pipe holding members 56. A speed pickup sensor on the motor of the drive assembly 52 is used to count magnetic pulses from the motor. An additional sensor or switch can be used to indicate when the shuttle arms 55 have passed a "home" position. The pulse count is correlated to the distance the shuttle arms 55, and consequently the pipe holding members 56, have traveled from the home position. The holding member position sensor 77 transmits a HOLDING MEMBER POSITION signal when the pipe holding members 56 are beneath each of the columns 48 of the magazine 42. The handling assembly controller 76 receives the HOLDING MEMBER POSITION signal and causes the pipe holding members 56 to stop beneath the appropriate column 48. Other ways for detecting the position of the pipe holding members 56 are contemplated. For example, photoelectric devices, mechanical devices, resistive devices, encoders, and linear displacement transducers may be used to indicate when the pipe holding members 56 are beneath a particular column 48.

The flow chart of FIG. 7 depicts an example of logic followed by the handling assembly controller 76 during the boring operation when a pipe section 32 is added to the drill string 18. With reference to FIGS. 3–5 and 7, the handling assembly controller 76 will first direct a pipe section 32 be placed in the pipe holding member 56. If an active gripper device 58*a* is used, the handling assembly controller 76 will relax the gripper device 58*a* at 702. The return arms 49 then are lowered to place a pipe section 32 in the pipe holding member 56 at 704. At 706, the active gripper device 58*a* is closed to secure the pipe section 32 in the pipe holding member 56. The routine then waits at 708 for a SPINDLE POSITION signal indicating the spindle 26 is positioned at the back end 33 of the spindle connection area. When the SPINDLE POSITION signal is received, the handling assembly controller 76 causes the shuttle arms 55 to extend at 710 to a position where pipe joints 30 can be lubricated. When the shuttle arms 55 reach the lubrication point at 712, the handling assembly controller 76 causes the shuttle arms to pause for two seconds to allow lubricant to be applied to pipe joints 30 at 714. One skilled in the art will appreciate that the two second delay is only exemplary and that any time sufficient to allow the pipe joints to be lubricated may be used. Furthermore, if no lubrication is required, or if the shuttle arms 55 need not pause for lubricant to be applied, then the logic followed by the handling assembly controller could be modified accordingly.

The shuttle arms 55 are fully extended to the spindle connection area 34 at 716. When the shuttle arms 55 reach the spindle connection 34 area at 718, the handling assembly controller 76 will slightly relax the active gripper device 58*a* at 720. The routine then waits at 722 for a SPINDLE CONNECTION signal indicating that the pipe section 32 is connected to the drill string 18. After receiving the SPINDLE CONNECTION signal, the handling assembly controller 76 opens the active grippers 58*a* at 724. The return arms 49 are then lifted at 726, and the shuttle arms 55 are retracted to their position beneath the magazine 42 at 728. The ADD PIPE routine of FIG. 7 completes at 730.

Figure 8:
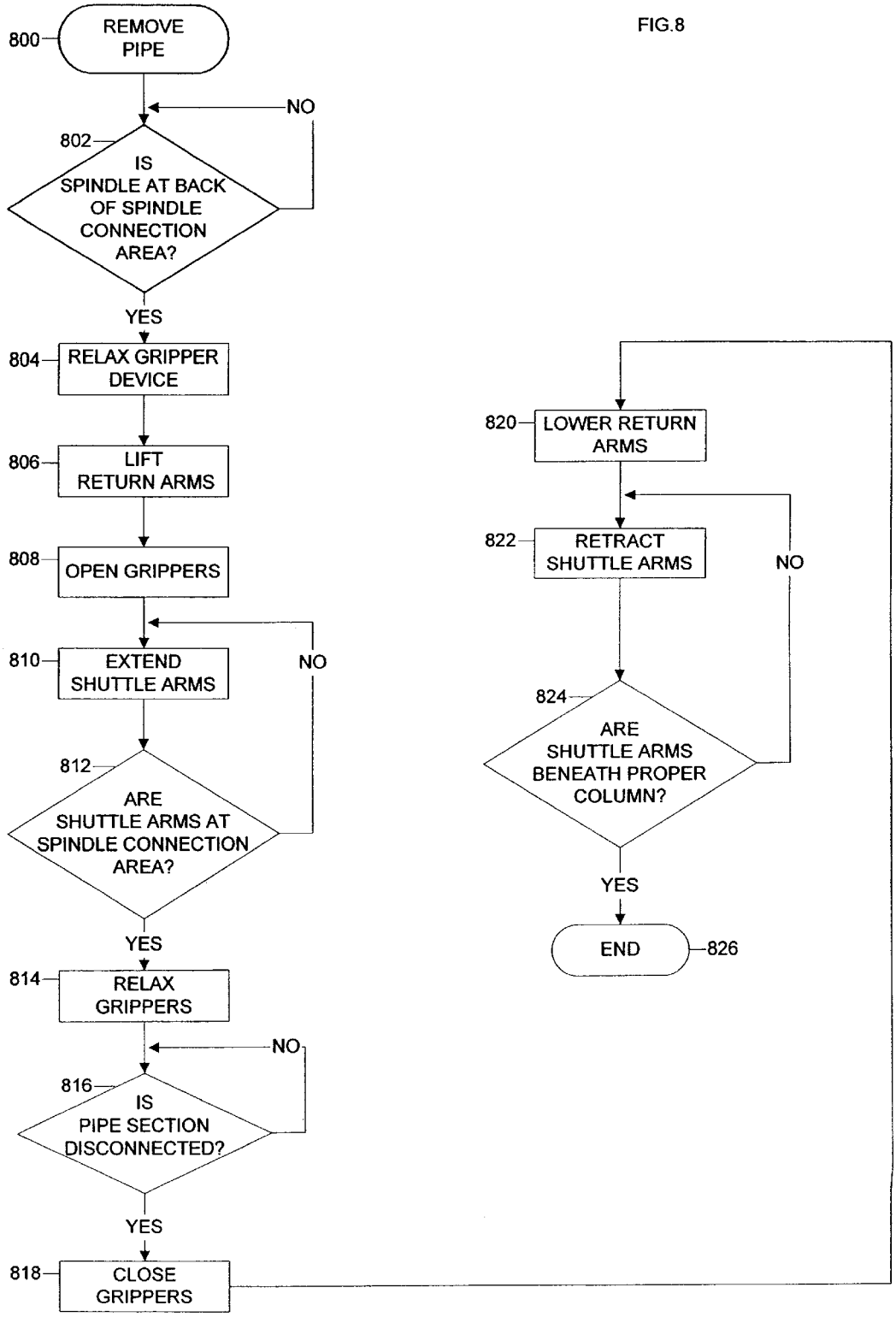
FIG. 8 is a flow diagram of a version of software for a Remove Pipe routine for the pipe handling assembly controller of FIG. 6.

The flow chart of FIG. 8 illustrates an example of logic for the handling system controller 76 during the backreaming operation when a pipe section 32 is removed from the drill string 18. The handling system controller 76 initially waits for a SPINDLE POSITION signal indicating the spindle 26 is positioned at the back end 33 of the spindle connection area 34. When the SPINDLE POSITION signal is received at 802, the handling assembly controller 76 will relax the gripper device 58*a* (FIG. 5) at 804, if an active gripper device is used. The return arms 49 are raised at 806 to remove any pipe section 32 that may have been resting in the pipe holding member 56. The gripper device 58*a* is opened at 808, and the shuttle arms 55 are fully extended to the spindle connection area 34 at 810.

When the shuttle arms 55 reach the spindle connection area 34 at 812, the handling assembly controller 76 puts the gripper device 58*a* in the relaxed position at 814. The routine then waits for the spindle position sensor 74 to transmit the SPINDLE POSITION signal at 816. The receipt of the SPINDLE POSITION signal at this point indicates that the pipe section 32 has been disconnected from the drill string 18 and positioned in the spindle connection area 34 so that the pipe section is aligned with the magazine 42. The handling assembly controller 76 then fully closes the gripper device 58*a* at 818. The return arms 49 are lowered at 820, and the shuttle arms 55 with the pipe section 32 in the pipe holding member 56 are returned to the magazine 42 at 822. When the pipe holding member 56 is beneath the proper column 48 at 824, the backreaming operation can continue at 826.

Figure 9:
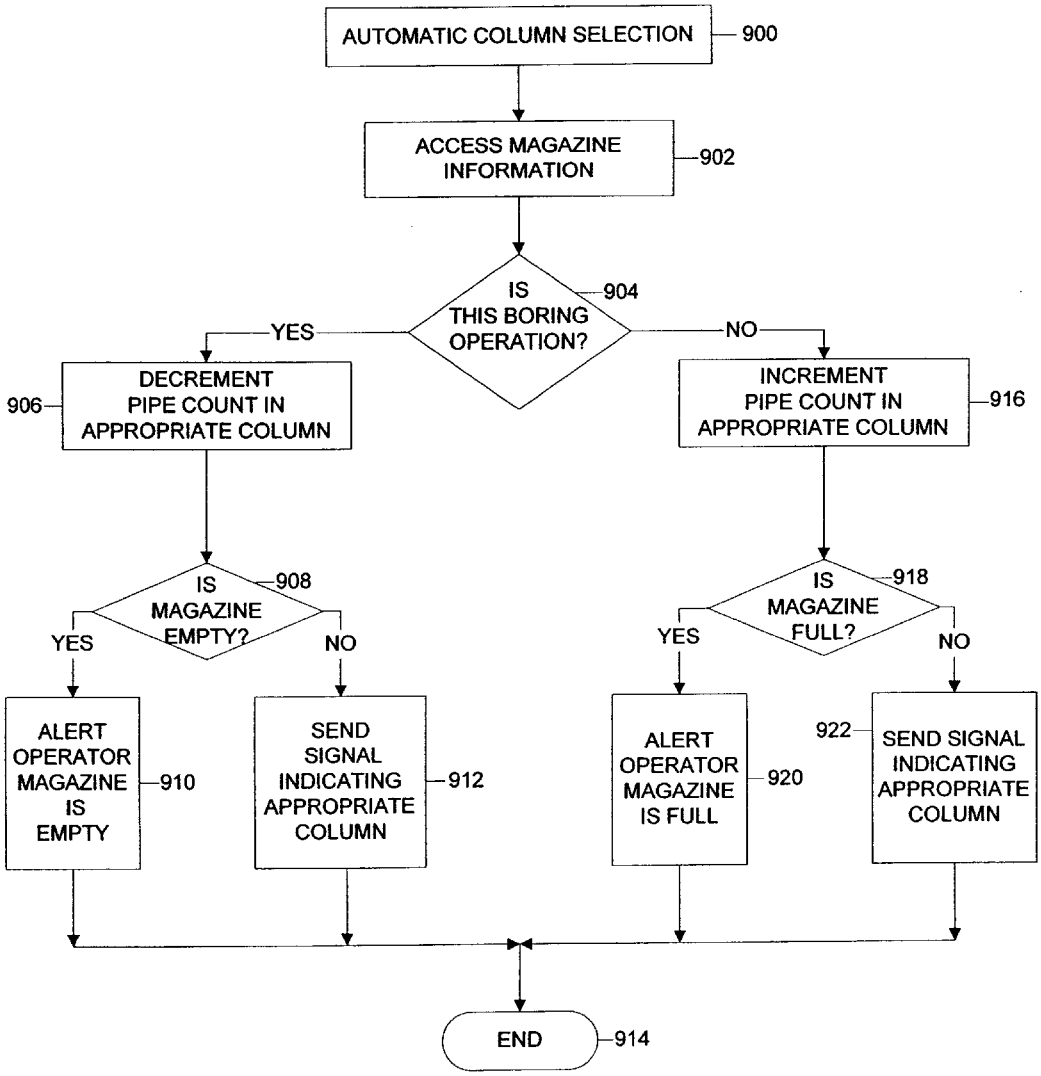
FIG. 9 is a flow diagram of a version of software for a Column Selection routine for the pipe handling assembly controller of FIG. 6.

When the shuttle arms 55 are retracted to the magazine 42, in either the boring operation or the backreaming operation, the pipe holding member 56 must be positioned below the proper column 48 of pipe in order to receive or replace a pipe section 32. The flow chart of FIG. 9 illustrates how the handling assembly controller 76 determines under which column 48 of pipe to position the pipe holding member 56.

The handling assembly controller 76 accesses information needed for tracking the number of pipe sections 32 in the magazine 42 being used at 902. The information consists of the number of pipe sections 32 the magazine 42 can hold, the number of columns 48 in the magazine, and the number of pipe sections remaining in the magazine. A check is made at 904 to determine if a pipe section 32 is being removed from the magazine 42 during the boring operation or if a pipe section is being replaced in the magazine during the backreaming operation. If a pipe section 32 is being removed, the pipe count of the appropriate column 48 is decremented at 906. At 908 a check is made to determine if the magazine 42 is empty. If the magazine 42 is empty, the operator is alerted at 910 that a new magazine is needed. Otherwise, at 912 the procedure returns information indicating which is the appropriate column 48 for receiving the next pipe section 32.

If a pipe section 32 is being added to the magazine 42 during the backreaming operation, the pipe count of the appropriate column is incremented at 916. At 918 a check is made to determine if the magazine 42 is full. If the magazine 42 is full, the operator is alerted at 920 that a new magazine is needed. Otherwise, at 922 the procedure returns information indicating which is the appropriate column 48 for returning the next pipe section 32. One skilled in the art will appreciate that other methods for properly selecting a column 48 in the magazine 42 may be used. For example, switches or photoelectric devices can be used to detect the presence or absence of pipe sections 32 in the magazine 42; and mechanical stops (either passively or actively positioned) could be used to stop the shuttle arms 55 under the appropriate column 48.

Makeup/Breakout System

Figure 10:
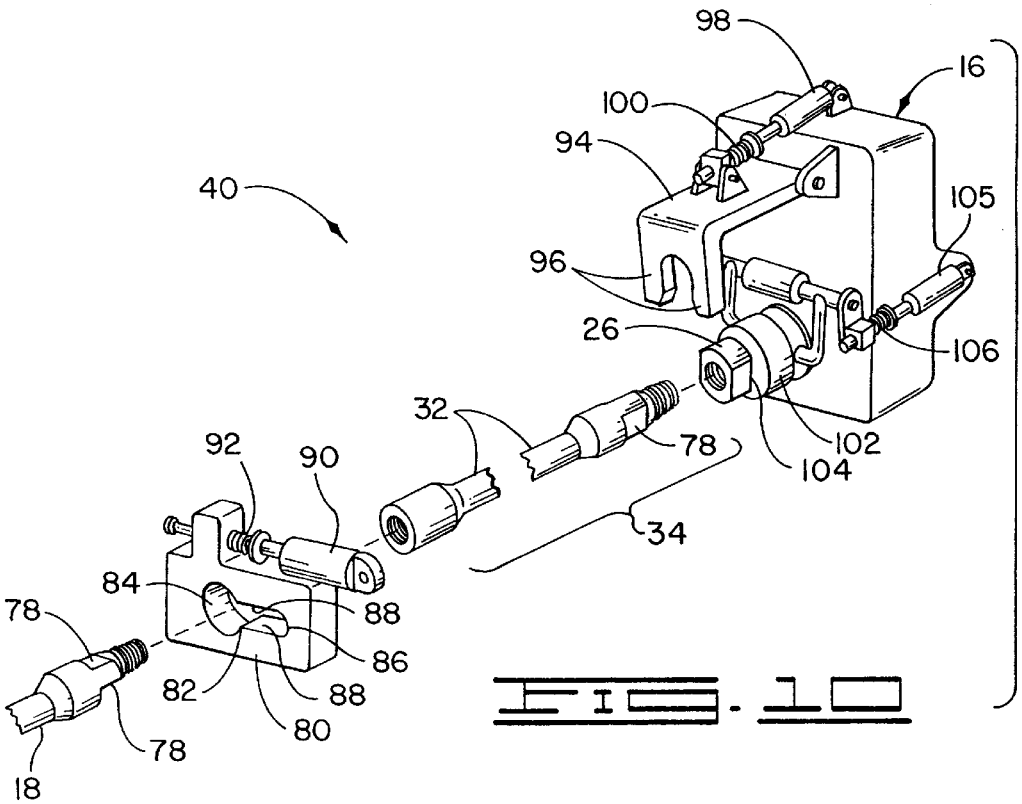
FIG. 10 is a partially cut-away, partially exploded, perspective view of one preferred embodiment of a makeup/breakout assembly.

The preferred embodiment for the makeup/breakout assembly 40 is shown in detail in FIG. 10. The makeup/breakout assembly 40 comprises a plurality of wrenches for holding the drill string 18 and the pipe section 32 in the spindle connection area 34. In the preferred embodiment, the wrenches are used with a drill string 18 comprised of pipe sections 32 having opposed flats 78 formed on the ends of the pipe sections.

A first wrench 80 secures the drill string 18. The first wrench 80 defines a keyhole opening 82 having a circular portion 84 slightly larger in diameter than the pipe section 32. The size of the circular portion 84 of the keyhole opening 82 permits a pipe section 32 to pass unobstructed through the circular portion when the first wrench 80 is in a first position. Consequently, when the first wrench 80 is in the first position, the pipe section 32 passing through the keyhole opening 82 can rotate freely.

The keyhole opening 82 is further characterized by a slot 86 extending from the circular opening 84. The flat inner sides of the slot 86 are defined by a pair of opposing surfaces 88 positioned to engage the flats 78 of the pipe section 32 when the first wrench 80 is in a second position. In the second position, the first wrench 80 is engaged, locking the pipe section 32 in place and preventing it from rotating.

The movement of the first wrench 80 between the first position and the second position is actuated by a hydraulic cylinder 90 in conjunction with a spring 92. As the hydraulic cylinder 90 is extended, the first wrench 80 is urged from the first position to the second position. However, because of the keyhole design of first wrench 80, the first wrench can only move to the second position if the pipe section 32 is aligned so that the flats 78 will engage the opposing surfaces 88 of the first wrench. As the hydraulic cylinder 90 extends, if the pipe flats 78 are not aligned with the opposing surfaces 88, then the spring 92 will compress. When the flats 78 are aligned, the spring 92 will expand, forcing the first wrench 80 to engage the drill string 18.

The keyhole design of the first wrench 80 provides added strength to the tool because it fully encompasses the circumference of the drill string 18. However, one skilled in the art will appreciate other configurations for the first wrench 80 are possible. For example, a forked tool with tines that engage the flats 78 on the pipe section 32, as described subsequently, could be used to secure the drill string 18.

The makeup/breakout assembly 40 further comprises a second wrench 94 positioned to secure the pipe section 32 in the spindle connection area 34. The second wrench 94 is a forked tool having two tines 96. The width of the tines 96 is slightly more than the width of the flats 78 on the pipe section 32. The second wrench 94 is designed to be moved between a first position and a second position. In the second position, the second wrench 94 grips the pipe section 32 when the tines 96 engage the flats 78, preventing the pipe section 32 from rotating with the spindle 26.

The movement of the second wrench 94 is actuated by a hydraulic cylinder 98 in combination with a spring 100. As with the first wrench 80, the second wrench 94 is urged from the first position to the second position by the hydraulic cylinder 98. However, if the pipe section 32 in the spindle connection area 34 is not aligned so that the flats 78 will engage the tines 96, the spring 100 will compress. When the flats 78 are aligned, the spring 100 will expand, forcing the second wrench 94 to engage the pipe section 32 in the spindle connection area 34.

The makeup/breakout assembly 40 further comprises a slidable collar wrench 102. A collar wrench suitable for use with the present invention is described in detail in U.S. Pat. No. 5,544,712, entitled Drill Pipe Breakout Device, issued Aug. 13, 1996, the contents of which are incorporated herein by reference. The collar wrench 102 has a through-bore permitting the collar wrench to be slid over the front of the spindle 26 and to rotate with the spindle. As the collar wrench 102 is slid over the spindle 26, inwardly facing surfaces 104 on the collar wrench engage the flats 78 of the pipe section 32 in the spindle connection area 34.

The movement of the collar wrench 102 is actuated by a hydraulic cylinder 105 in combination with a spring 106. The collar wrench 102 is moved from the disengaged position to the engaged position by a hydraulic cylinder 105. However, if the pipe section 32 in the spindle connection area 34 is not aligned with the spindle 26 so that the pipe flats 78 will engage the inwardly facing surfaces 104 of the collar wrench 102, the spring 106 will compress. When the pipe flats 78 are aligned, the spring 106 will expand, forcing the collar wrench 102 to engage the pipe section 32 in the spindle connection area 34. Having the collar wrench 102 in the engaged position permits the spindle 26 to be locked to the pipe section 32 so that the pipe section can rotate with the spindle when the threaded connection between the spindle and pipe section has been broken.

One skilled in the art will appreciate that other designs for the wrenches are contemplated. For example, other geometric shapes capable of transmitting torque would be appropriate for the spindle collar wrench. Any number of flats on the end of the pipe section 32 could be configured to engage a corresponding number of surfaces on the inside of the spindle collar wrench 102, thereby locking the spindle 26 to the pipe section in the spindle connection area 34. Similarly, the first wrench 80 and the second wrench 94 could be designed to have a corresponding number of surfaces that would engage the arrangement of flats on the end of the pipe sections 32. The wrenches could be maneuvered to engage the flats, effectively clamping the pipe section 32 and the drill string 18 to prevent any rotation.

Figure 11:
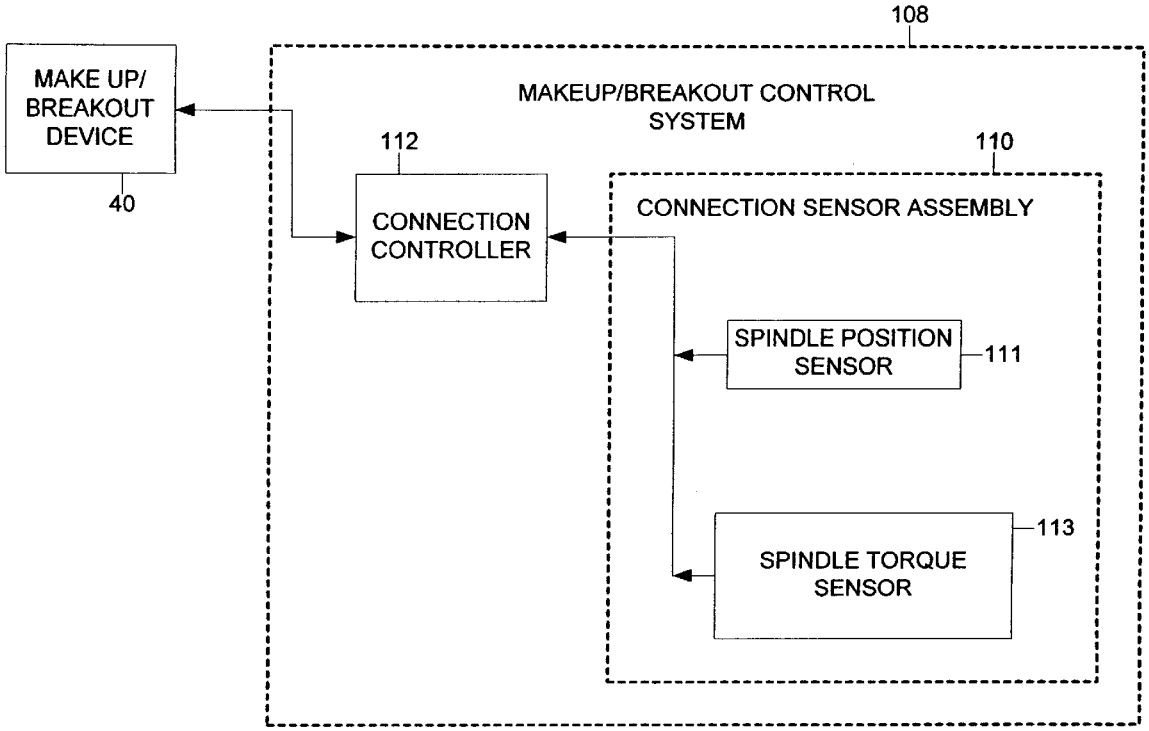
FIG. 11 is a block diagram of a circuit for controlling the makeup/breakout assembly of FIG. 10.

The present invention also provides for the automated control of the makeup/breakout assembly 40 by a makeup/breakout control system 108, shown in FIG. 11. With reference to FIG. 10, the makeup/breakout control system 108 automatically coordinates the operation of the makeup/breakout assembly 40 during the process of adding and removing pipe sections 32 to and from the drill string 18. The makeup/breakout control system 108 comprises a connection sensor assembly 110 and a connection controller 112. The connection sensor assembly 110 comprises a spindle position sensor 111 and a spindle torque sensor 113.

The spindle position sensor 111 detects the position of the spindle 26 by monitoring the motor used to thrust the drill string 18 and correlating revolutions of the motor to the distance the spindle travels. The spindle position sensor 111 detects the position of the spindle 26 in the spindle connection area 34 and transmits a SPINDLE POSITION signal to the connection controller 112. The spindle torque sensor 113 detects when the spindle 26 is connected to the drill string 18 by monitoring the pressure in the motor that provides rotation to the drill string. The spindle torque sensor 113 transmits a SPINDLE CONNECTION signal to indicate that the spindle 26 is or is not connected to the drill string 18. In response to the SPINDLE POSITION signal and the SPINDLE CONNECTION signal, the connection controller 112 will operate the makeup/breakout assembly 40.

Figure 12:
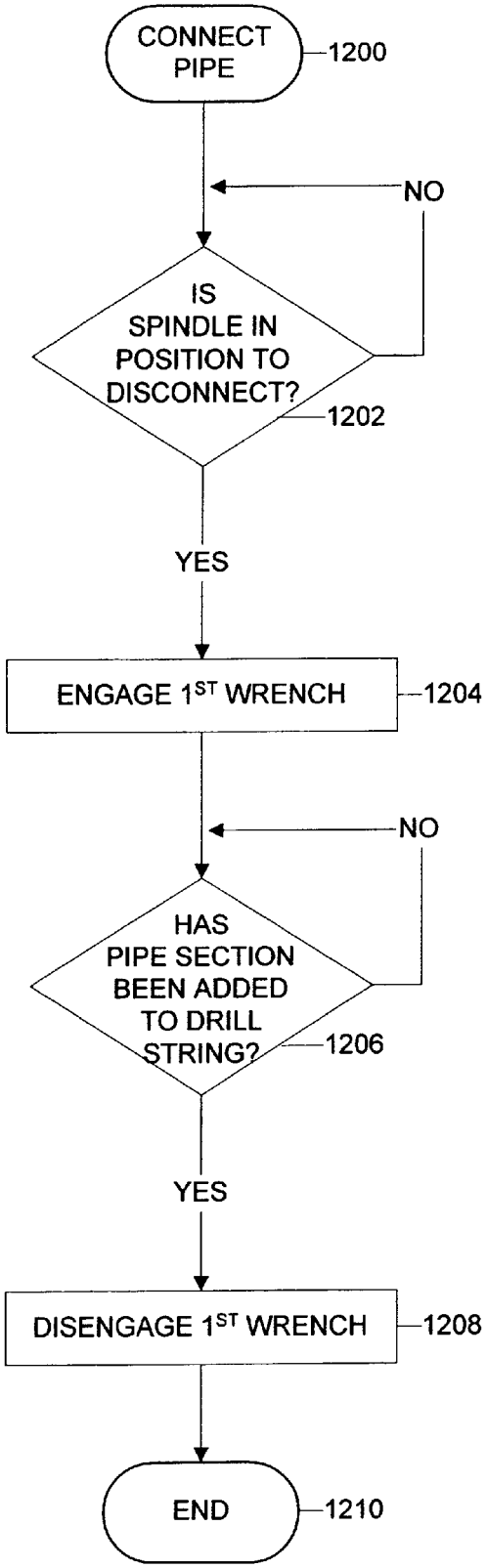
FIG. 12 is a flow diagram of a version of software for a Connect Pipe routine for the connection controller of FIG. 11.

The flow chart of FIG. 12 depicts an example of logic used by the connection controller 112 during the boring operation when a pipe section 32 is added to the drill string 18. With reference to FIGS. 10 and 11, the connection controller 112 initially waits for the SPINDLE POSITION signal at 1202, indicating that the spindle 26 is at the back end 33 of the spindle connection area 34 so that the pipe section 32 can be added to the drill string 18. After receiving the SPINDLE POSITION signal, the connection controller 112 engages the first wrench 80 at 1204, effectively securing the drill string 18 and preventing its rotation. Of the plurality of wrench devices, only the first wrench 80 is used during the boring operation. With the first wrench 80 engaged, the spindle 26 can be removed from the drill string 18 by reverse rotation and moved to the back end 33 of the spindle connection area 34.

After a pipe section 32 is placed in the spindle connection area 34, rotating and advancing the spindle 26 connects the spindle to the pipe section 32 and the pipe section to the drill string 18. With the first wrench 80 engaged, the rotation of the spindle 26 and the pipe section 32 in the spindle connection area 34 will make up the connection between the pipe section and the drill string 18. When the connection is made, the SPINDLE CONNECTION signal is received at 1206, indicating the pipe section 32 has been added to the drill string 18. The first wrench 80 is then disengaged at 1208 so that the boring operation can proceed at 1210.

Figure 13:
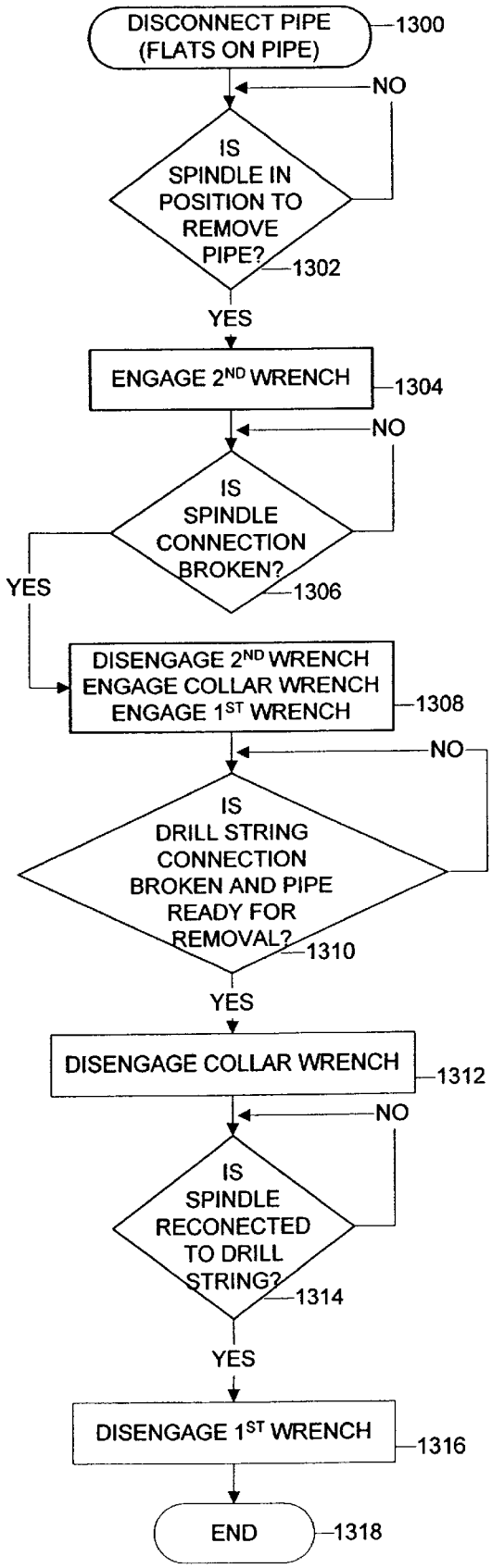
FIG. 13 is a flow diagram of a version of software for a Disconnect Pipe routine for the connection controller of FIG. 11.

The flow chart of FIG. 13 illustrates an example of logic used by the connection controller 112 during the backreaming operation when a pipe section 32 is removed from the drill string 18. With reference to FIGS. 10 and 11, the routine waits at 1302 for the SPINDLE POSITION signal indicating that the spindle 26 has pulled back so that the pipe section 32 to be removed from the drill string 18 is in the spindle connection area 34. After receiving the SPINDLE POSITION signal, the connection controller 112 engages the second wrench 94 at 1304 to secure the pipe section 32 in the spindle connection area 34. As the spindle 26 is reverse rotated, the connection between the spindle and the pipe section 32 will be broken and the spindle torque sensor 113 will transmit the SPINDLE CONNECTION signal. After receiving the SPINDLE CONNECTION signal at 1306, the connection controller 112 then disengages the second wrench 94 and engages the first wrench 80 and the collar wrench 102 at 1308.

With the collar wrench 102 engaged, the pipe section 32 will be locked to the spindle 26 and will rotate with the spindle, despite the connection being broken. The rotation of the spindle 26 and the pipe section 32 will then cause the connection to the drill string 18 to be broken and the SPINDLE CONNECTION signal will be received at 1310. The connection controller 112 then disengages the collar wrench 102 at 1312, and the pipe section 32 in the spindle connection area 34 can be removed by the pipe handling assembly 36.

After the pipe section 32 is removed from the spindle connection area 34, the spindle 26 is moved forward and reconnected to the drill string 18. When the spindle 26 reconnects to the drill string 18, the SPINDLE POSITION signal from the spindle position sensor 111 is received by the connection controller 112 at 1314. The first wrench 80 is then disengaged at 1316 and the backreaming operation can proceed at 1318.

Figure 14:
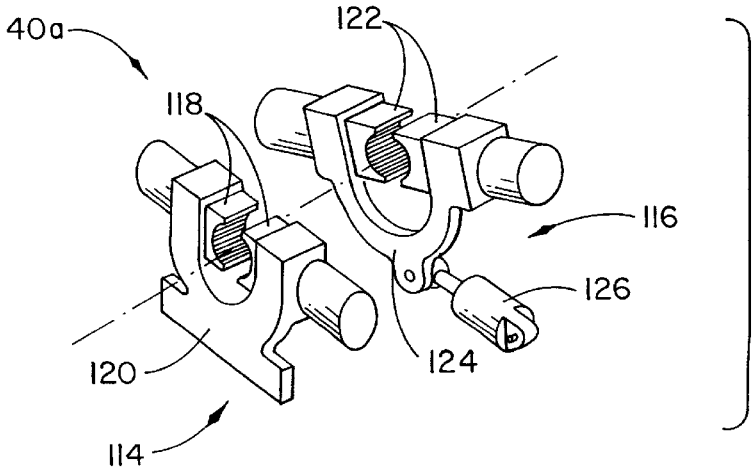
FIG. 14 is a partially cut-away, perspective view of an alternative embodiment of a makeup/breakout assembly.

An alternative embodiment for the makeup/breakout assembly is shown in detail in FIG. 14. The embodiment shown therein may be used with or without pipe sections 32 having flats 78. In this alternative embodiment, the makeup/breakout assembly **40*a* comprises a first wrench 114 and a second wrench 116. The first wrench 114 is positioned to secure the drill string 18. The second wrench 116, adjacent to the first wrench 114, is positioned to secure the pipe section 32 in the spindle connection area 34**.

The first wrench 114 comprises a hydraulically actuated pair of gripping members 118. The gripping members 118 are positioned on opposite sides of the drill string 18 and are supported by a horseshoe-shaped holding member 120. The holding member 120 is attached to the frame 14 to anchor the first wrench 114. When activated, the gripping members 118 are pressed against the drill string 18, securing the drill string and preventing it from rotating.

The second wrench 116 comprises a second hydraulically actuated pair of gripping members 122. The gripping members 122 of the second wrench 116 are positioned on opposite sides of the pipe section 32 in the spindle connection area 34. When the gripping members 122 are engaged, the gripping members grasp and secure the pipe section 32 in the spindle connection area 34. A rotatable horseshoe-shaped holding member 124 supports the gripping members 122. The holding member 124 is rotatable to permit the connection between the pipe section 32 in the spindle connection area 34 and the drill string 18 to be broken. The rotation of the holding member 124 is controlled by a hydraulic cylinder 126 connected at the base of the holding member 124. As the hydraulic cylinder 126 is operated, the holding member 124 and the pipe section 32 it is holding are rotated slightly. The slight rotation of the pipe section 32 in the spindle connection area 34, in conjunction with the drill string 18 being secured by the first wrench 114, permits the connection to be broken.

The instant embodiment of the invention also provides for the automated control of the makeup/breakout assembly **40*a* by the makeup/breakout control system 108, shown in FIG. 11 and described previously. As with the previously described embodiment, the makeup/breakout control system 108 automatically coordinates the operation of the makeup/breakout assembly 40*a* during the process of adding and removing pipe sections 32 to and from the drill string 18. During the boring operation when only the first wrench 114 is used, the logic followed by the connection controller 112 of the present embodiment is the same as the logic shown in the flow chart of FIG. 12 and described previously. However, during the backreaming operation when both wrenches 114 and 116 are used, the logic followed by the connection controller 112** is slightly different.

Figure 15:
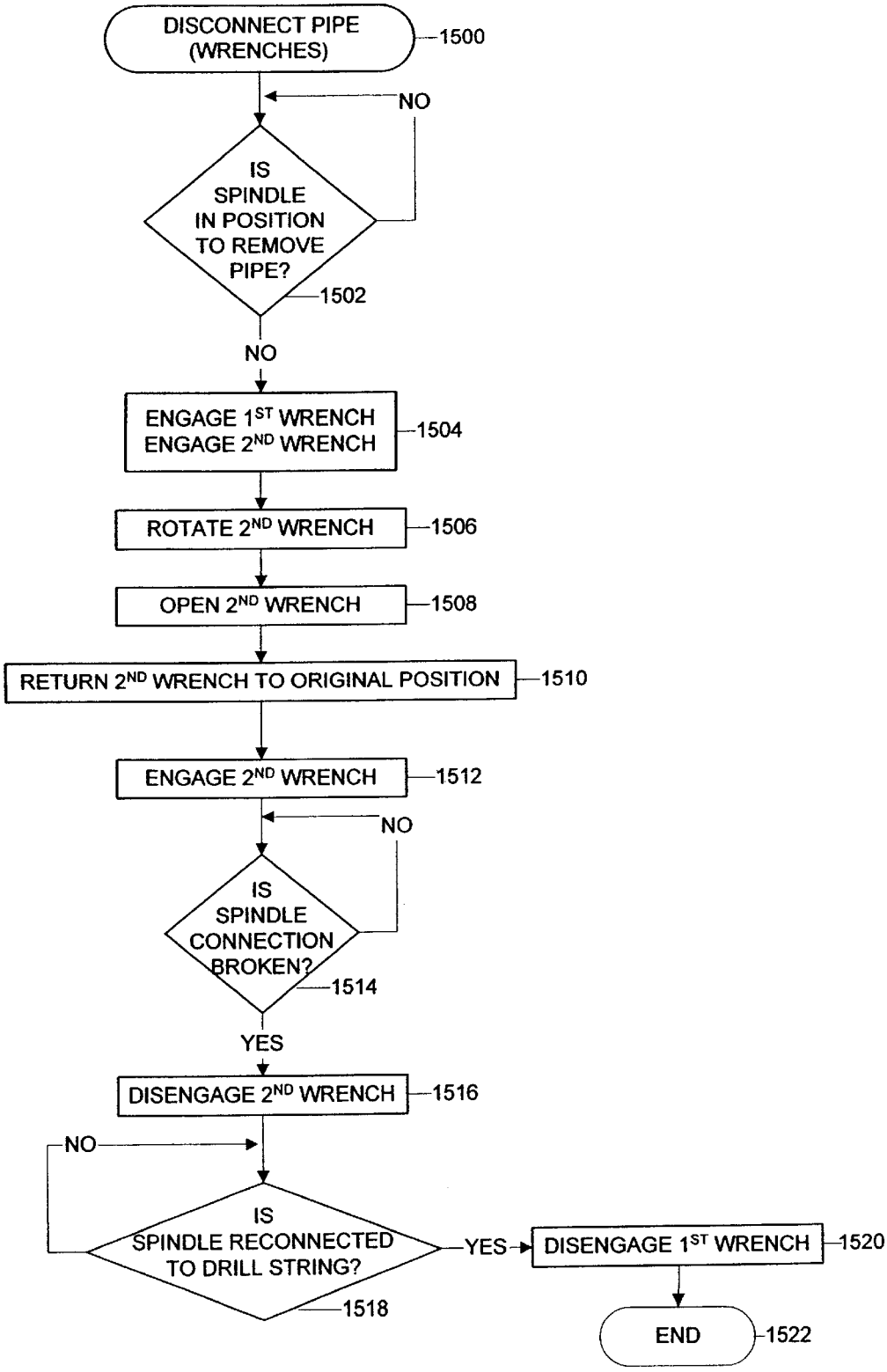
FIG. 15 is a flow diagram of an alternative version of software for a Disconnect Pipe routine for the controller of FIG. 11.

The flow chart in FIG. 15 illustrates an example of logic used by the connection controller 112 during the backreaming operation when the wrenches of FIG. 14 are used. The routine waits at 1502 for the SPINDLE POSITION signal indicating that the spindle 26 has pulled back so that the pipe section 32 to be removed from the drill string 18 is in the spindle connection area 34. After receiving the SPINDLE POSITION signal, the connection controller 112 engages the first wrench 114 at 1504 to secure the drill string 18. The connection controller 112 engages the second wrench 116 at 1504 to secure the pipe section 32 in the spindle connection area 34.

The hydraulic cylinder 126 is activated at 1506, rotating the holding member 124, the second wrench 116, and the pipe section 32 in the spindle connection area 34. The slight rotation breaks the connection between the pipe section 32 and the drill string 18. The second wrench 116 is disengaged at 1508 and rotated back to its original position at 1510. The connection controller 112 engages the second wrench at 1512, securing the pipe section 32 in the spindle connection area 34 again. The spindle 26 can now be reverse rotated to break the connection between the spindle 26 and the pipe section 32 in the spindle connection area 34.

When the connection is broken, the spindle torque sensor 113 will transmit the SPINDLE CONNECTION signal. After receiving the SPINDLE CONNECTION signal at 1514, the connection controller 112 disengages the second wrench 116 at 1516, and the pipe section 32 in the spindle connection area 34 can be removed by the pipe handling assembly. With the pipe section 32 removed from the spindle connection area 34, the spindle 26 is moved forward and reconnected to the drill string. After the spindle 26 reconnects to the drill string 18, the connection controller 112 receives the SPINDLE CONNECTION signal at 1518 and disengages the first wrench 114 at 1520. The backreaming operation then can proceed at 1522.

Pipe Lubrication System

Lubricating pipe joints 30 is helpful to prevent the pipe joints from forming too securely. If a lubricant is not used on the pipe joints 30, galling is possible. Galling can occur when pipe sections 32 of similar material and similar hardness are threaded together without lubricant, causing the pipe joints 30 to fuse together. Therefore, it is desirable to synchronize lubrication of the pipe joints 30 with the making and breaking of drill string 18 connections. One skilled in the art will appreciate that other methods of preventing galling may be used. For example, pipe sections of dissimilar materials or dissimilar hardness could be used. Alternatively, a permanent coating could been used on the pipe joints so that no lubrication is required. Drill pipe with a permanent coating used to prevent galling has appeared in this and related industries, and is disclosed *Innovative Technology for Tubular Connection to Eliminate Thread Compound Grease*, E. Tsuru et al., presented at the 1997 SPE/IADC Drilling Conference, SPE/IADC 37649. If a permanent coating technique or the like is used, no lubrication would be required and the present invention could be implemented without using a lubrication technique. However, as drill pipe requiring lubrication to prevent galling is currently prevalent, the present invention also contemplates a pipe lubrication assembly 38 to lubricate pipe joints 30 as required.

Shown in FIG. 16, the pipe lubrication assembly 38 comprises a lubricant reservoir 128, a pump system 130, and an applicator 132. In the preferred embodiment, the pump system 130 comprises a hydraulic pump 134 that transfers lubricant from the reservoir 128 to the applicator 132. When the pipe joints 30 to be lubricated are in the proper position, a first valve 136 and a second valve 144 supply hydraulic pressure to the hydraulic pump 134. The hydraulic pump 134 produces a rapid, high pressure lubricant to the applicator 132. The applicator 132 comprises a nozzle assembly 138 that sprays lubricant onto pipe joints 30. During the boring operation, lubricant is alternately applied to the connections at both ends of the pipe section 32 that is to be added to the drill string 18. Consequently, the nozzle assembly 138 preferably comprises a pair of spray nozzles 140 and 142. A first spray nozzle 140 is positioned to apply lubricant to the spindle pipe joint 28. A second spray nozzle 142 is positioned to apply lubricant to the exposed pipe joint 30 of the drill string 18. The lubricant is applied after the spindle 26 disconnects from the drill string 18, prior to when a new pipe section 32 is connected to the drill string.

During the backreaming operation, lubricant preferably is applied only to the exposed pipe joint 30 of the drill string 18 since the spindle 26 will connect to the drill string in preparation of pulling back. The first valve 136 is activated to enable the second spray nozzle 142. Consequently, lubricant will be transferred only to the second spray nozzle 142. One skilled in the art will appreciate that, alternatively, the second valve 144 may enable the first spray nozzle 140 so that the first spray nozzle 140 applies lubricant to the spindle pipe joint 28.

One skilled in the art will appreciate that other configurations for the spray nozzles 140 and 142 are possible. For example, the present embodiment would be equally effective if the spray nozzles are positioned as shown in the embodiment depicted in FIGS. 17*a* and 17*b* and described subsequently. The timing of the application of lubricant to the pipe joints 30 will be described hereafter.

Figure 17:
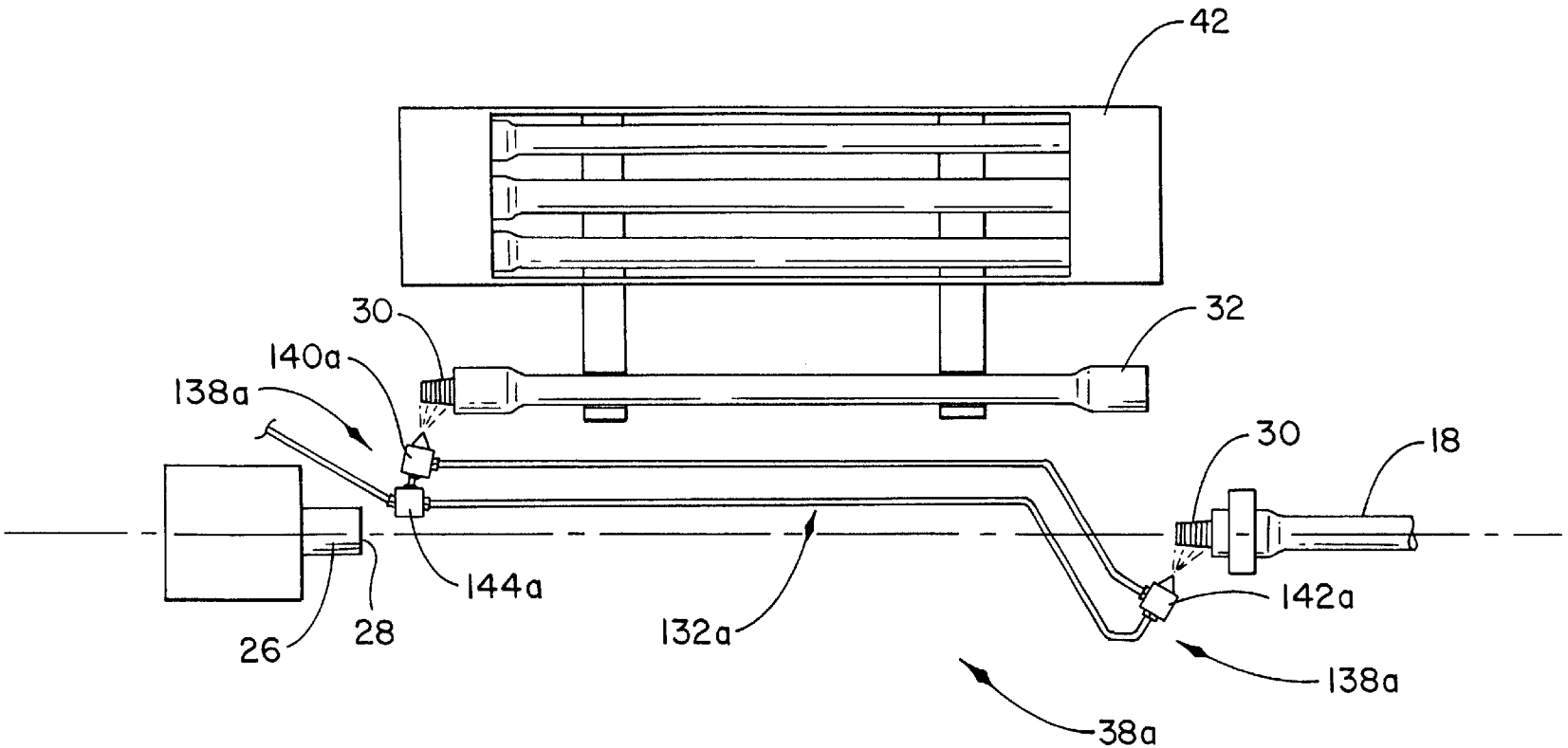
FIG. 17*a* is an exploded, schematic illustration of an alternative embodiment of a pipe lubrication assembly.
FIG. 17*b* is an exploded, partial top view of the pipe lubrication assembly of FIG. 17*a*.
Figure 18:
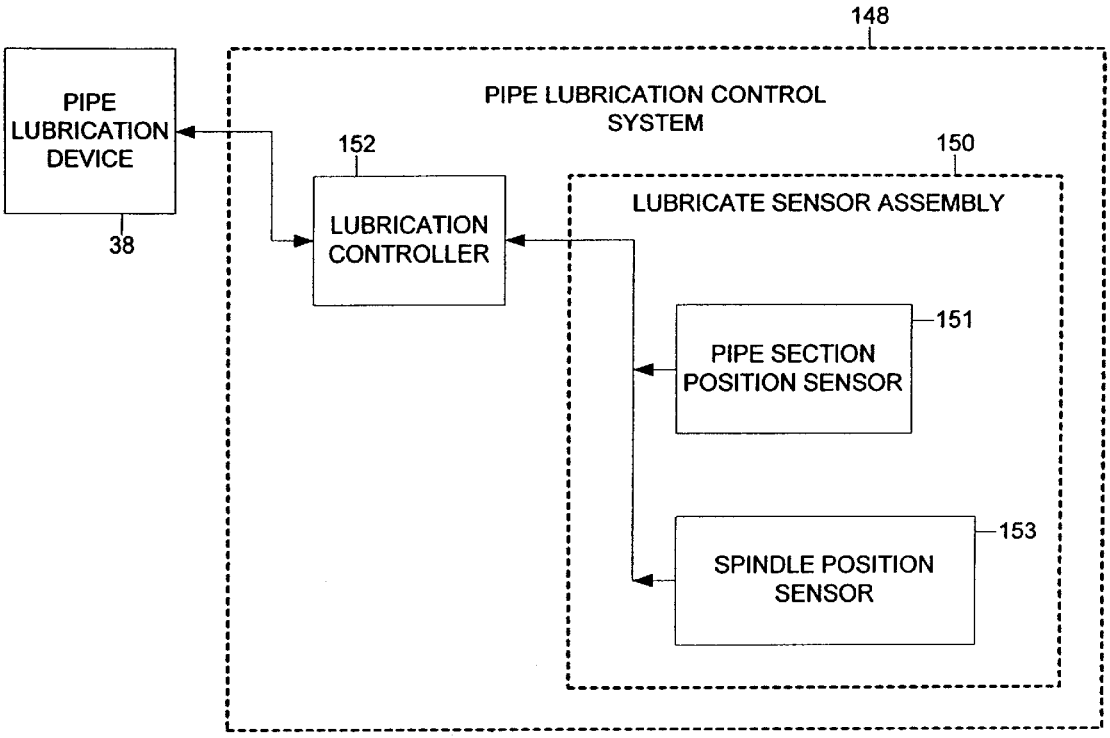

FIGS. 17*a* and 17*b* illustrate an alternative embodiment of the pipe lubrication assembly 38*a*. In this embodiment, the pump system 130*a* comprises a pneumatic pump 146. The pipe lubrication assembly 38*a* applies lubricant to the male threads of the pipe joints 30 as a pipe section 32 is transported to the spindle connection area 34. A first valve 136*a* supplies pressurized air to the pneumatic pump 146. The pneumatic pump 146 transfers lubricant to the applicator 132*a*. The applicator 132*a* comprises a nozzle assembly 138*a* that sprays atomized lubricant onto pipe joints 30. The lubricant is atomized by pressurized air that is supplied to the nozzle assembly 138*a* at the same time that the pneumatic pump 146 is activated.

During the boring operation, lubricant is applied to two pipe joints 30, at both ends of the pipe section 32 that is to be added to the drill string 18. Consequently, in this embodiment, the nozzle assembly 138*a* comprises a pair of spaced apart spray nozzles 140*a* and 142*a*. A first spray nozzle 140*a* is positioned to apply lubricant to the pipe section 32 being transferred to the spindle connection area 34 at the end proximate the spindle pipe joint 28. A second spray nozzle 142*a* is positioned to apply lubricant to the exposed pipe joint 30 of the drill string 18. The lubricant is applied after the spindle 26 disconnects from the drill string 18, prior to when a new pipe section 32 is moved into the spindle connection area 34.

During the backreaming operation, lubricant preferably is applied only to the exposed pipe joint 30 of the drill string 18 after the pipe section 32 is removed from the spindle connection area 34, since the spindle 26 will connect to the drill string in preparation of pulling back the drill string. A second valve 144*a* is activated to disable the first spray nozzle 140*a*. Consequently, lubricant will be transferred only to the second spray nozzle 142*a*. One skilled in the art will appreciate that other configurations for the spray nozzles 140*a* and 142*a* are possible. For example, the first spray nozzle 140*a* could be configured to apply lubricant to the spindle pipe joint 28.

Figure 18:
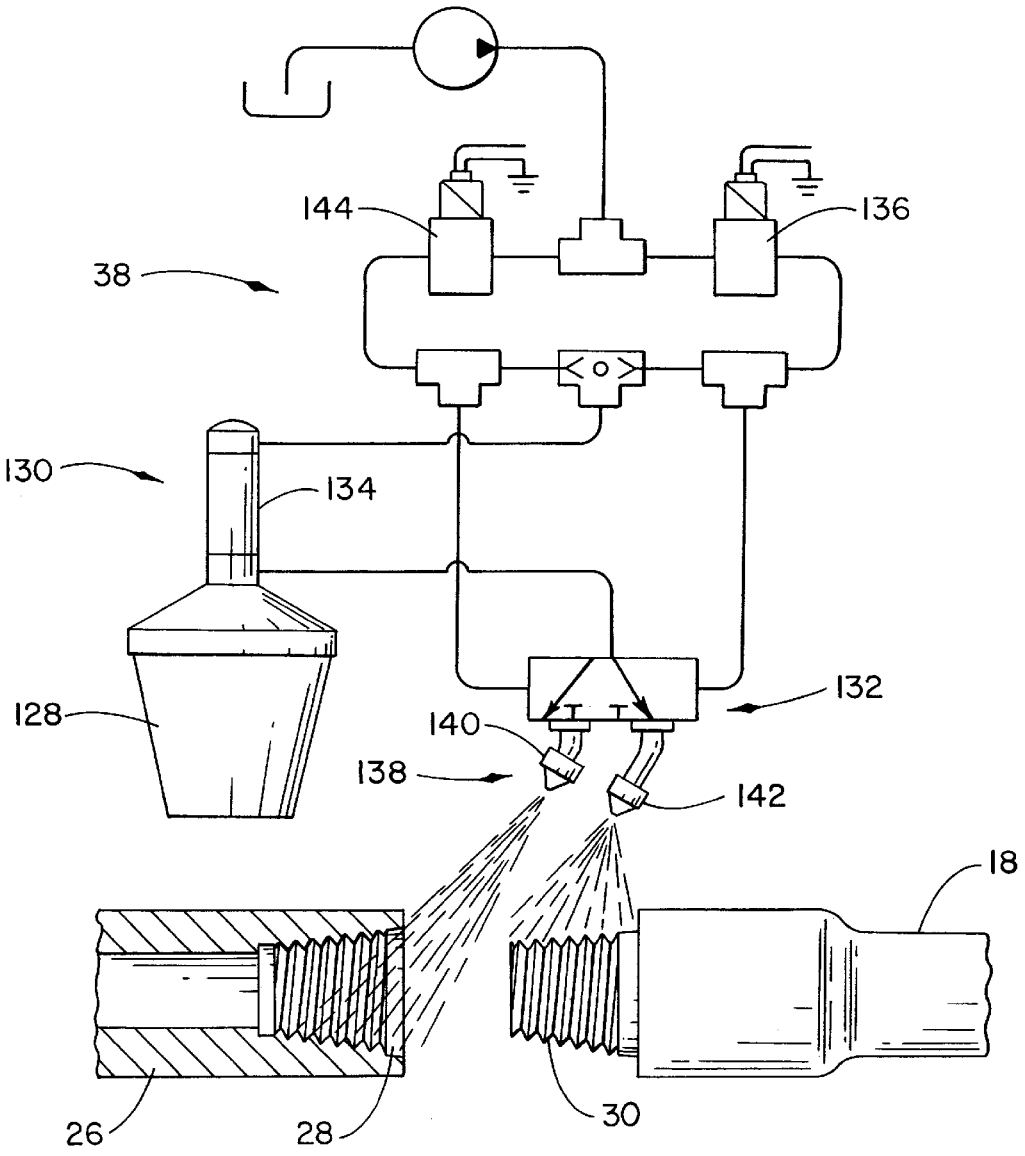
FIG. 18 is a block diagram of a circuit for controlling the pipe lubrication assembly.
Figure 5H:
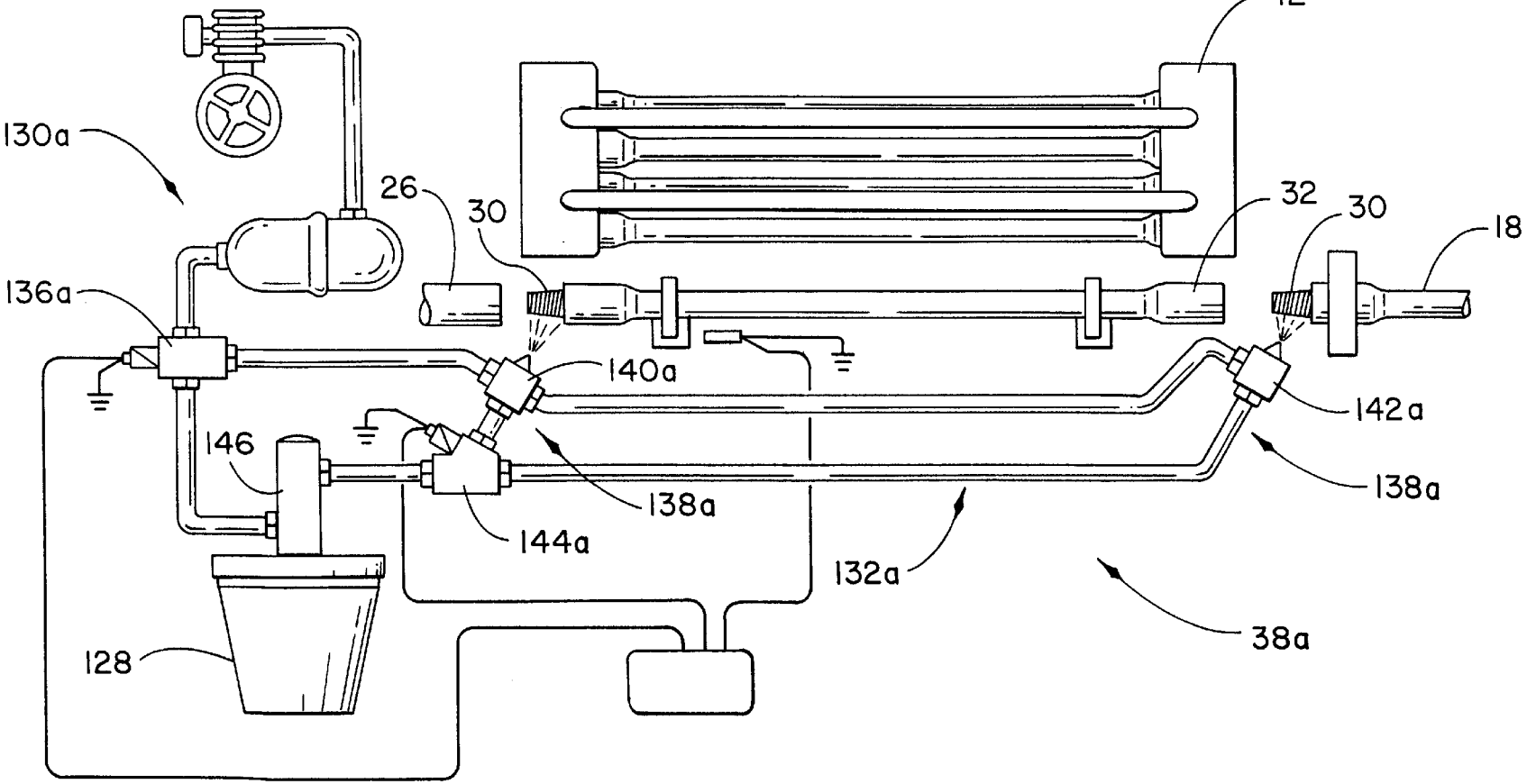

The present invention also provides for the automated control of the pipe lubrication assembly 38 or 38*a*, using a pipe lubrication control system. Illustrated in FIG. 18, the pipe lubrication control system 148 comprises a lubricate sensor assembly 150 and a lubrication controller 152. The lubricate sensor assembly 150 determines the relative position of a pipe section 32 being transferred to the spindle connection area 34 and the spindle 26 in the spindle connection area. The lubricate sensor assembly 150 comprises a pipe section position sensor 151 and a spindle position sensor 153.

During the boring operation, when a pipe section 32 is added to the drill string 18, the pipe section position sensor 151 transmits a LUBRICATE PIPE signal to the lubrication controller 152, indicating that the pipe section is in a position to be lubricated. The pipe lubrication assembly 38 or 38*a* of the present invention preferably is used in conjunction with the pipe handling assembly 36. The pipe section position sensor 151 detects the position of the transport assembly 50 by correlating the operation of the drive assembly 52 to the distance traveled by the transport assembly. When the pipe section position sensor 151 detects the pipe section 32 to be added to the drill string 18 is in a position to be lubricated, the pipe section position sensor transmits the LUBRICATE PIPE signal. One skilled in the art will appreciate that the pipe section position sensor 151 may be replaced by any device suitable for indicating when the pipe section 32 is positioned so that lubricant can be applied to the pipe joints 30.

The spindle position sensor 153 is used by the lubrication controller 152 to detect when lubricant is to be dispensed during the backreaming operation. The spindle position sensor 153 detects the position of the spindle 26 by monitoring the motor used to thrust the drill string 18 and correlating revolutions of the motor to the distance the spindle travels. During the backreaming operation, when the spindle position sensor 153 detects the spindle 26 in the spindle connection area 34 proximate the exposed end of the drill string 18, the spindle position sensor 153 transmits a SPINDLE POSITION signal to the lubrication controller 152. In response to the signals from the lubricate sensor assembly 150, the lubrication controller 152 activates the pipe lubrication assembly 38 or 38*a* so that the pipe joints 30 are lubricated.

Figure 19:
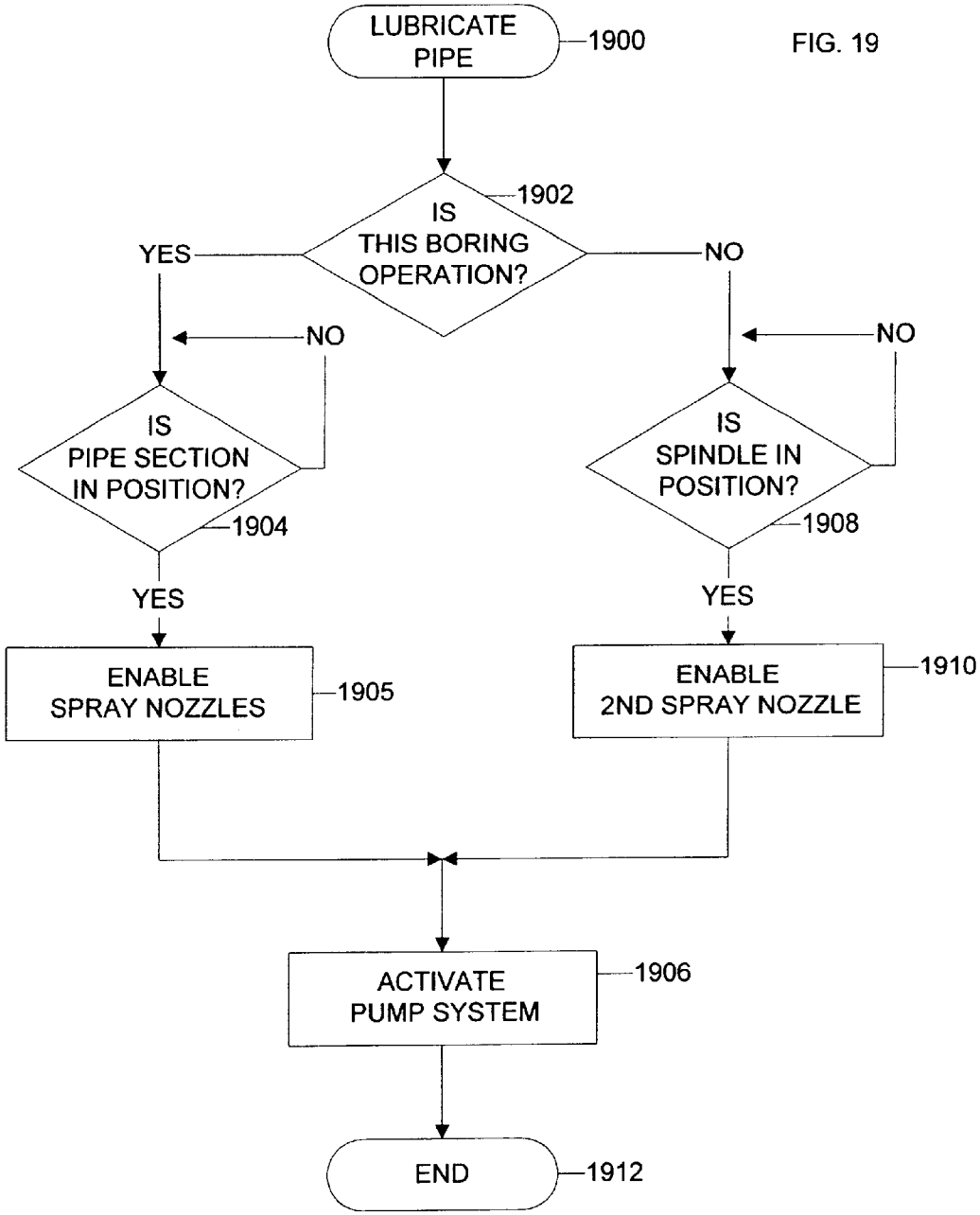
FIG. 19 is a flow diagram of a version of software for the lubrication controller of FIG. 18.

An example of logic followed by the lubrication controller 152 is illustrated in FIG. 19. The lubrication controller first determines at 1902 if lubricant is being applied during the boring operation or the backreaming operation. During the boring operation, when a pipe section 32 is added to the drill string 18, the lubrication controller 152 waits at 1904 for the pipe section to be put in position so that the pipe joints 30 can be lubricated. When the LUBRICATE PIPE signal is received indicating the pipe section 32 is in position, the first spray nozzle 140 or 140*a* and the second spray nozzle 142 or 142*a* are enabled at 1905. The pump system 130 or 130*a* is then activated at 1906 and lubricant is delivered to the first spray nozzle 140 or 140*a* and the second spray nozzle 142 or 142*a*.

During the backreaming operation, when a pipe section 32 is removed from the drill string 18, the lubrication controller 152 waits at 1908 for the SPINDLE POSITION signal. The SPINDLE POSITION signal is transmitted by the spindle position sensor 153 when the spindle 26 is in position for lubricant to be dispensed prior to the spindle reconnecting to the drill string 18. When the SPINDLE POSITION signal is received, the first valve 136 or 136*a* is used to enable the second spray nozzle 142 or 142*a* at 1910. The lubrication controller 152 then activates the pump system 130 or 130*a* at 1906, and only the second spray nozzle 142 or 142*a* dispenses lubricant. The LUBRICATE routine completes at 1912.

Figure 20:
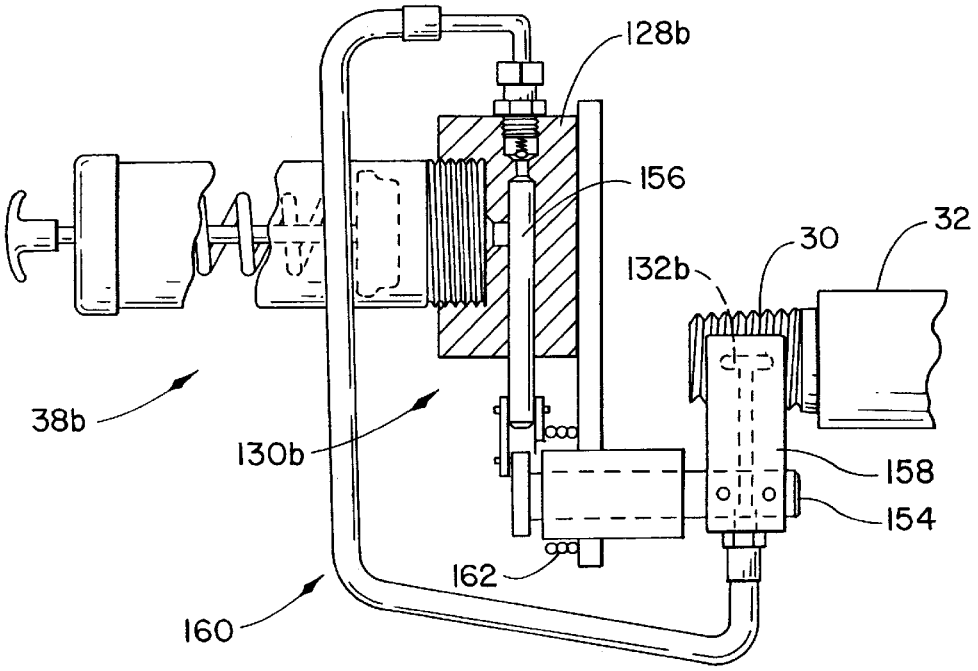
FIG. 20 is an exploded, partially fragmented side elevational view of an alternative embodiment of the pipe lubrication assembly.
Figure 21:
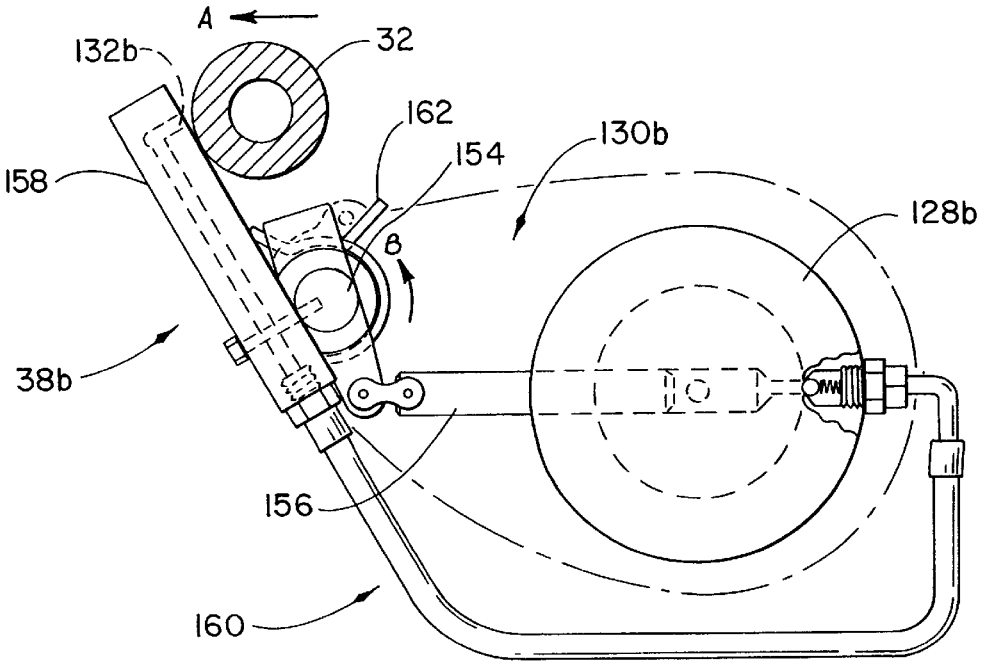
FIG. 21 is an exploded end elevational view of the pipe lubrication assembly of FIG. 20.

A third embodiment for the pipe lubrication assembly is shown in FIGS. 20 and 21. As shown, the pipe lubrication assembly 38*b* is a passive mechanical apparatus. The pump system 130*b* comprises a rotatable shaft 154 coupled to a piston 156 that pumps lubricant out of the lubricant reservoir 128*b*. The shaft 154 is rotated by a movable arm 158 having a first end that is connected to the shaft and a second end that comes in physical contact with the pipe section 32 to be lubricated. The movable arm 158 is positioned such that, as the pipe section 32 is transported to the spindle connection area 34 in the direction of the arrow A (FIG. 21), the pipe section will contact the second end of the movable arm, causing the movable arm to pivot. As the movable arm 158 pivots, the shaft 154 rotates in the direction of arrow B (FIG. 21). The rotation of the shaft 154 causes the piston 156 to compress and pump lubricant out of the lubricant reservoir 128*b*. The lubricant is transferred through a hose assembly 160 to the applicator 132*b*. The applicator 132*b* is positioned so that as the pipe joint 30 to be lubricated passes by the applicator, the pipe joint will brush against the applicator so that lubricant is wiped onto the pipe joint. In the embodiment shown, the applicator 132*b* is part of the movable arm 158.

During the backreaming operation, when pipe sections 32 are transported from the spindle connection area 34, the pipe lubrication assembly 38*b* is designed not to dispense lubricant. As the pipe section 32 is transported in the direction opposite arrow A, the pipe section contacts and pivots the movable arm 158. As the movable arm 158 pivots, the shaft 154 rotates in the direction opposite arrow B. The rotation of the shaft 154 in this direction causes the piston 156 to be withdrawn and not pump lubricant. A torsion spring 162 on the shaft 154 returns the shaft to its original position, regardless of the direction of the shaft rotation.

Automatic Control of Pipe Handling System

Figure 22:
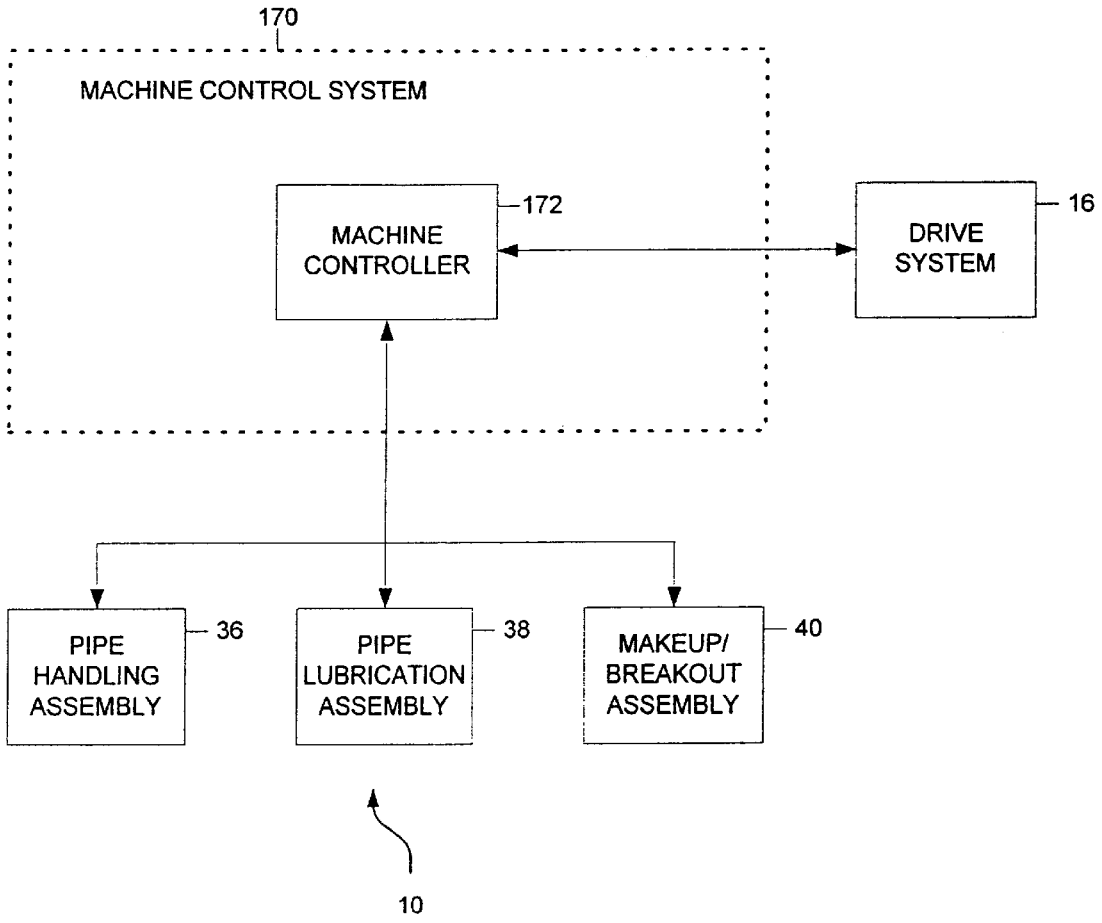
FIG. 22 is a schematic illustration of a machine control system in accordance with an embodiment of the present invention.

The present invention preferably provides for automatic control of the pipe handling system 17 to minimize the need for operator involvement. A machine control system, shown in FIG. 22, synchronizes the operations of the pipe handling assembly 36, the pipe lubrication assembly 38, and the makeup/breakout assembly 40*a*. The machine control system 170 is activated by the operator and controls the operation of the boring machine 10 when a pipe section 32 is added to, or removed from, the drill string 18. The machine control system 170 comprises a machine controller 172 that controls the operations of the boring machine 10.

FIGS. 23 through 31 illustrate flow charts of exemplary embodiments of logic used by the machine controller 172. One skilled in the art will appreciate that the machine controller 172 can be programmed to control any number of the assemblies to allow the operator as much control as desired. For example, control of the pipe lubrication assembly 38 can be omitted where drill pipe that does not require lubrication is used. Alternatively, the pipe lubrication assembly 38 can be omitted so that the operator can lubricate pipe joints 30 manually as needed, or so that a passive mechanical assembly, such as that shown in FIGS. 20 and 21 and described earlier, could be used.

Figure 23:
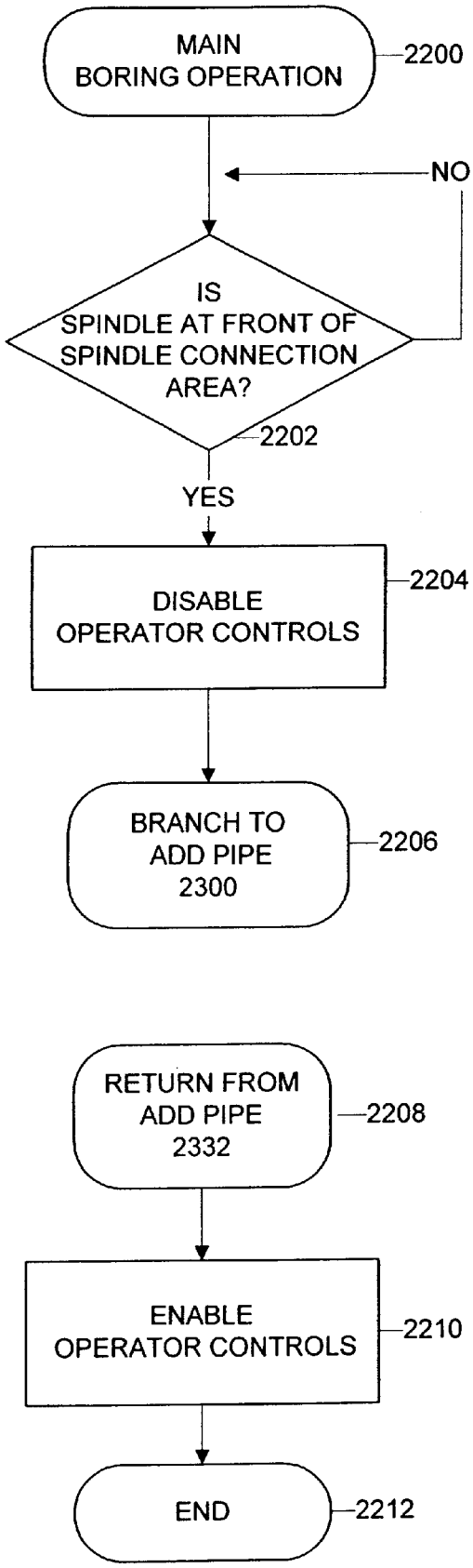
FIGS. 23–27 illustrate flow diagrams of software for the machine control system of FIG. 22 during a boring operation.

FIG. 23 illustrates a main boring operation logic diagram. When a pipe section 32 must be added to the drill string 18 during the boring operation, the operator activates the machine control system 170 by turning a switch or pushing a button at the control panel 24 (see FIG. 1) at 2200. The machine controller 172 waits at 2202 for the SPINDLE POSITION signal indicating that the spindle 26 is positioned at the front of the spindle connection area 34. When the SPINDLE POSITION signal is received, the machine controller 172 disables the operator's controls at 2204. The operation then branches to the ADD PIPE routine at 2206, illustrated in FIG. 24. When the pipe section 32 has been added to the drill string 18, control returns at 2208, and the operator's controls are enabled at 2210. The operator can then resume the boring operation at 2212.

Figure 24:
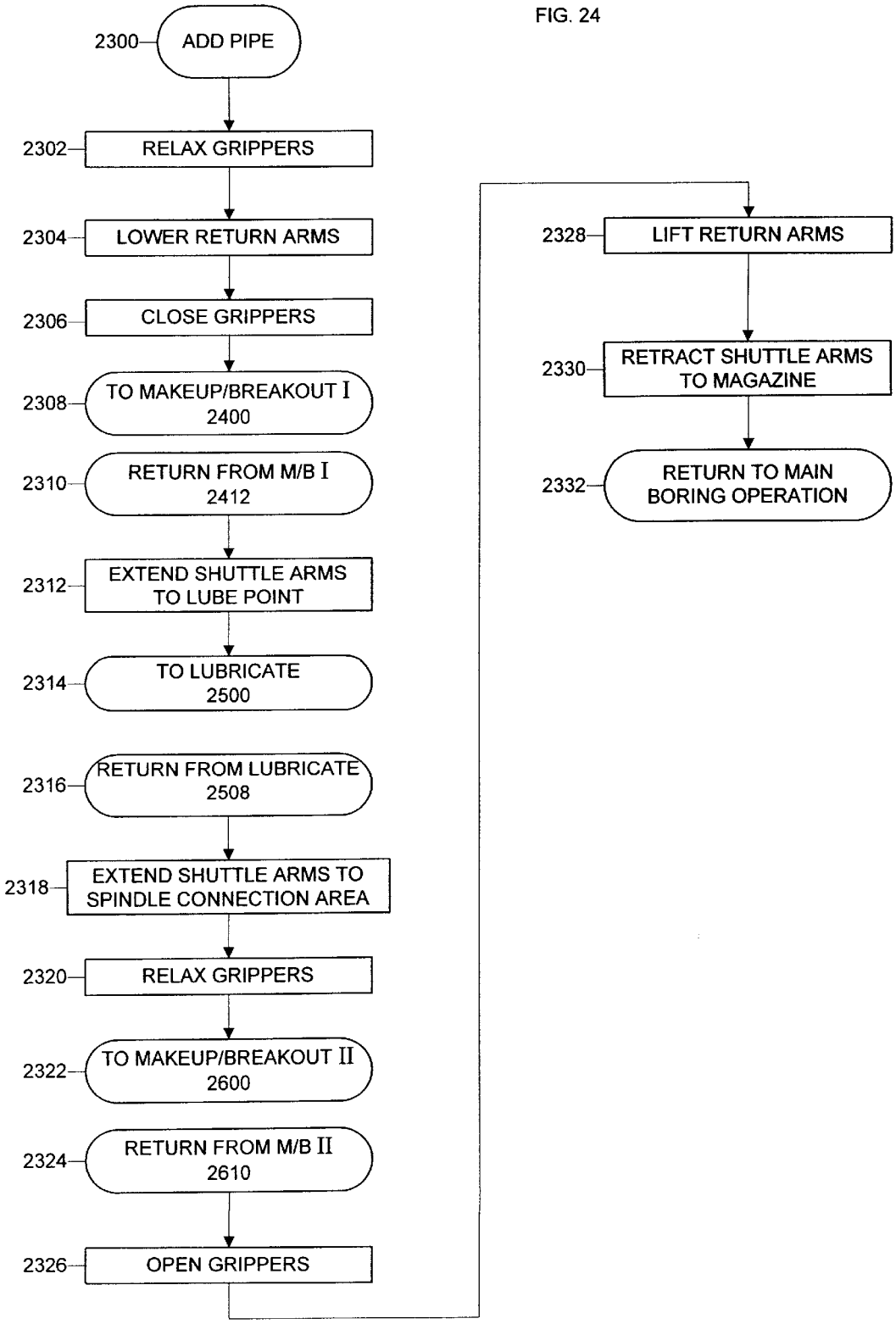
Figure 25:
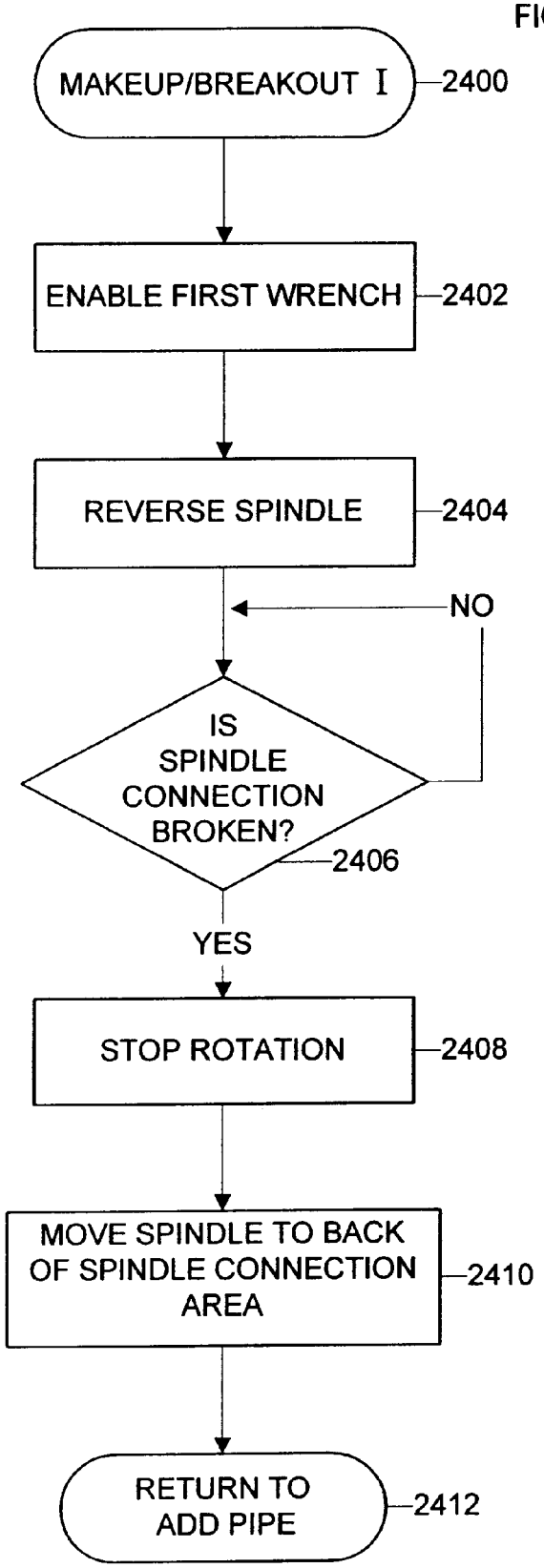
Figure 26:
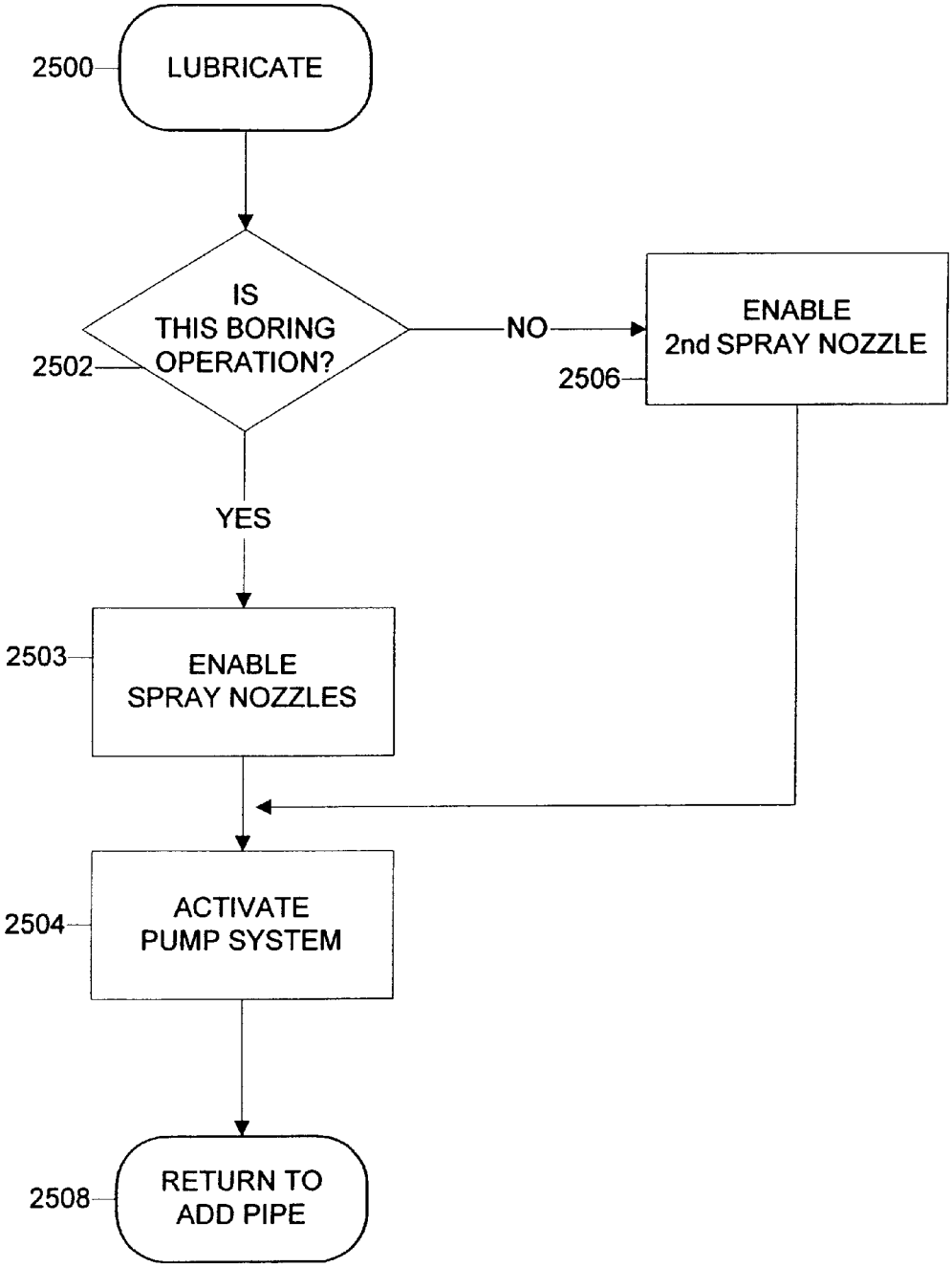

FIG. 24 illustrates logic flow for adding a pipe section 32 to the drill string 18. At 2302 the active gripper device 58*a*, if used, is relaxed. The return arms 49 are lowered at 2304 to place a pipe section 32 in the pipe holding member 56. The gripper device 58*a* is then closed at 2306 to secure the pipe section in the pipe holding member 56. The MAKEUP/BREAKOUT I routine of FIG. 25 is then initiated at 2308 to disconnect the spindle 26 from the drill string 18. When control returns at 2310, the spindle 26 is positioned at the back end 33 of the spindle connection area 34. The shuttle arms 55 are extended to the lubrication point at 2312 where the LUBRICATE routine of FIG. 26 is called at 2314. One skilled in the art will appreciate that an apparatus such as the lubrication sensor assembly 150, described earlier, can be used to indicate the position of the pipe section 32 to be lubricated.

Figure 27:
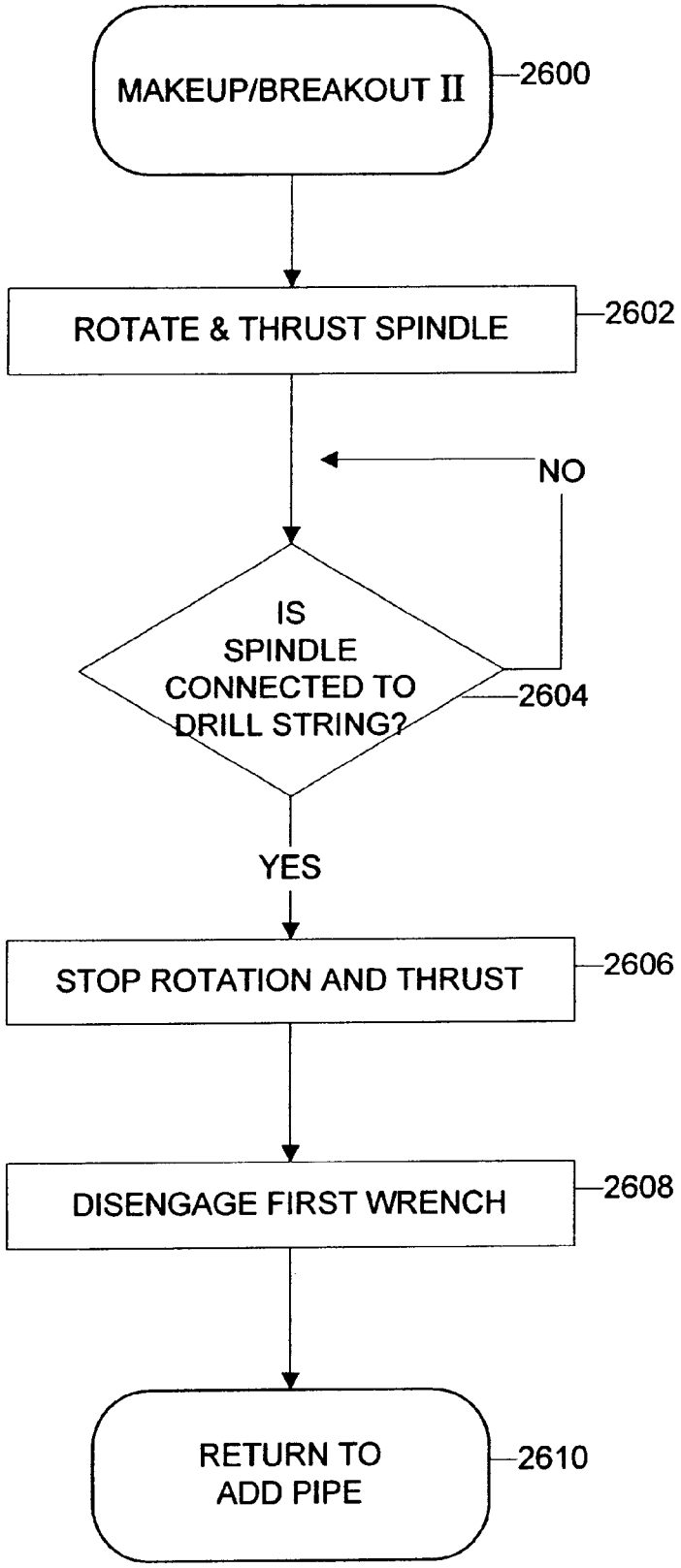

After the pipe section 32 has been lubricated, the shuttle arms 55 are extended to the spindle connection area 34 at 2318. The gripper device 58*a* is relaxed at 2320 and the MAKEUP/BREAKOUT II routine of FIG. 27 is called at 2322 to make up the connection between the spindle 26 and the pipe section 32 in the spindle connection area 34 and between the pipe section and the drill string 18. When control returns at 2324, the gripper device 58*a* is opened at 2326. At 2328 the return arms 49 are lifted, and at 2330 the shuttle arms 55 are retracted to the magazine 42. Control returns to the MAIN BORING procedure of FIG. 23 at 2332.

The MAKEUP/BREAKOUT I routine of FIG. 25 illustrates how the spindle 26 is disconnected from the drill string 18 during the boring operation before a pipe section 32 is placed in the spindle connection area 34. The first wrench 114 of the makeup/breakout assembly 40*a* is engaged at 2402 to secure the drill string 18. The spindle 26 is then rotated in reverse at 2404 to break the spindle connection to the drill string 18. The routine then waits at 2406 for a signal indicating that the spindle 26 is disconnected from the drill string 18. An apparatus such as the connection sensor assembly 110 described above could be used to detect when the spindle connection is broken.

When the spindle 26 has been disconnected from the drill string 18, the rotation of the spindle is stopped at 2408. The spindle 26, now free from the pipe section 32, is then moved to the back end 33 of the spindle connection area 34 at 2410. Control returns back to the ADD PIPE routine of FIG. 24 at 2412. The present discussion illustrates automatic control of the makeup/breakout assembly 40*a* of FIG. 14. Other makeup/breakout assemblies, such as the makeup/breakout assembly 40 shown in FIG. 10 and described earlier, could be automatically controlled by the machine controller 172.

A LUBRICATE routine is shown in FIG. 26. A first check is made at 2502 to determine if a pipe section 32 is being added during the boring operation or being removed during the backreaming operation. As discussed earlier, during the backreaming operation only one pipe joint 30 need be lubricated. Thus, during the boring operation the first spray nozzle 140*a* and the second spray nozzle 142*a* are enabled at 2503. The pump system 130 is then activated at 2504, and pipe joints 30 are lubricated at both ends of the pipe section 32 being added to the drill string 18. During the backreaming operation, the second spray nozzle 142*a* is enabled at 2506. When the pump system 130 is activated at 2504, only the second spray nozzle 142*a* applies lubricant to the pipe joint 30 on the exposed end of the drill string 18. Control is returned to the calling procedure at 2508.

FIG. 27 illustrates logic of a MAKEUP/BREAKOUT II routine that connects the spindle 26 to the pipe section 32 in the spindle connection area 34 and the pipe section to the drill string 18. At 2602 the spindle 26 is rotated and thrust forward to connect to the pipe section 32 and to subsequently connect the pipe section to the drill string 18. The routine then waits at 2604 for a signal indicating the spindle 26 is connected to the drill string 18. When the connections are made, the rotation and thrust of the spindle are stopped at 2606. The first wrench 114 is then disengaged at 2608 so that the drill string 18 can rotate freely and the boring operation can continue at 2610.

Figure 28:
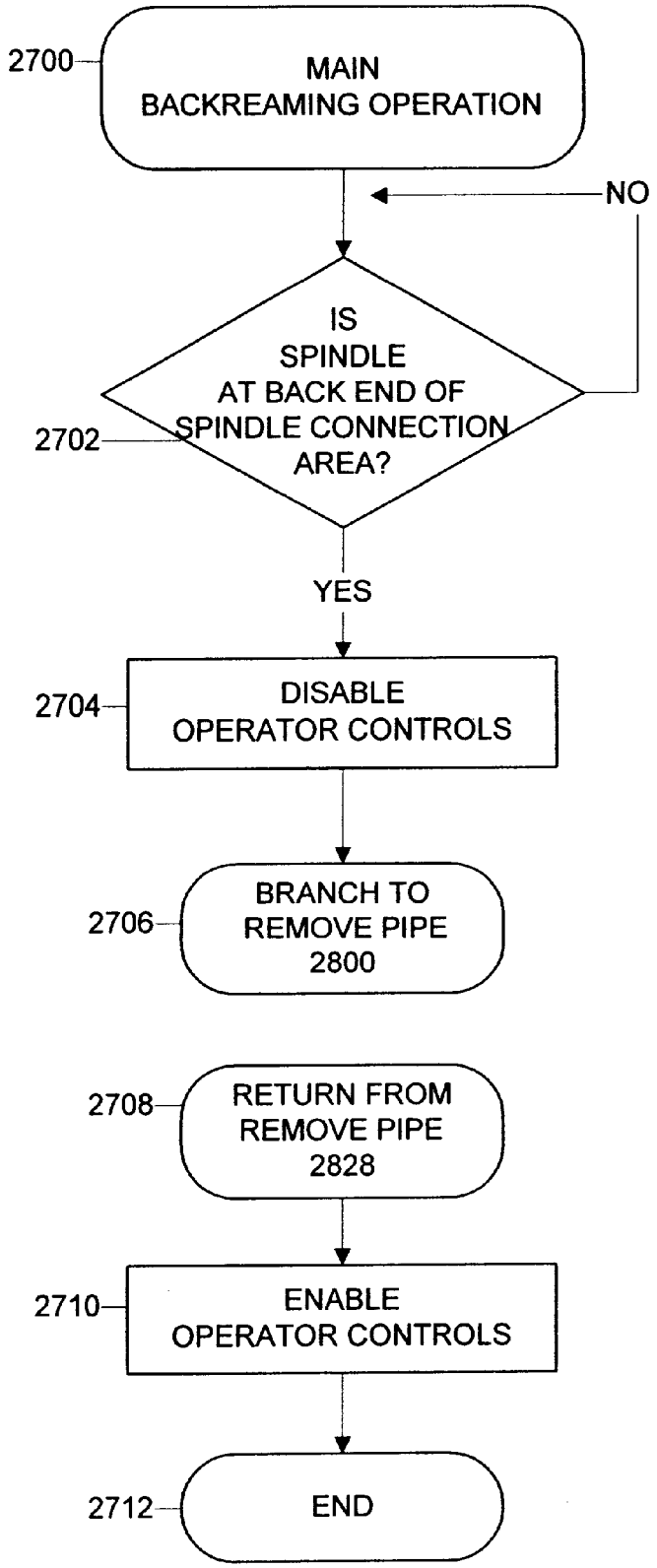
FIGS. 28–31 illustrate flow diagrams of software for the machine control system of FIG. 22 during a backreaming operation.

FIG. 28 illustrates a main backreaming operation logic diagram. When a pipe section 32 is to be removed from the drill string 18 during the backreaming operation, the operator activates the machine control system 170 by turning a switch or pushing a button on the control panel 24 (see FIG. 1) at 2700. The machine controller 172 waits for the spindle 26 to be positioned at the back end 33 of the spindle connection area 34 at 2702. When the spindle 26 is in position, the machine controller 172 disables the operator's controls at 2704. The operation then branches to the REMOVE PIPE routine at 2706, illustrated in FIG. 29. When the pipe section 32 has been removed from the drill string 18, control returns at 2708 and the operator's controls are enabled at 2710. The operator then can resume the backreaming operation at 2712.

Figure 29:
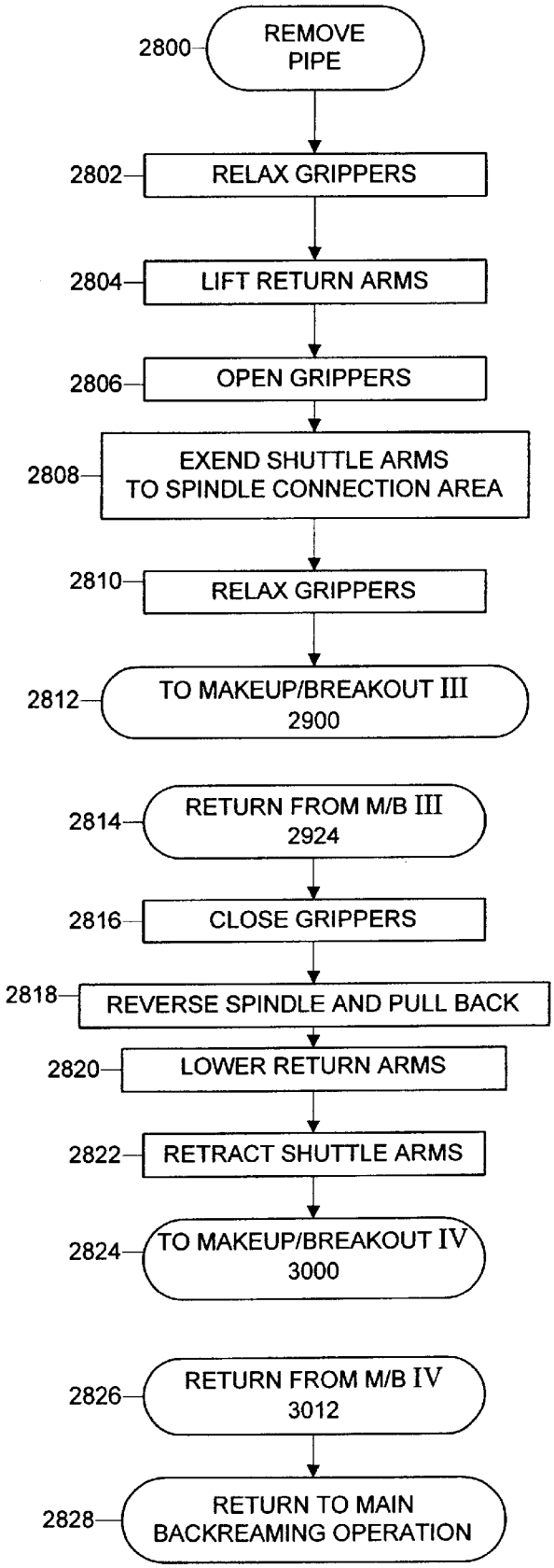

FIG. 29 illustrates the logic flow for removing a pipe section 32 from the drill string 18. At 2802 the active gripper device 58*a* is opened to the relaxed position. The return arms 49 are lifted at 2804 to free the shuttle arms 55 from the pipe sections 32 in the magazine 42. The gripper device 58*a* is then opened at 2806 and the shuttle arms 55 are extended to the spindle connection area 34 at 2808. The gripper device 58*a* is then closed to the relaxed position at 2810 to support the pipe section 32 in the spindle connection area 34. The MAKEUP/BREAKOUT III routine of FIG. 30 is initiated at 2812 to disconnect the spindle 26 from the drill string 18.

Figure 31:
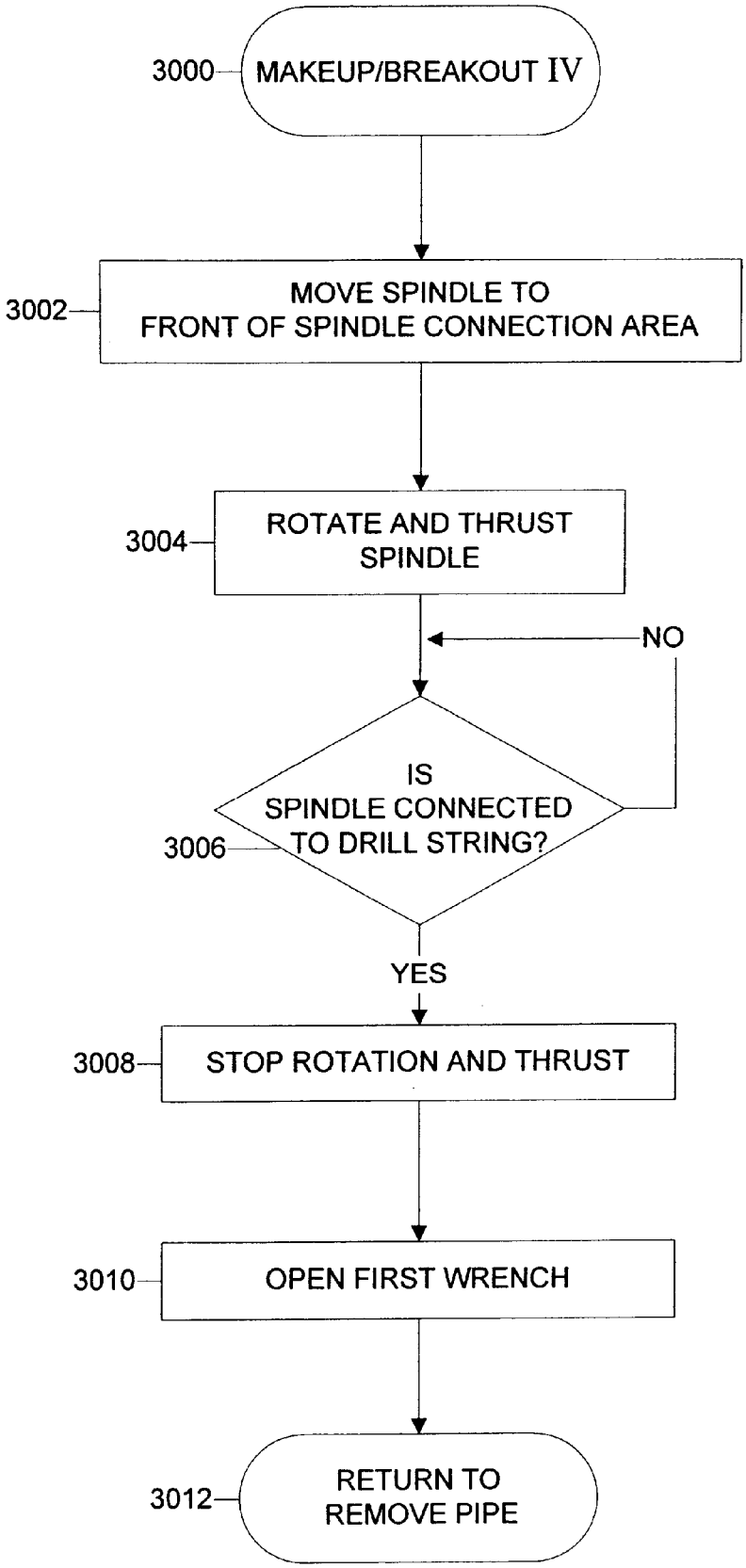

When control returns at 2814, the pipe section 32 in the spindle connection area 34 is free from the spindle 26 and the drill string 18. The gripper device 58*a* is closed at 2816 to secure the pipe section 32 in the pipe holding member 56. At 2818 the spindle 26 is rotated in reverse and pulled back from the pipe section 32 in the spindle connection area 34. One skilled in the art will appreciate that the pipe section 32 is now free from the drill string 18 and the spindle 26. The return arms 49 are lowered at 2820 and the shuttle arms 55 are then retracted to their position beneath the magazine 42 at 2822. The MAKEUP/BREAKOUT IV routine of FIG. 31 is called at 2824 to reconnect the spindle 26 to the drill string 18. When control returns at 2826, the boring machine 10 is ready to resume backreaming, and control is returned to the MAIN BACKREAMING procedure of FIG. 28 at 2828.

Figure 30:
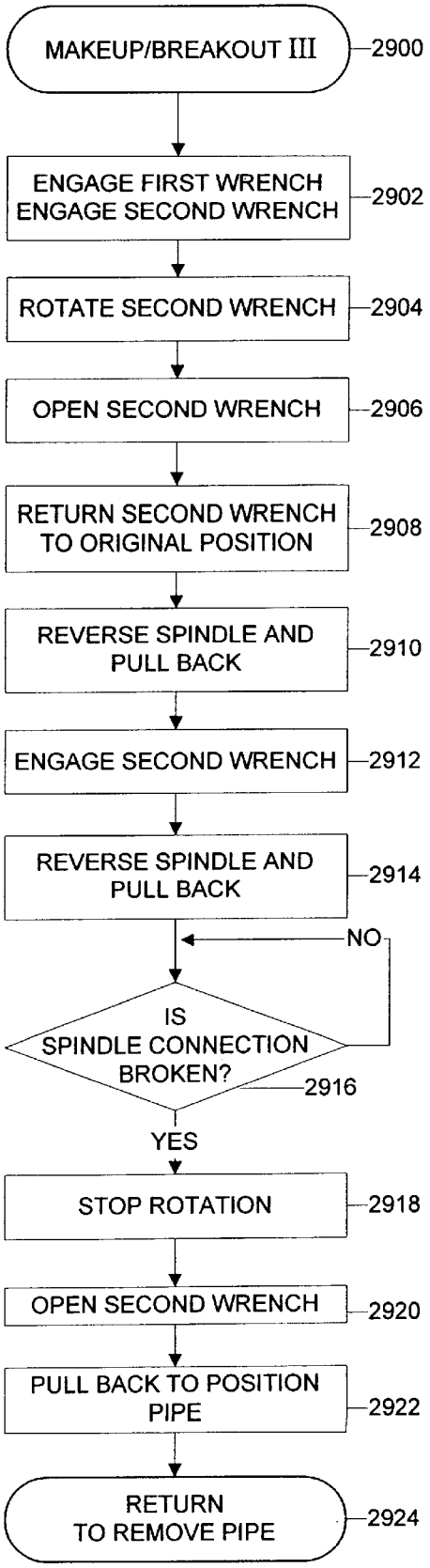

The MAKEUP/BREAKOUT III routine of FIG. 30 illustrates how the pipe section 32 in the spindle connection area 34 is disconnected from the drill string 18 during the backreaming operation. The first wrench 114 and the second wrench 116 of the makeup/breakout assembly 40*a* are engaged at 2902 to secure the pipe section 32 in the spindle connection area 34 and the drill string 18. At 2904 the second wrench 116 is rotated to disconnect the pipe section 32 from the drill string 18. The second wrench 116 is then opened at 2906 and rotated back to its original position at 2908. At 2910 the spindle 26 and the pipe section 32 are rotated in reverse and pulled back to position the pipe section so that it is free from the drill string 18, but in position for the second wrench 116 to secure the pipe section. The second wrench 116 is then engaged at 2912 to again secure the pipe section 32 in the spindle connection area 34.

The spindle 26 is rotated in reverse at 2914 to break but not unscrew the spindle connection to the pipe section 32. The routine waits at 2916 for the spindle 26 connection to the pipe section 32 to be broken. When the spindle 26 is broken loose from the pipe section 32, the rotation and pullback of the spindle are stopped at 2918. The second wrench 116 is then opened at 2920 and the pipe section is pulled back to align it with the magazine 42 at 2922. One skilled in the art will appreciate that a pipe section 32 in the spindle connection area 34 is now free from the spindle 26 and the drill string 18. Control then returns back to the REMOVE PIPE routine of FIG. 29 at 2924.

FIG. 31 illustrates the logic of a MAKEUP/BREAKOUT IV routine where the spindle 26 is reconnected to the drill string 18. At 3002 the spindle 26 is moved to the front end of the spindle connection area 34. The spindle 26 is rotated and thrust forward to connect to the drill string 18 at 3004. The routine then waits at 3006 for the spindle 26 to be reconnected to the drill string 18. When the connection to the drill string 18 is made, the rotation and thrust of the spindle 26 are stopped at 3008. The first wrench 114 is then opened at 3010 so that the drill string 18 can rotate freely and the backreaming operation can continue at 3012.

Those skilled in the art will appreciate that variations from the specific embodiments disclosed above are contemplated by the invention. For example, the description of the machine control system 170 incorporates an active gripper device 58*a* as shown in FIG. 5, the wrench devices of the makeup/breakout assembly 40*a* illustrated in FIG. 14, and the nozzle assembly 138*a* shown in FIG. 17*a*. However, the use of other assemblies is contemplated. For example, a passive gripper device such as that shown in FIG. 4 could be used so that the machine control system 170 need not operate the gripper device. Similarly, the makeup/breakout assembly 40 of FIG. 10 could be substituted and its operation controlled by the machine control system 170. Where any modification or substitution is contemplated, the logic for the machine controller 172 would have to modified to control the particular assemblies that comprise the pipe handling system.

As described herein, the machine controller 172 of the machine control system 170 is preferably microprocessor based and capable of executing the logic described above to operate the assemblies included in the pipe handling system 17. However, both microprocessor based and non-microprocessor based systems may be used for controlling the operations of the pipe handling system 17. For example, the machine control system 170 may comprise a plurality of switches, valves, relays, solenoids, and other electronic or mechanical devices to control and sequence the operations of any of the assemblies of the pipe handling system 17.

Figures 32A, 32B:
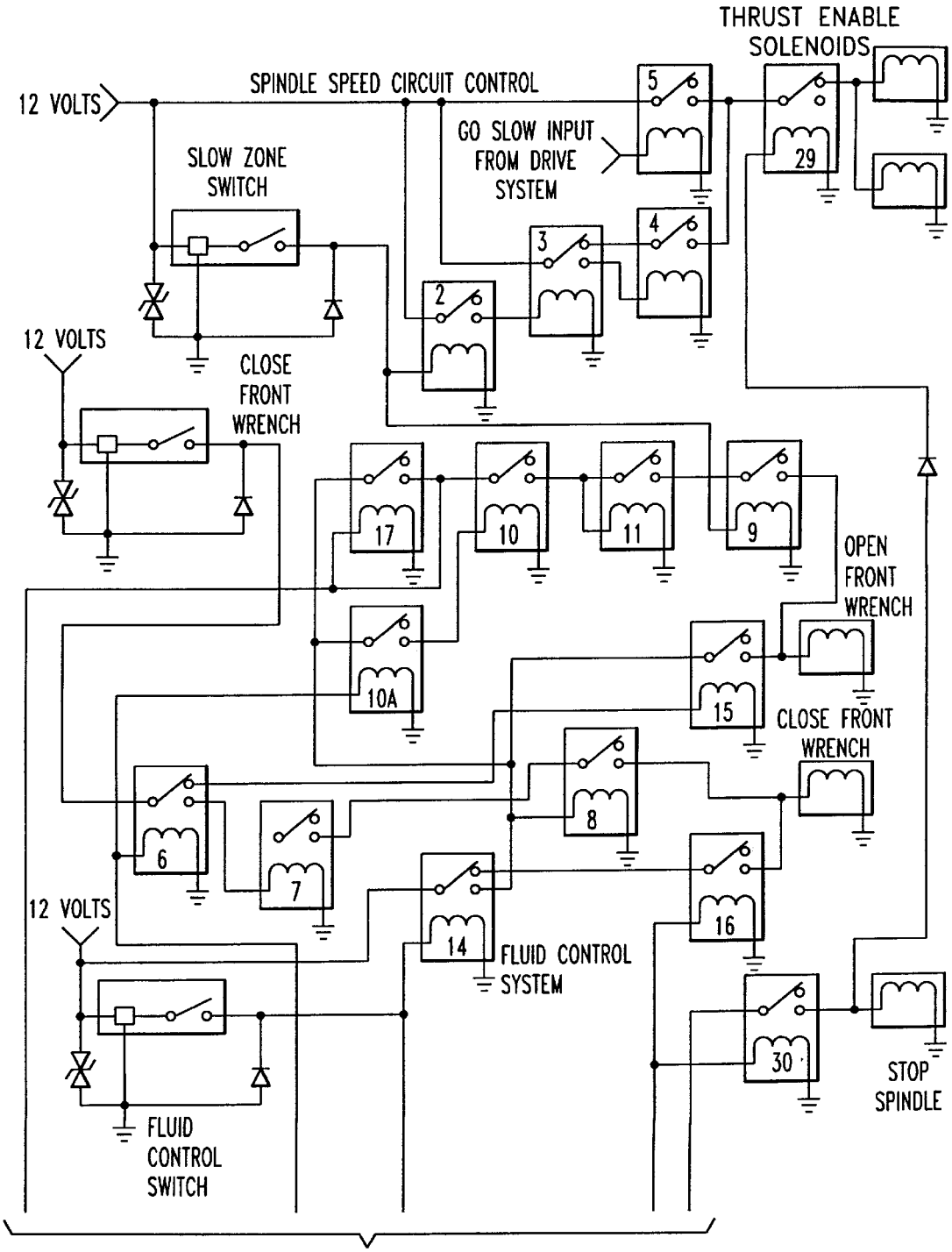
FIG. 32 is a schematic illustration of an alternative embodiment for a circuit for controlling a makeup/breakout assembly.
Figures 32A, 32B:
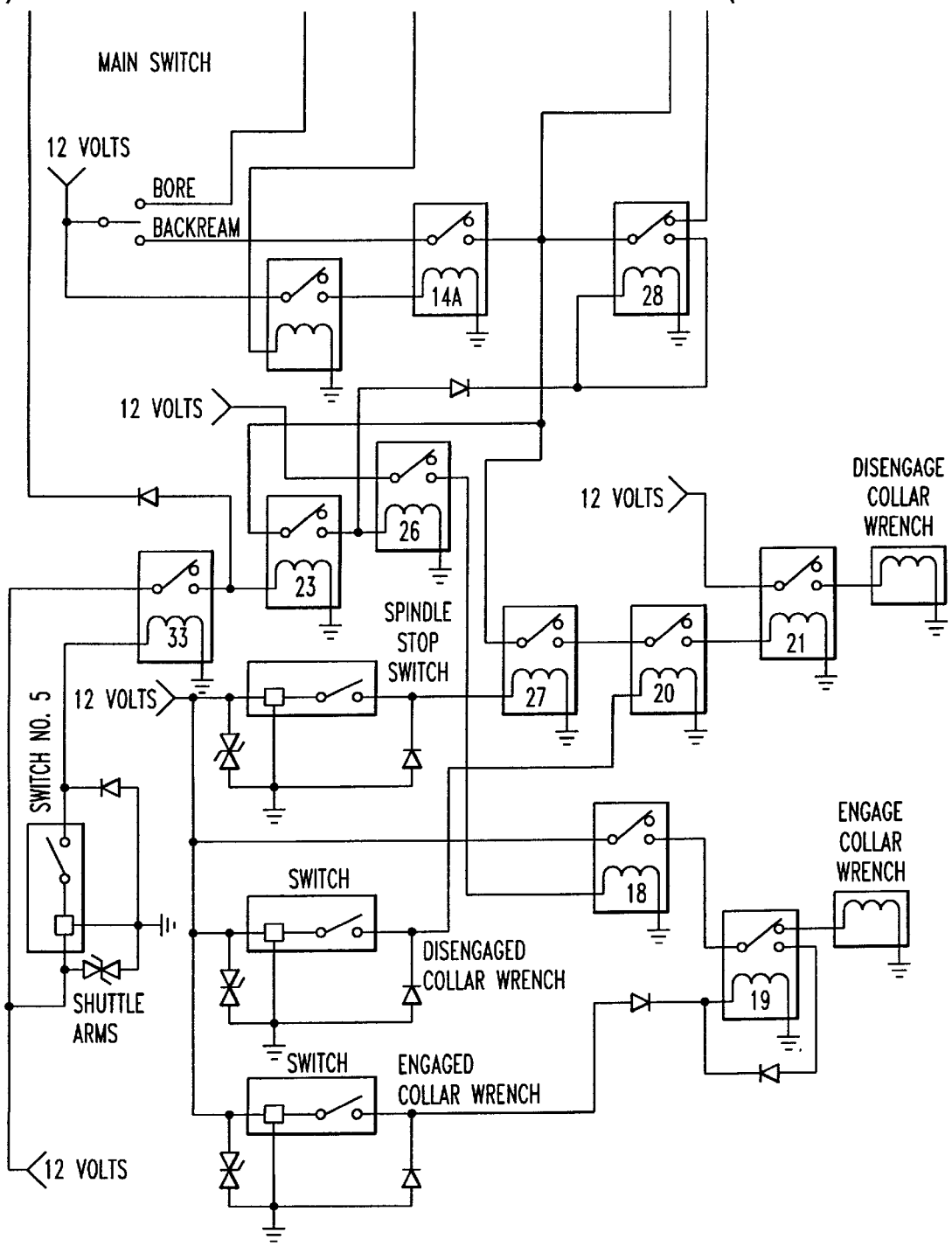

By way of example, FIG. 32 illustrates an exemplary embodiment of a circuit for controlling the first wrench 80 and the collar wrench 102 of the makeup/breakout assembly 40 of FIG. 10. The circuit of FIG. 32 can be used to control the operations of the wrenches during both the boring operation and the backreaming operation, depending on the state of a main control switch. Additionally, the system of FIG. 32 can be used to open and close the front wrench 80, engage and disengage the collar wrench 102, and otherwise control the sequences necessary to operate the makeup/breakout assembly 40. As shown, the circuit of FIG. 32 operates in conjunction with the above described systems to control other assemblies and in conjunction with systems for controlling other aspects of the boring machine 10, such as the thrust and rotation of the spindle 26.

FIG. 33 illustrates an additional example of a non-microprocessor based machine control system 170 for the pipe handling system 17. The circuit of FIG. 33 shows an exemplary embodiment of a circuit for controlling the pipe handling assembly 36 of FIGS. 3 and 4. The circuit of FIG. 33 can be used to control the operations of the pipe handling assembly 36 during both the boring operation and the backreaming operation, depending on the state of a main control switch. Additionally, the system of FIG. 33 can be used to extend and retract the shuttle arms 55, raise and lift the return arms 49, and otherwise control the sequences necessary to operate the pipe handling assembly 36. As shown, the circuit of FIG. 33 operates in conjunction with the above described systems to control other assemblies and in conjunction with systems for controlling other aspects of the boring machine 10, such as the thrust and rotation of the spindle 26.

Although the present invention has been described with respect to several specific preferred embodiments, various changes, modifications, and substitutions of parts and elements may be suggested to one skilled in the art. Consequently, the invention should not be restricted to the above embodiments and it is intended that the present invention encompass such changes, modifications, and substitutions of parts and elements without departing from the spirit and scope of the invention.

What is claimed is:

1. A pipe handling system for use with a horizontal boring machine having a drive system, a drill string comprised of a plurality of pipe sections connectable at threaded pipe joints, a spindle comprising a spindle pipe joint for connecting the drill string to the drive system, and a spindle connection area, the pipe handling system comprising:

a makeup/breakout assembly adapted to secure the drill string and at least one pipe section in the spindle connection area as the at least one pipe section is connected to or disconnected from the drill string by executing a plurality of operations;

a pipe handling assembly adapted to store and to transport pipe sections to and from the spindle connection area by executing a plurality of operations;

a handling assembly control system adapted to automatically operate the pipe handling assembly by initiating and coordinating the plurality of operations executed by the pipe handling assembly; and a makeup/breakout control system adapted to automatically operate the makeup/breakout assembly by initiating and coordinating the plurality of operations executed by the makeup/breakout assembly.

2. The pipe handling system of claim 1 further comprising:

a pipe lubrication assembly adapted to apply lubricant to at least one pipe joint by executing a plurality of operations.

3. The pipe handling system of claim 2 wherein the pipe lubrication assembly comprises:

a lubricant reservoir;

a pump system; and an applicator;

wherein the pump system is adapted to transfer lubricant from the lubricant reservoir to the applicator.

4. The pipe handling system of claim 3 wherein the pump system comprises a hydraulic pump.

5. The pipe handling system of claim 3 wherein the applicator comprises a nozzle assembly.

6. The pipe handling system of claim 5 wherein the nozzle assembly comprises:

a first spray nozzle positioned to apply lubricant to the spindle pipe joint; and a second spray nozzle positioned to apply lubricant to an exposed pipe joint of the drill string.

7. The pipe handling system of claim 5 wherein the nozzle assembly comprises:

a first spray nozzle positioned to apply lubricant to a pipe joint of a pipe section in the spindle connection area at an end of the pipe section proximate the spindle pipe joint; and a second spray nozzle positioned to apply lubricant to an exposed pipe joint of the drill string.

8. The pipe handling system of claim 3 wherein the pump system comprises a pneumatic pump.

9. The pipe handling system of claim 3 wherein the pump system comprises:

a rotatable shaft;

a piston operatively connectable to the rotatable shaft and adapted to pump lubricant out of the lubricant reservoir; and a movable arm having a first end and a second end, the first end connected to the rotatable shaft and the second end positioned to contact a particular pipe section being transported to the spindle connection area.

10. The pipe handling system of claim 9 wherein the applicator is positioned to contact a particular pipe joint of the particular pipe section, such that as the particular pipe joint comes into contact with the applicator, lubricant is wiped onto the particular pipe joint.

11. The pipe handling system of claim 2 further comprising:

a pipe lubrication control system adapted to automatically operate the pipe lubrication assembly by initiating and coordinating the plurality of operations executed by the pipe lubrication assembly.

12. The pipe handling system of claim 11 wherein the pipe lubrication control system comprises:

a lubricate sensor assembly adapted to detect a position of the at least one pipe joint to be lubricated and to transmit at least one position signal; and a lubrication controller adapted to receive the at least one position signal and to operate the pipe lubrication assembly.

13. The pipe handling system of claim 12 wherein the lubricate sensor assembly comprises a pipe section position sensor adapted to detect a position of a particular pipe section being transported to the spindle connection area.

14. The pipe handling system of claim 12 wherein the lubrication controller is further adapted to cause the pipe lubrication assembly to apply lubricant to the spindle pipe joint and to an exposed pipe joint of the drill string after the spindle has disconnected from the drill string.

15. The pipe handling system of claim 12 wherein the lubrication controller is further adapted to cause the pipe lubrication assembly to apply lubricant to an exposed pipe joint of the drill string prior to the spindle connecting to the drill string.

16. The pipe handling system of claim 1 wherein the pipe handling assembly comprises at least one gripper device adapted to stabilize the at least one pipe section in the spindle connection area while the spindle pipe joint is being connected or disconnected.

17. The pipe handling system of claim 1 wherein the makeup/breakout assembly comprises:

a first wrench adapted to grip and to hold the drill string; and a second wrench adapted to grip and to rotate the at least one pipe section in the spindle connection area.

18. The pipe handling system of claim 17 wherein:

the first wrench comprises a plurality of gripping members; and the second wrench comprises a plurality of gripping members.

19. The pipe handling system of claim 1 wherein the makeup/breakout assembly comprises:

a first wrench adapted to grip and to hold the drill string;

a second wrench adapted to grip and to hold the at least one pipe section in the spindle connection area; and a spindle collar wrench adapted to lock the at least one pipe section in the spindle connection area for rotation with the spindle.

20. The pipe handling system of claim 19 wherein:

the first wrench comprises a plurality of opposing surfaces adapted to engage corresponding flats on an exposed end of the drill string;

the second wrench comprises a plurality of opposing surfaces adapted to engage corresponding flats on ends of the pipe sections; and the spindle collar wrench is mounted on the spindle and comprises at least one continuous surface adapted to engage corresponding flats on ends of the pipe sections.

21. The pipe handling system of claim 20 wherein the first wrench is adapted to move between a first position and a second position, the opposing surfaces of the first wrench engaging flats on the exposed end of the drill string when the first wrench is in the second position so that the drill string is prevented from rotating.

22. The pipe handling system of claim 20 wherein the second wrench is adapted to move between a first position and a second position, the opposing surfaces of the second wrench engaging flats on an end of the at least one pipe section in the spindle connection area when the second wrench is in the second position so that the at least one pipe section in the spindle connection area is prevented from rotating.

23. The pipe handling system of claim 20 wherein the spindle collar wrench is adapted to move between a disengaged position and an engaged position, the at least one surface of the spindle collar wrench engaging flats on an end of the at least one pipe section in the spindle connection area when the spindle collar wrench is in the engaged position so that the at least one pipe section in the spindle connection area is locked to rotate with the spindle.

24. The pipe handling system of claim 1 wherein the makeup/breakout control system comprises:

a connection sensor assembly adapted to transmit at least one signal to indicate when the makeup/breakout assembly is to be operated; and a connection controller adapted to receive the at least one signal and to operate the makeup/breakout assembly.

25. The pipe handling system of claim 24 wherein the connection sensor assembly comprises:

a spindle position sensor adapted to detect a position of the spindle and to transmit a spindle position signal; and a spindle torque sensor adapted to detect when the spindle is connected to the drill string and to transmit a spindle connection signal.

26. The pipe handling system of claim 24 wherein the connection controller is further adapted to engage a first wrench and then disengage the first wrench in response to a signal indicating the at least one pipe section in the spindle connection area is connected to the drill string.

27. The pipe handling system of claim 24 wherein the connection controller is further adapted to engage a first wrench and a second wrench, disengage the second wrench in response to a signal indicating the spindle is disconnected from the at least one pipe section in the spindle connection area, engage a spindle collar wrench, disengage the spindle collar wrench in response to a signal indicating the at least one pipe section in the spindle connection area is disconnected from the drill string, and disengage the first wrench in response to a signal indicating the spindle is reconnected to the drill string.

28. The pipe handling system of claim 1 wherein the pipe handling assembly comprises:

a magazine adapted to store the pipe sections; and a transport assembly adapted to transport at least one pipe section between the magazine and the spindle connection area.

29. The pipe handling system of claim 28 wherein the transport assembly further comprises:

a transport member; and a drive assembly adapted to drive the movement of the transport member;

wherein the transport member is adapted to receive and to release at least one of the pipe sections; and wherein the drive assembly is adapted to shuttle the transport member to and from the spindle connection area.

30. The pipe handling system of claim 29 further comprising at least one gripper device supportable on the transport member and adapted to stabilize the at least one pipe section in the spindle connection area.

31. The pipe handling system of claim 1 wherein the handling assembly control system comprises:

a handling system sensor assembly adapted to transmit at least one signal to indicate when the pipe handling assembly is to be operated; and a handling assembly controller adapted to receive the at least one signal and to operate the pipe handling assembly.

32. The pipe handling system of claim 31 wherein the sensor assembly comprises:

a spindle position sensor adapted to detect a position of the spindle and to transmit a spindle position signal; and a holding member position sensor adapted to detect a position for storing and receiving pipe sections and to transmit a holding member position signal.

33. The pipe handling system of claim 32 wherein the sensor assembly further comprises:

a spindle torque sensor adapted to detect when the spindle is connected to the drill string and to transmit a spindle connection signal.

34. The pipe handling system of claim 31 wherein the controller is further adapted to retrieve a particular pipe section from a magazine into a pipe holding member, to extend the pipe holding member from a position beneath the magazine to the spindle connection area, and to retract the pipe holding member to a selected position beneath the magazine in response to a signal indicating the particular pipe section is connected to the drill string.

35. The pipe handling system of claim 31 wherein the controller is further adapted to extend a pipe holding member from a position beneath a magazine to the spindle connection area in order to retrieve a particular pipe section from the spindle connection area, to retract the pipe holding member to a selected position beneath the magazine in response to a signal indicating the particular pipe section is disconnected from the drill string, and to store the particular pipe section in the magazine.

36. A control system for a pipe handling system for use with a horizontal boring machine, the pipe handling system comprising a pipe handling assembly for storing and transporting pipe sections having pipe joints, a pipe lubrication assembly for lubricating at least one pipe joint, and a makeup/breakout assembly, the control system comprising:

a handling assembly control system adapted to automatically operate the pipe handling assembly by initiating and coordinating a plurality of operations executed by the pipe handling assembly;

a pipe lubrication control system adapted to automatically operate the pipe lubrication assembly by initiating and coordinating the plurality of operations executed by the pipe lubrication assembly; and a makeup/breakout control system adapted to automatically operate the makeup/breakout assembly by initiating and coordinating the plurality of operations executed by the makeup/breakout assembly.

37. The control system of claim 36 wherein the pipe lubrication control system comprises:

a lubricate sensor assembly adapted to detect a position of the at least one pipe joint to be lubricated and to transmit at least one position signal; and a lubrication controller adapted to receive the at least one position signal and to operate the pipe lubrication assembly.

38. The control system of claim 36 wherein the makeup/breakout control system comprises:

a connection sensor assembly adapted to transmit at least one signal to indicate when the makeup/breakout assembly is to be operated; and a connection controller adapted to receive the at least one signal and to operate the makeup/breakout assembly.

39. The control system of claim 36 wherein the handling assembly control system comprises:

a handling system sensor assembly adapted to transmit at least one signal to synchronize the operation of the pipe handling assembly; and a handling assembly controller adapted to receive the at least one signal and to operate the pipe handling assembly.

40. A pipe handling system for use with a horizontal boring machine having a drive system, a drill string comprised of a plurality of pipe sections connectable at pipe joints, a spindle comprising a spindle pipe joint for connecting the drill string to the drive system, and a spindle connection area, the pipe handling system comprising:

a pipe handling assembly adapted to store and to transport pipe sections to and from the boring machine by executing a plurality of operations; and a handling assembly control system adapted to automatically operate the pipe handling assembly by initiating and coordinating the plurality of operations executed by the pipe handling assembly.

41. The pipe handling system of claim 40 wherein the pipe handling assembly comprises:

a magazine adapted to store a plurality of pipe sections;

a transport assembly adapted to transport at least one pipe section between the magazine and the connection area.

42. The pipe handling system of claim 41 wherein the transport assembly further comprises:

a transport member; and a drive assembly adapted to drive a movement of the transport member;

wherein the transport member is adapted to receive and to release the at least one pipe section; and wherein the drive assembly is adapted to shuttle the transport member between the magazine and the connection area.

43. The pipe handling system of claim 42 further comprising at least one gripper device supportable on the transport member and adapted to stabilize the at least one pipe section in the connection area.

44. The pipe handling system of claim 40 wherein the handling assembly control system comprises:

a handling system sensor assembly adapted to detect when the pipe handling assembly is to be operated and transmit at least one signal; and a handling assembly controller adapted to receive the at least one signal and to operate the pipe handling assembly.

45. The pipe handling system of claim 44 wherein the controller is further adapted to retrieve a particular pipe section from a magazine into a pipe holding member, to extend the pipe holding member from a position beneath the magazine to the connection area, and to retract the pipe holding member to the position beneath the magazine in response to the at least one signal.

46. The pipe handling system of claim 44 wherein the controller is further adapted to extend a pipe holding member from a position beneath a magazine to the connection area in order to retrieve a particular pipe section from the connection area, to retract the pipe holding member to the position beneath the magazine in response to the at least one signal indicating the particular pipe section is to be returned to the magazine, and to store the particular pipe section in the magazine.

47. A pipe lubrication system for use with a horizontal boring machine having a pipe handling system comprising a pipe handling assembly for storing and transporting a plurality of pipe sections to and from the horizontal boring machine, the pipe sections having pipe joints at opposing ends of each of the pipe sections, the pipe lubrication system comprising:

a pipe lubrication assembly adapted to apply lubricant to at least one pipe joint by executing a plurality of operations; and a pipe lubrication control system adapted to automatically operate the pipe lubrication assembly by initiating and coordinating the plurality of operations executed by the pipe lubrication assembly.

48. The pipe lubrication system of claim 47 wherein the pipe lubrication assembly comprises:

a lubricant reservoir;

a pump system; and an applicator;

wherein the pump system is adapted to transfer lubricant from the lubricant reservoir to the applicator.

49. The pipe lubrication system of claim 48 wherein the pump system comprises a hydraulic pump.

50. The pipe handling system of claim 48 wherein the applicator comprises a nozzle assembly.

51. The pipe lubrication system of claim 50 wherein the nozzle assembly comprises:

a first spray nozzle positioned to apply lubricant to a first pipe joint; and a second spray nozzle positioned to apply lubricant to a second pipe joint.

52. The pipe lubrication system of claim 48 wherein the pump system comprises a pneumatic pump.

53. The pipe lubrication system of claim 48 wherein the pump system comprises:

a rotatable shaft;

a piston operatively connectable to the rotatable shaft and adapted to pump lubricant out of the lubricant reservoir; and a movable arm having a first end and a second end, the first end connected to the rotatable shaft and the second end positioned to contact a particular pipe section being transported by the pipe handling assembly.

54. The pipe lubrication system of claim 53 wherein the applicator is positioned to contact a particular pipe joint of the particular pipe section being transported by the pipe handling assembly, such that as the pipe joint comes into contact with the applicator, lubricant is wiped onto the particular pipe joint.

55. The pipe lubrication system of claim 47 wherein the pipe lubrication control system comprises:

a lubricate sensor assembly adapted to detect a position of the at least one pipe joint to be lubricated and to transmit at least one signal indicating the at least one pipe joint is in position to be lubricated; and a lubrication controller adapted to receive the at least one signal and to operate the pipe lubrication assembly.

56. The pipe lubrication system of claim 55 wherein the lubrication controller is further adapted to cause the pipe lubrication assembly to apply lubricant to a first pipe joint of a first pipe section and a second pipe joint of a second pipe section.

57. A makeup/breakout system for use with a horizontal boring machine having a drive system, a drill string comprised of a plurality of pipe sections connectable at threaded pipe joints, a spindle comprising a spindle pipe joint for connecting the drill string to the drive system and a spindle connection area, the makeup/breakout system comprising:

a makeup/breakout assembly adapted to secure the drill string and at least one pipe section in the spindle connection area as the at least one pipe section is connected to, or disconnected from, the drill string by executing a plurality of operations; and a makeup/breakout control system adapted to automatically operate the makeup/breakout assembly by initiating and coordinating the plurality of operations executed by the makeup/breakout assembly.

58. The makeup/breakout system of claim 57 wherein the makeup/breakout assembly comprises:

a first wrench adapted to grip and to hold the drill string; and a second wrench adapted to grip and to rotate the at least one pipe section in the spindle connection area.

59. The makeup/breakout system of claim 58 wherein:

the first wrench comprises a plurality of gripping members; and the second wrench comprises a plurality of gripping members.

60. The makeup/breakout system of claim 57 wherein the makeup/breakout assembly comprises:

a first wrench adapted to grip and to hold the drill string;

a second wrench adapted to grip and to hold the at least one pipe section in the spindle connection area; and a spindle collar wrench adapted to lock the at least one pipe section in the spindle connection area for rotation with the spindle.

61. The makeup/breakout system of claim 60 wherein:

the first wrench comprises a plurality of opposing surfaces adapted to engage corresponding flats on an exposed end of the drill string;

the second wrench comprises a plurality of opposing surfaces adapted to engage corresponding flats on ends of the pipe sections; and the spindle collar wrench is mounted on the spindle and comprises at least one continuous surface adapted to engage corresponding flats on the ends of the pipe sections.

62. The makeup/breakout system of claim 61 wherein the first wrench is adapted to move between a first position and a second position, the opposing surfaces of the first wrench engaging flats on the exposed end of the drill string when the first wrench is in the second position so that the drill string is prevented from rotating.

63. The makeup/breakout system of claim 61 wherein the second wrench is adapted to move between a first position and a second position, the opposing surfaces of the second wrench engaging flats on an end of the at least one pipe section in the connection area when the second wrench is in the second position so that the at least one pipe section in the connection area is prevented from rotating.

64. The makeup/breakout system of claim 61 wherein the spindle collar wrench is adapted to move between a disengaged position and an engaged position, the at least one surface of the spindle collar wrench engaging flats of an end of the at least one pipe section in the connection area when the spindle collar wrench is in the engaged position so that the at least one pipe section in the connection area is locked to rotate with the spindle.

65. The makeup/breakout system of claim 57 wherein the makeup/breakout control system comprises:

a connection sensor assembly adapted to detect when the makeup/breakout assembly is to be operated and to transmit at least one signal; and a connection controller adapted to receive the at least one signal and to operate the makeup/breakout assembly.

66. The makeup/breakout system of claim 65 wherein the connection controller is further adapted to engage a first wrench and to then disengage the first wrench in response to the a signal indicating the pipe section in the spindle connection area is connected to the drill string.

67. The makeup/breakout system of claim 65 wherein the connection controller is further adapted to engage a first wrench and a second wrench, to disengage the second wrench in response to a signal indicating the spindle is disconnected from a particular pipe section in the connection area, to engage a spindle collar wrench, to disengage the spindle collar wrench in response to a signal indicating the particular pipe section is disconnected from the drill string, and to disengage the first wrench.

68. A horizontal boring machine comprising:

a frame;

a drill string comprised of a plurality of pipe sections connectable at threaded pipe joints;

a drive system attachable to the frame adapted to rotate and to axially advance the drill string substantially horizontally through the earth, the drive system having a spindle comprising a spindle pipe joint for connecting the drive system to the drill string; and an automated pipe handling system adapted to add and to retrieve pipe sections to and from the drill string by executing a plurality of operations, the automated pipe handling system comprising:

a pipe handling assembly adapted to transport the pipe sections to and from a spindle connection area;

a makeup/breakout assembly adapted to secure the drill string and at least one pipe section as the at least one pipe section is connected to or disconnected from the drill string; and a control system adapted to operate the pipe handling system by initiating and coordinating the plurality of operations.

69. The horizontal boring machine of claim 68 further comprising:

a pipe lubrication assembly adapted to apply lubricant to at least one pipe joint.

70. The horizontal boring machine of claim 69 wherein the pipe lubrication assembly comprises:

a lubricant reservoir;

a pump system; and an applicator;

wherein the pump system is adapted to transfer lubricant from the lubricant reservoir to the applicator.

71. The horizontal boring machine of claim 70 wherein the pump system comprises a hydraulic pump.

72. The horizontal boring machine of claim 70 wherein the applicator comprises a nozzle assembly.

73. The horizontal boring machine of claim 72 wherein the nozzle assembly comprises:

a first spray nozzle positioned to apply lubricant to the spindle pipe joint; and a second spray nozzle positioned to apply lubricant to an exposed pipe joint of the drill string.

74. The horizontal boring machine of claim 72 wherein the nozzle assembly comprises:

a first spray nozzle positioned to apply lubricant to a pipe joint of a pipe section in the spindle connection area at an end of the pipe section proximate the spindle pipe joint; and a second spray nozzle positioned to apply lubricant to an exposed pipe joint of the drill string.

75. The horizontal boring machine of claim 70 wherein the pump system comprises a pneumatic pump.

76. The horizontal boring machine of claim 70 wherein the pump system comprises:

a rotatable shaft;

a piston operatively connectable to the rotatable shaft and adapted to pump lubricant out of the lubricant reservoir; and a movable arm having a first end and a second end, the first end connected to the rotatable shaft and the second end positioned to contact a particular pipe section being transported to the spindle connection area.

77. The horizontal boring machine of claim 76 wherein the applicator is positioned to contact a particular pipe joint of the particular pipe section, such that as the particular pipe joint comes into contact with the applicator, lubricant is wiped onto the particular pipe joint.

78. The horizontal boring machine of claim 68 wherein the pipe handling assembly comprises at least one gripper device adapted to stabilize the at least one pipe section in the spindle connection area while the spindle pipe joint is being connected or disconnected.

79. The horizontal boring machine of claim 68 wherein the makeup/breakout assembly comprises:

a first wrench adapted to grip and to hold the drill string; and a second wrench adapted to grip and to rotate the at least one pipe section in the spindle connection area.

80. The horizontal boring machine of claim 79 wherein:

the first wrench comprises a plurality of gripping members; and the second wrench comprises a plurality of gripping members.

81. The horizontal boring machine of claim 68 wherein the makeup/breakout assembly comprises:

a first wrench adapted to grip and to hold the drill string;

a second wrench adapted to grip and to hold the at least one pipe section in the spindle connection area; and a spindle collar wrench adapted to lock the at least one pipe section in the spindle connection area for rotation with the spindle.

82. The horizontal boring machine of claim 81 wherein:

the first wrench comprises a plurality of opposing surfaces adapted to engage corresponding flats on an exposed end of the drill string;

the second wrench comprises a plurality of opposing surfaces adapted to engage corresponding flats on ends of the pipe sections; and the spindle collar wrench is mounted on the spindle and comprises at least one continuous surface adapted to engage corresponding flats on ends of the pipe sections.

83. The horizontal boring machine of claim 82 wherein the first wrench is adapted to move between a first position and a second position, the opposing surfaces of the first wrench engaging flats on an exposed end of the drill string when the first wrench is in the second position so that the drill string is prevented from rotating.

84. The horizontal boring machine of claim 82 wherein the second wrench is adapted to move between a first position and a second position, the opposing surfaces of the second wrench engaging flats on an end of the at least one pipe section in the spindle connection area when the second wrench is in the second position so that the at least one pipe section in the spindle connection area is prevented from rotating.

85. The horizontal boring machine of claim 82 wherein the spindle collar wrench is adapted to move between a disengaged position and an engaged position, the at least one surface of the spindle collar wrench engaging flats of an end of the at least one pipe section in the spindle connection area when the spindle collar wrench is in the engaged position so that the at least one pipe section in the spindle connection area is locked to rotate with the spindle.

86. The horizontal boring machine of claim 68 wherein the pipe handling assembly comprises:

a magazine adapted to store the pipe sections;

a transport assembly adapted to transport at least one pipe section between the magazine and the spindle connection area.

87. The horizontal boring machine of claim 86 wherein the transport assembly further comprises:

a transport member; and a drive assembly adapted to drive a movement of the transport member;

wherein the transport member is adapted to receive and to release at least one of the pipe sections; and wherein the drive assembly is adapted to shuttle the transport member to and from the spindle connection area.

88. The horizontal boring machine of claim 87 further comprising at least one gripper device supportable on the transport member and adapted to stabilize the at least one pipe section in the in the spindle connection area.

89. The horizontal boring machine of claim 69 further comprising:

a pipe lubrication control system adapted to automatically operate the pipe lubrication assembly by initiating and coordinating a plurality of operations executed by the pipe lubrication assembly.

90. The horizontal boring machine of claim 89 wherein the pipe lubrication control system comprises:

a lubricate sensor assembly adapted to detect a position of the at least one pipe joint to be lubricated and to transmit at least one position signal; and a lubrication controller adapted to receive the at least one position signal and to operate the pipe lubrication assembly.

91. The horizontal boring machine of claim 90 wherein the lubricate sensor assembly comprises a pipe section position sensor adapted to detect a position of a particular pipe section being transported to the spindle connection area.

92. The horizontal boring machine of claim 90 wherein the lubrication controller is further adapted to cause the pipe lubrication assembly to apply lubricant to the spindle pipe joint and to an exposed pipe joint of the drill string after the spindle has disconnected from the drill string.

93. The horizontal boring machine of claim 90 wherein the lubrication controller is further adapted to cause the pipe lubrication assembly to apply lubricant to an exposed pipe joint of the drill string prior to the spindle connecting to the drill string.

94. The horizontal boring machine of claim 68 wherein the control system comprises:

a handling assembly control system adapted to automatically operate the pipe handling assembly; and a makeup/breakout control system adapted to automatically operate the makeup/breakout assembly.

95. The horizontal boring machine of claim 94 wherein the pipe handling control system comprises:

a handling system sensor assembly adapted to transmit at least one signal to indicate when the pipe handling assembly is to be operated; and a handling assembly controller adapted to receive the at least one signal and to operate the pipe handling assembly.

96. The horizontal boring machine of claim 95 wherein the sensor assembly comprises:

a spindle position sensor adapted to detect a position of the spindle and to transmit a spindle position signal; and a holding member position sensor adapted to detect a position of a particular pipe section being transported to the spindle connection area and to transmit a holding member position signal.

97. The horizontal boring machine of claim 96 wherein the sensor assembly further comprises:

a spindle torque sensor adapted to detect when the spindle is connected to the drill string and to transmit a spindle connection signal.

98. The horizontal boring machine of claim 95 wherein the handling assembly controller is further adapted to retrieve a pipe section from a magazine into a pipe holding member, extend the transport member from a position beneath the magazine to the spindle connection area; and retract the transport member to the position beneath the magazine in response to a signal indicating the pipe section is connected to the drill string.

99. The horizontal boring machine of claim 95 wherein the handling assembly controller is further adapted to extend a pipe holding member from a position beneath a magazine to the spindle connection area in order to retrieve a particular pipe section from the spindle connection area, to retract the pipe holding member to the position beneath the magazine in response to a signal indicating the particular pipe section is disconnected from the drill string, and to store the particular pipe section in the magazine.

100. The horizontal boring machine of claim 94 wherein the makeup/breakout control system comprises:

a connection sensor assembly adapted to transmit at least one signal to indicate when the makeup/breakout assembly is to be operated; and a connection controller adapted to receive the at least one signal and to operate the makeup/breakout assembly.

101. The horizontal boring machine of claim 100 wherein the connection sensor assembly comprises:

a spindle position sensor adapted to detect the position of the spindle in the spindle connection area and to transmit a spindle position signal; and a spindle torque sensor adapted to detect when the spindle is connected to the drill string and to transmit a spindle connection signal.

102. The horizontal boring machine of claim 100 wherein the connection controller is further adapted to engage a first wrench and to then disengage the first wrench in response to a signal indicating a particular pipe section in the spindle connection area is connected to the drill string.

103. The horizontal boring machine of claim 100 wherein the connection controller is further adapted to engage a first wrench and a second wrench, to disengage the second wrench in response to a signal indicating the spindle is disconnected from a particular pipe section in the spindle connection area, to engage a spindle collar wrench, to then disengage the spindle collar wrench in response to a signal indicating the particular pipe section in the spindle connection area is disconnected from the drill string, and to disengage the first wrench.

104. A method for drilling a horizontal borehole comprising:

advancing a boring tool through the earth using a drill string comprised of a plurality of pipe sections connected at threaded pipe joints; and repeatedly adding individual pipe sections to the drill string by performing a plurality of operations to transfer pipe sections to the drill string, wherein the plurality of operations are automatically initiated and coordinated.

105. The method of claim 104 further comprising performing a plurality of operations to apply lubricant to at least one pipe joint prior to adding each individual pipe section, wherein the plurality of operations are automatically initiated and coordinated.

106. The method of claim 105 wherein the plurality of operations for applying lubricant to the pipe joint comprises:

sensing a position of a particular pipe section being added to the drill string; and applying lubricant to a particular pipe joint on the drill string or to another pipe joint on the particular pipe section being added to the drill string.

107. The method of claim 104 further comprising performing a plurality of operations to secure the drill string while a particular pipe section being added to the drill string is rotated to engage a particular threaded connection, wherein the plurality of operations are automatically initiated and coordinated.

108. The method of claim 107 wherein the plurality of operations for securing the drill string comprises:

sensing a position of the drill string;

engaging a first wrench with the drill string;

sensing when the particular pipe section being added to the drill string has been connected to the drill string; and disengaging the first wrench.

109. The method of claim 104 wherein the plurality of operations for delivery of individual pipe sections to the drill string comprises:

retrieving a particular pipe section from a storage position in response to a signal indicating that the particular pipe section is to be added to the drill string; and transporting the particular pipe section to a connection area for connection to the drill string.

110. A method for backreaming a horizontal borehole comprising:

pulling a drill string composed of a plurality of pipe sections connected at threaded pipe joints back through a previously bored horizontal borehole; and repeatedly removing the pipe sections from the drill string as the drill string is shortened by performing a plurality of operations to transfer pipe sections away from the drill string, wherein the plurality of operations are automatically initiated and coordinated.

111. The method of claim 110 wherein the plurality of operations for transporting pipe sections away from the drill string comprises:

retrieving a particular pipe section from the drill string in response to a signal indicating that the particular pipe section is to be removed from the drill string; and transporting the particular pipe section to a storage position.

112. The method of claim 110 further comprising performing a plurality of operations to apply lubricant to a particular pipe joint on the drill string after a particular pipe section is removed from the drill string, wherein the plurality of operations are automatically initiated and coordinated.

113. The method of claim 112 wherein the plurality of operations for applying lubricant to the particular pipe joint comprises:

sensing when a particular pipe section has been removed from the drill string; and applying lubricant to the drill string before the drill string is further pulled back through the borehole.

114. The method of claim 110 further comprising performing a plurality of operations to secure the drill string while a particular pipe section being removed from the drill string is rotated to disconnect the threaded connection, wherein the plurality of operations are automatically initiated and coordinated.

115. The method of claim 114 wherein the plurality of operations for securing the drill string comprises:

sensing the position of the particular pipe section to be removed from the drill string;

engaging a first wrench with the drill string;

sensing when the particular pipe section to be removed from the drill string has been disconnected from the drill string; and disengaging the first wrench.

* * * * *